US008827657B1

(12) United States Patent
Priddy

(10) Patent No.: US 8,827,657 B1
(45) Date of Patent: Sep. 9, 2014

(54) CONCRETE PUMP SYSTEM AND METHOD

(71) Applicant: Francis Wayne Priddy, Bartonville, TX (US)

(72) Inventor: Francis Wayne Priddy, Bartonville, TX (US)

( * ) Notice: Subject to any disclaimer, the term of this patent is extended or adjusted under 35 U.S.C. 154(b) by 0 days.

(21) Appl. No.: 14/155,812

(22) Filed: Jan. 15, 2014

(51) Int. Cl.
*F04B 7/04* (2006.01)
*F04B 39/10* (2006.01)
*F16K 1/00* (2006.01)

(52) U.S. Cl.
USPC ..... 417/53; 417/519; 417/532; 417/900; 137/874

(58) Field of Classification Search
USPC ..... 417/517–519, 531, 532, 900, 53; 137/874
See application file for complete search history.

(56) References Cited

U.S. PATENT DOCUMENTS 3,663,129 A * 5/1972 Antosh ..... 417/516
3,909,160 A * 9/1975 Sherrod ..... 417/517
3,989,420 A * 11/1976 Taylor ..... 417/517
4,019,839 A * 4/1977 Schwing ..... 417/517
4,469,135 A * 9/1984 Gray ..... 137/625.45
4,653,990 A * 3/1987 Schlecht ..... 417/517
5,141,408 A * 8/1992 Conrad et al. ..... 417/339
5,380,174 A * 1/1995 Schwing ..... 417/519

* cited by examiner

*Primary Examiner* — Charles Freay
(74) *Attorney, Agent, or Firm* — Kevin M. Klughart; David W. Carstens; Carstens & Cahoon, LLP

(57) ABSTRACT

A concrete pump system/method configured to provide substantially constant flow of concrete or cement material is disclosed. The system integrates a trapezoidal cutting ring and spectacle plate in conjunction with lofted transitional interfaces to the hydraulic pump cylinder rams and output ejection port to ensure that pressurized discharge concrete material is not allowed to be relaxed nor backflow into the material sourcing hopper. The trapezoidal cutting ring is configured to completely seal off the trapezoidal spectacle ports as it smoothly transitions between the hydraulic pump input ports during cycle changes thus generating a more uniform output flow of concrete while eliminating hopper backflow and hydraulic fluid shock. A control system is configured to coordinate operation of the hydraulic pump cylinder rams and cutting ring to ensure that output ejection port pressure and material flow is maintained at a relatively constant level throughout all portions of the pumping cycle.

20 Claims, 66 Drawing Sheets

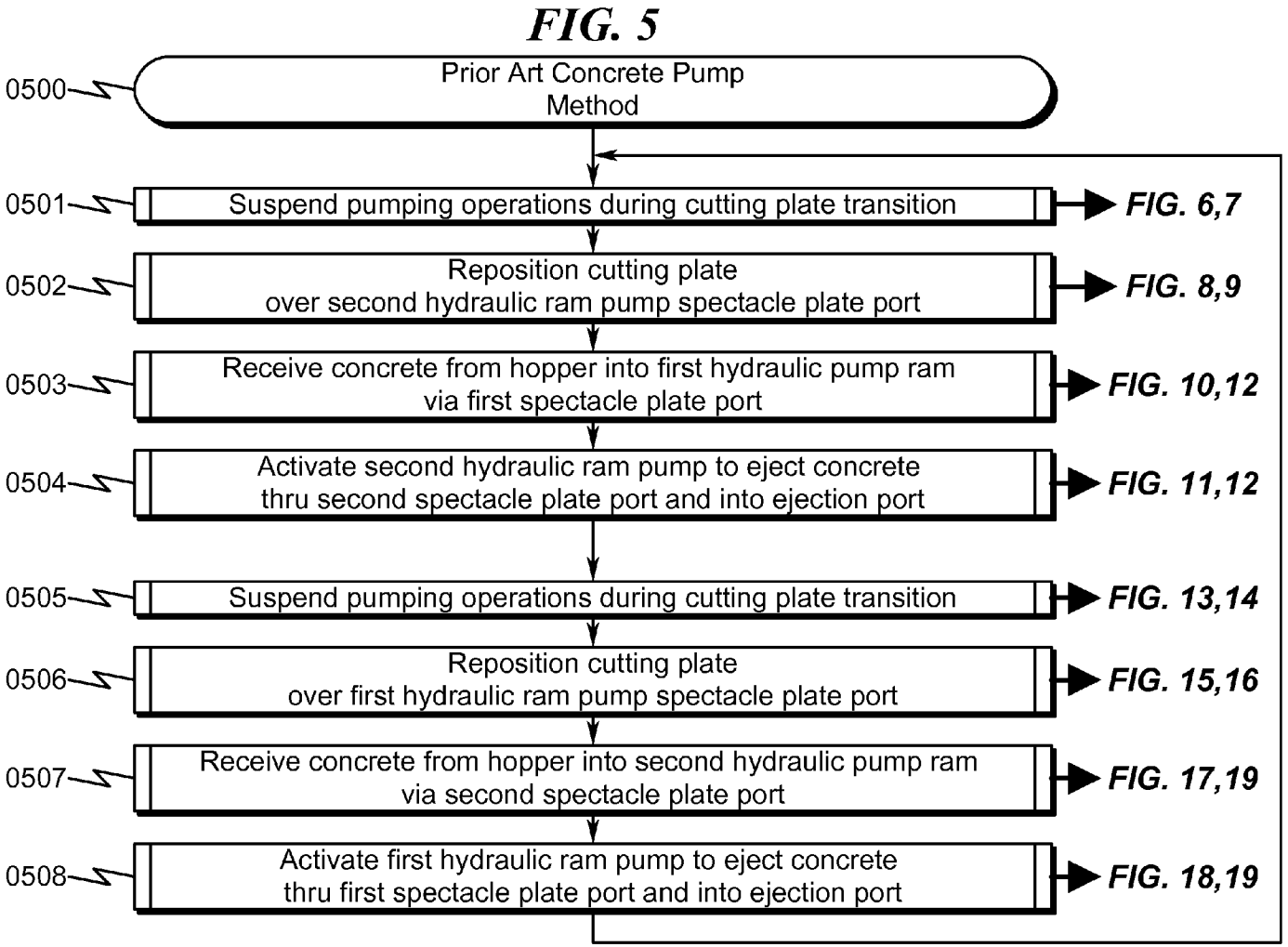
FIG. 5
Prior Art Concrete Pump Method
0500
0501
Suspend pumping operations during cutting plate transition
FIG. 6,7
0502
Reposition cutting plate over second hydraulic ram pump spectacle plate port
FIG. 8,9
0503
Receive concrete from hopper into first hydraulic pump ram via first spectacle plate port
FIG. 10,12
0504
Activate second hydraulic ram pump to eject concrete thru second spectacle plate port and into ejection port
FIG. 11,12
0505
Suspend pumping operations during cutting plate transition
FIG. 13,14
0506
Reposition cutting plate over first hydraulic ram pump spectacle plate port
FIG. 15,16
0507
Receive concrete from hopper into second hydraulic pump ram via second spectacle plate port
FIG. 17,19
0508
Activate first hydraulic ram pump to eject concrete thru first spectacle plate port and into ejection port
FIG. 18,19

2400

3800

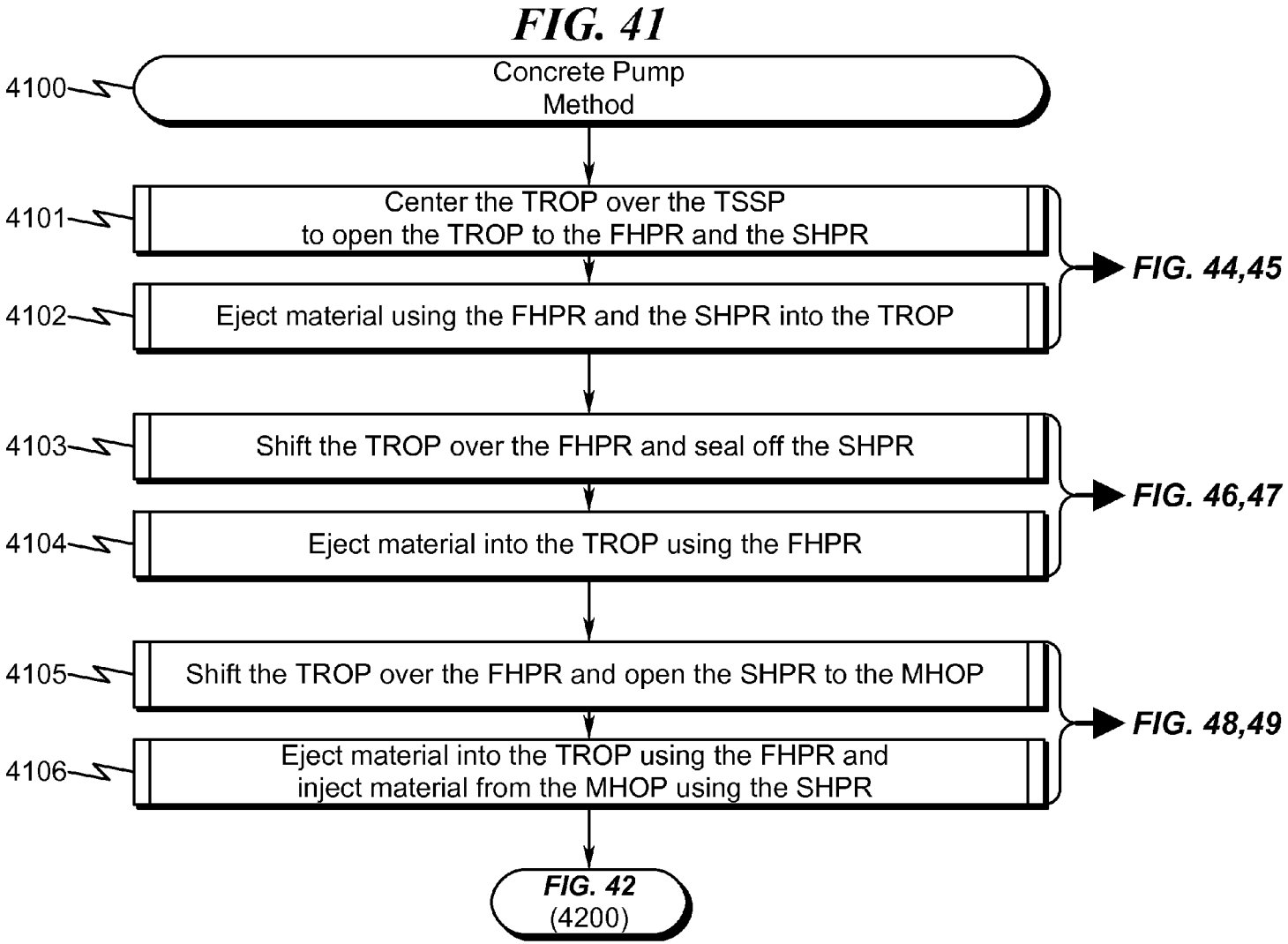
FIG. 41
Concrete Pump Method
4100
Center the TROP over the TSSP to open the TROP to the FHPR and the SHPR
4101
FIG. 44,45
Eject material using the FHPR and the SHPR into the TROP
4102
Shift the TROP over the FHPR and seal off the SHPR
4103
FIG. 46,47
Eject material into the TROP using the FHPR
4104
Shift the TROP over the FHPR and open the SHPR to the MHOP
4105
FIG. 48,49
Eject material into the TROP using the FHPR and inject material from the MHOP using the SHPR
4106
FIG. 42 (4200)

AZPRI.0101
(42/66)
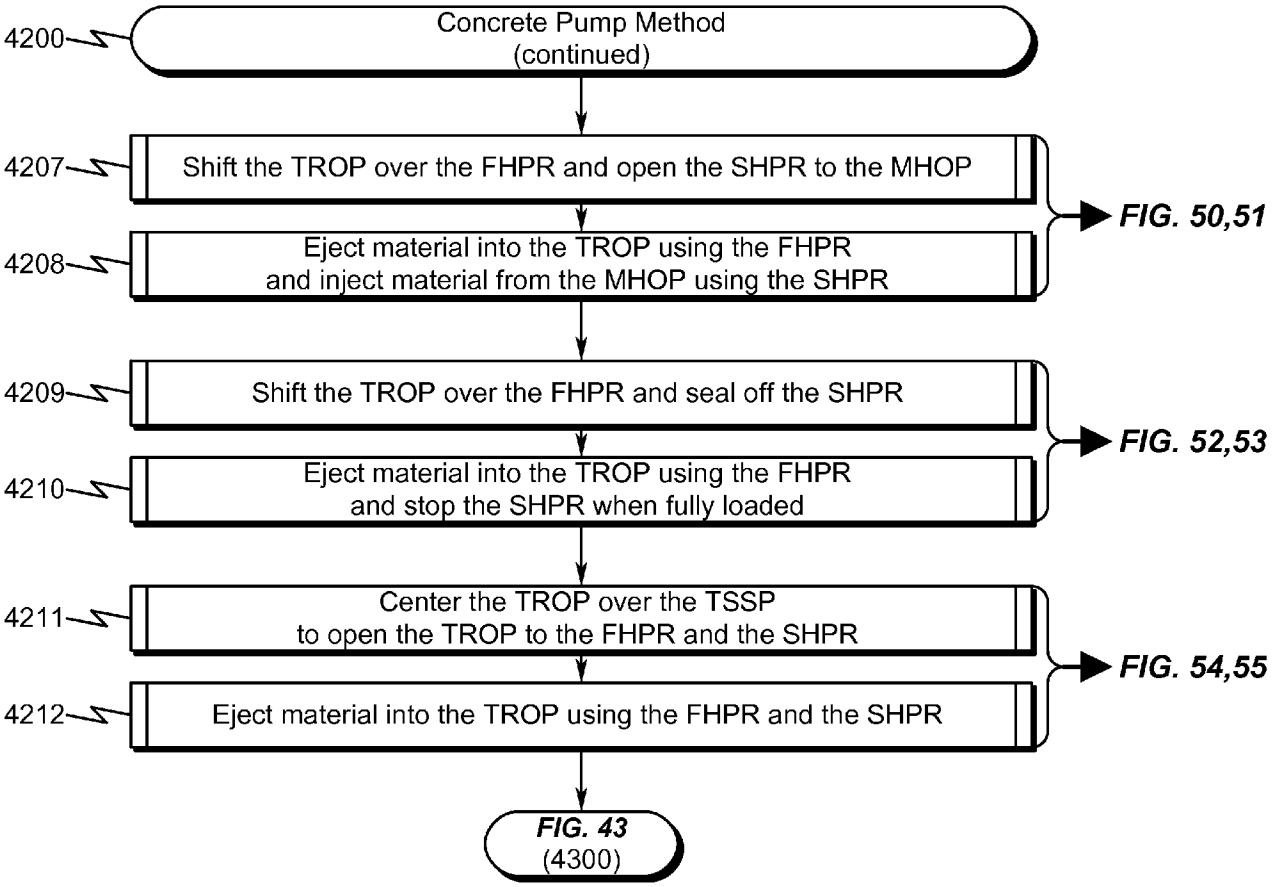

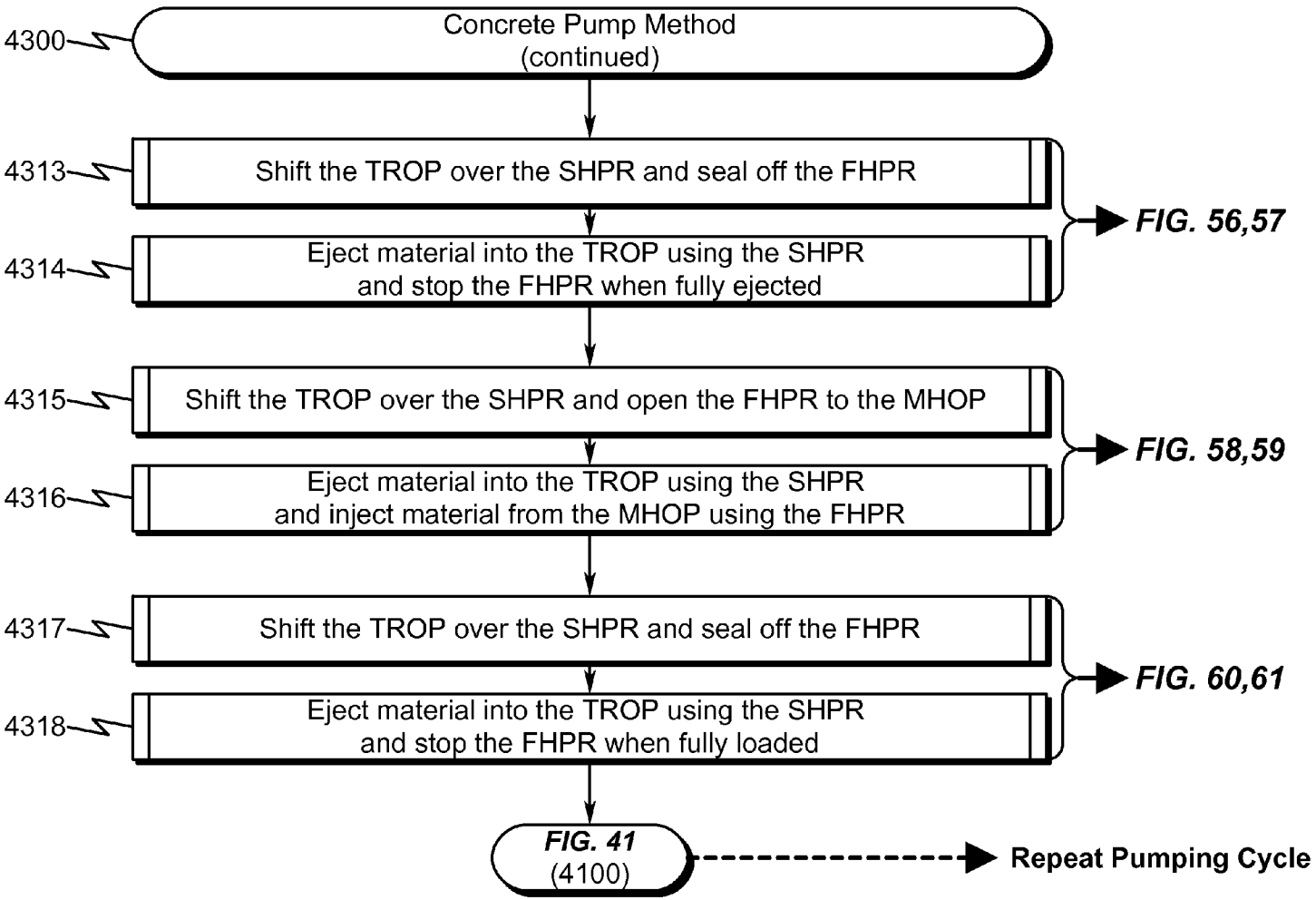
FIG. 43
Concrete Pump Method
(continued)
4300
Shift the TROP over the SHPR and seal off the FHPR
4313
FIG. 56,57
Eject material into the TROP using the SHPR
and stop the FHPR when fully ejected
4314
Shift the TROP over the SHPR and open the FHPR to the MHOP
4315
FIG. 58,59
Eject material into the TROP using the SHPR
and inject material from the MHOP using the FHPR
4316
Shift the TROP over the SHPR and seal off the FHPR
4317
FIG. 60,61
Eject material into the TROP using the SHPR
and stop the FHPR when fully loaded
4318
FIG. 41
(4100)
Repeat Pumping Cycle Prior Art

CONCRETE PUMP SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to systems and methods for pumping concrete and/or cement. Specifically, the present invention in many preferred embodiments has application to situations in which concrete/cement must be pumped with a uniform flow rate.

PRIOR ART AND BACKGROUND OF THE INVENTION

Background (0100)-(0400)

Conventional concrete pumps are typically configured in functional construction as depicted in FIG. 1 (0100)-FIG. 4 (0400). As illustrated in FIG. 1 (0100), it can be seen that a material hopper (MHOP) (0101) is filled with concrete/cement or other material that is to be pumped through an ejection port (0102) to a construction jobsite for delivery to a concrete form or other containment structure. Hydraulic pumps (0103, 0104) alternately are filled with material from the hopper (0101) using hydraulic pump rams (0105, 0106) and these same hydraulic pump rams (0105, 0106) are activated to push the material into the ejection port (0102) to the jobsite. The ejection port (0102) articulates between each hydraulic pump cylinder (0103, 0104) and their corresponding hydraulic pump ram (0105, 0106) by virtue of a driveshaft (0107) linked to a positioning means (0108) that is rotated by virtue of hydraulic positioning drivers (0109, 0110). Hydraulic pressure driving the hydraulic pump rams (0105, 0106) and the hydraulic positioning drivers (0109, 0110) is coordinated so that the material in the hopper is injected into a loading pump cylinder (0103, 0104) when the cylinder input port is open to the material hopper (0101) and transmitted to the ejection port (0102) when the other hydraulic pump ram (0105, 0106) is activated. The cycle alternates between injection in one pump cylinder port and ejection from the other pump cylinder port. As depicted in FIG. 4 (0400), a spectacle plate (0411) mates with the articulating ejection port (0102) based on the activation state of each hydraulic pump cylinder and corresponding hydraulic pump ram.

As depicted in the diagrams within FIG. 1 (0100)-FIG. 4 (0400), the spectacle plate (0411) and articulating ejection port (0102) typically operate in a two-state left/right operational mode and are configured such that there is a center transition region between the two cylinder ports in which no flow occurs from the pump cylinders (0103, 0104) to the articulating ejection port (0102). In this transition region the flow through the articulating ejection port (0102) will be abruptly stopped and started with backflow into the material hopper (0101), resulting in heightened stresses within the pump cylinders (0103, 0104) and piping/hoses connected to the articulating ejection port (0102). These heightened stresses can cause premature wear and/or failure of the pumping system as well as make manipulation of the hoses distributing the concrete difficult at the terminal job site. While some prior art configurations may utilize a pressurized pneumatic ballast (low pressure accumulator) connected to the articulating ejection port (0102) (not shown) to modulate the impulse pressure differentials associated with this operation, this workaround is not entirely successful in forcing a uniform material flow through the articulating ejection port (0102). Furthermore, this approach does not improve the wear and stress associated with the pump cylinders (0103, 0104) which may in some circumstances incorporate internal piston springs (not shown) or other modifications to limit the impulse pressure loads on the hydraulic drivers (0105, 0106).

One skilled in the art will recognize that the articulation of the driveshaft (0107) and positioning means (0108) may be accomplished using the hydraulic drivers (0109, 0110) as depicted or by using a wide variety of other mechanical means. The illustration of the hydraulic drivers (0109, 0110) in this context is only exemplary of a wide variety of methodologies to articulate the position of the material ejection port (0102).

Typical Pump Cycle (0500)-(1900)

To better understand the benefits of the present invention, a detailed review of conventional prior art concrete pumping systems is warranted. A typical method associated with a prior art concrete pumping cycle is depicted in the flowchart of FIG. 5 (0500) with supporting drawings illustrating the various steps depicted in FIG. 6 (0600)-FIG. 19 (1900). The typical pumping method includes the following steps:

(1) As depicted in FIG. 6 (0600) and FIG. 7 (0700), suspending pumping operations during the transition of the cutting plate/ejection port from the left to the right hydraulic pump ram (0501);

(2) As depicted in FIG. 8 (0800) and FIG. 9 (0900), repositioning the cutting plate/ejection port from the left to the right hydraulic pump ram (0502);

(3) As depicted in FIG. 10 (1000) and FIG. 12 (1200), receiving concrete from the material hopper into the first (left) hydraulic pump ram via the first (left) spectacle plate port in conjunction with step (4) (0503);

(4) As depicted in FIG. 11 (1100) and FIG. 12 (1200), activating the second hydraulic pump ram to eject concrete thru the second spectacle plate port and into the ejection port in conjunction with step (3) (0504);

(5) As depicted in FIG. 13 (1300) and FIG. 14 (1400), suspending pumping operations during the transition of the cutting plate/ejection port from the right to the left hydraulic pump ram (0505);

(6) As depicted in FIG. 15 (1500) and FIG. 16 (1600), repositioning the cutting plate/ejection port from the right to the left hydraulic pump ram (0506);

(7) As depicted in FIG. 17 (1700) and FIG. 19 (1900), receiving concrete from the material hopper into the second (right) hydraulic pump ram via the second (right) spectacle plate port in conjunction with step (8) (0507);

(8) As depicted in FIG. 18 (1800) and FIG. 19 (1900), activating the first hydraulic pump ram to eject concrete thru the first spectacle plate port and into the ejection port in conjunction with step (7) (0508); and (9) Proceeding to step (1) to repeat the pumping cycle.

As depicted in these steps and diagrams, the prior art concrete pumping method incurs suspended pumping operating when transitioning the ejection port from the left-to-right (0501, 0600, 0700) and right-to-left (0505, 1300, 1400) hydraulic pumping cylinders. Furthermore, as the ejection port moves over the spectacle plate there may be regions of operation where material from the ejection port may reflow/backflow into the material hopper (see detail in FIG. 6 (0600), FIG. 7 (0700), FIG. 13 (1300) and FIG. 14 (1400)), thus reducing the overall flow rate of concrete to the jobsite.

Typical Pump Cycle Flow Inefficiencies (2000)-(2400)

Within the traditional pumping cycle depicted in FIG. 6 (0600)-FIG. 19 (1900), several inefficiencies exist. FIG. 20 (2000)-FIG. 24 (2400) are provided to illustrate these inefficiencies by depicting only the hydraulic pump rams, spectacle plate, and output ejection port. As generally depicted in FIG. 20 (2000) and FIG. 21 (2100), when the ejection port is fully covering one of the two hydraulic pump ram pumps, material may be ejected from the right hydraulic pump to the ejection port and injected into the left hydraulic pump ram from the material hopper. In this state the ejection port (and corresponding piping to the job site) is fully sealed with respect to the pumping operation.

However, as generally depicted in FIG. 22 (2200) and FIG. 23 (2300), when the ejection port is partially covering one of the two hydraulic pump rams, material may backflow from the ejection port to the material hopper because the system is no longer fully sealed by the right hydraulic pump ram. This typically results in a reduction of pumping pressure and overall reduction in material moved by the pumping operation.

Finally, as generally depicted in FIG. 24 (2400), as the ejection port transitions between the right and left hydraulic pump rams there exists a "dead zone" where pumping operations are essentially suspended as neither hydraulic pump ram has access to the ejection port. This transition region results in an impulse reduction in pump flow that places stress on the ejection port and hydraulic pump rams. The reduction in pump flow during this transition period is an undesirable artifact of this conventional pump architecture.

DEFICIENCIES IN THE PRIOR ART

The prior art as detailed above suffers from the following deficiencies:

- Prior art concrete pump systems and methods do not sustain a constant flow of material through the ejection port.
- Prior art concrete pump systems and methods due to their non-uniform material flow may result in difficulties placing concrete at the job site due to the impulse nature of material flow from piping at the job site.
- Prior art concrete pump systems and methods incur one or more portions of the pumping cycle wherein no material is pumped through the ejection port.
- Prior art concrete pump systems and methods may permit material to reflow from the ejection port to the material hopper during one or more portions of the pumping cycle.
- Prior art concrete pump systems and methods generally incur spikes in hydraulic pressure during the center transition region of the output port, resulting in significant wear and stress on the hydraulic pump.
- Prior art concrete pump systems and methods generally require an accumulator or other device connected to the output port to modulate spikes in output material flow pressure.

While some of the prior art may teach some solutions to several of these problems, the core issue pumping concrete with a uniform delivery rate has not been solved by the prior art.

OBJECTIVES OF THE INVENTION

Accordingly, the objectives of the present invention are (among others) to circumvent the deficiencies in the prior art and affect the following objectives in the context of a concrete pump system and method:

(1) Provide for a concrete pump system and method that provides for a uniform material delivery rate.

(2) Provide for a concrete pump system and method that provides for an increased material delivery rate as compared to the prior art.

(3) Provide for a concrete pump system and method that minimizes or eliminates material reflow from the ejection port back into the material hopper.

(4) Provide for a concrete pump system and method that is easily retrofitted into existing concrete pump systems.

(5) Provide for a concrete pump system and method that does not require an accumulator or other devices to modulate impulse material flow.

(6) Provide for a concrete pump system and method that eases the placement of material at the job site by providing a uniform delivery flow through the output ejection port.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

The present invention as embodied in a system and method utilizes a trapezoidal-shaped spectacle plate and associated cutting ring in conjunction with coordination of hydraulic pump ram operation to ensure the following:

- The flow path from each hydraulic pump ram is never obstructed when transferring material to the ejection port.
- Each hydraulic pump ram is positively sealed off at the end of the pumping cycle to prevent material from reflowing from the ejection port back into the material hopper.

The trapezoidal-shaped spectacle plate is mated with a corresponding trapezoidal-shaped cutting ring that may be optionally fitted with sealing wings that ensure backflow from the ejection port is minimized or eliminated.

The system/method as described herein may be applied to conventional concrete pumping systems in which two hydraulic pump rams are used in a bipolar operation mode with a first hydraulic pump ram injecting material from the material hopper while the second hydraulic pump ram ejects material into the ejection port for delivery to the job site. In this configuration the ejection port and associated cutting plate articulates between the first and second hydraulic pump rams. However, the present invention also anticipates that the ejection port and cutting ring may be configured to support multiple injecting/ejecting hydraulic pump rams and thus permit "ganged" pumping into a common ejection port assembly that rotates between the hydraulic pump ram input ports. This configuration may permit improved overall pumping rates as compared to existing prior art concrete pumps.

BRIEF DESCRIPTION OF THE DRAWINGS

For a fuller understanding of the advantages provided by the invention, reference should be made to the following detailed description together with the accompanying drawings wherein:

FIG. 5 illustrates a typical prior art pumping method depicted in more detail in FIG. 6-FIG. 19;

FIG. 41 illustrates a flowchart depicting a preferred exemplary invention method described in more detail in FIG. 44-FIG. 61;

FIG. 42 illustrates a flowchart depicting a preferred exemplary invention method described in more detail in FIG. 44-FIG. 61;

FIG. 43 illustrates a flowchart depicting a preferred exemplary invention method described in more detail in FIG. 44-FIG. 61;

DESCRIPTION OF THE PRESENTLY PREFERRED EXEMPLARY EMBODIMENTS

Figure 1:
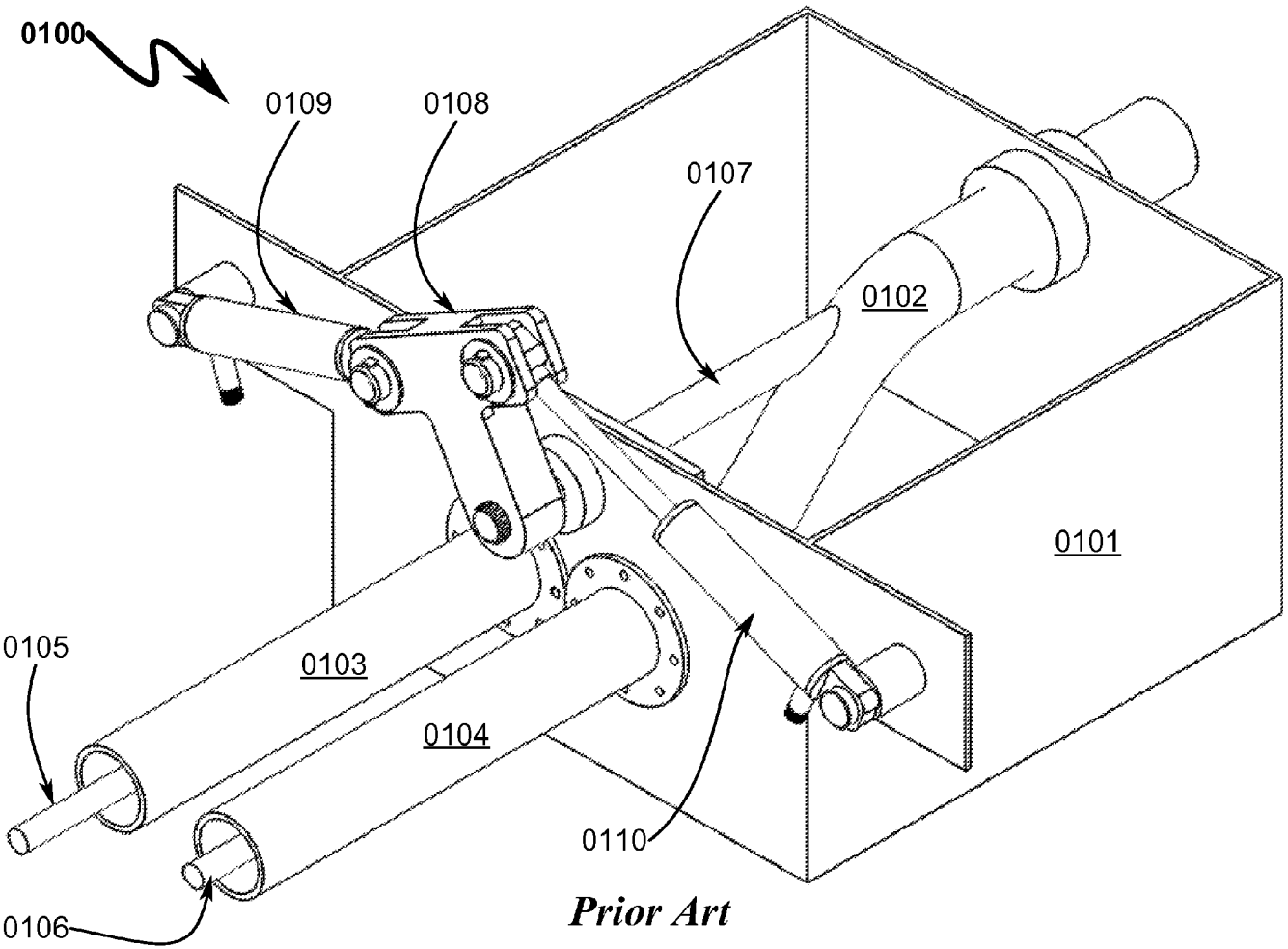
FIG. 1 Prior Art
FIG. 1 illustrates a front perspective view of a prior art concrete pump.
Figure 2:
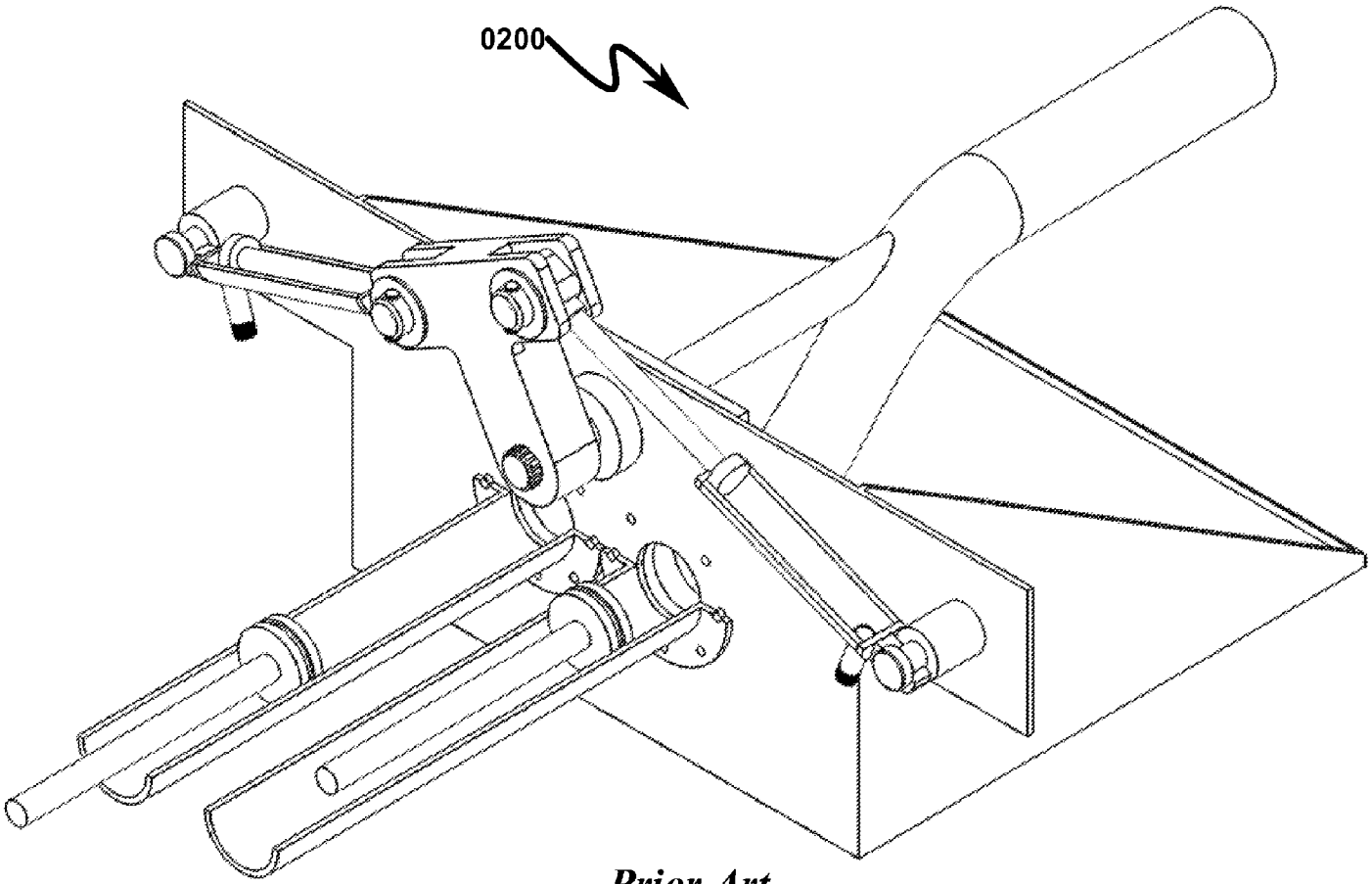
FIG. 2 Prior Art
FIG. 2 illustrates a front perspective sectional detail view of a prior art concrete pump.
Figure 3:
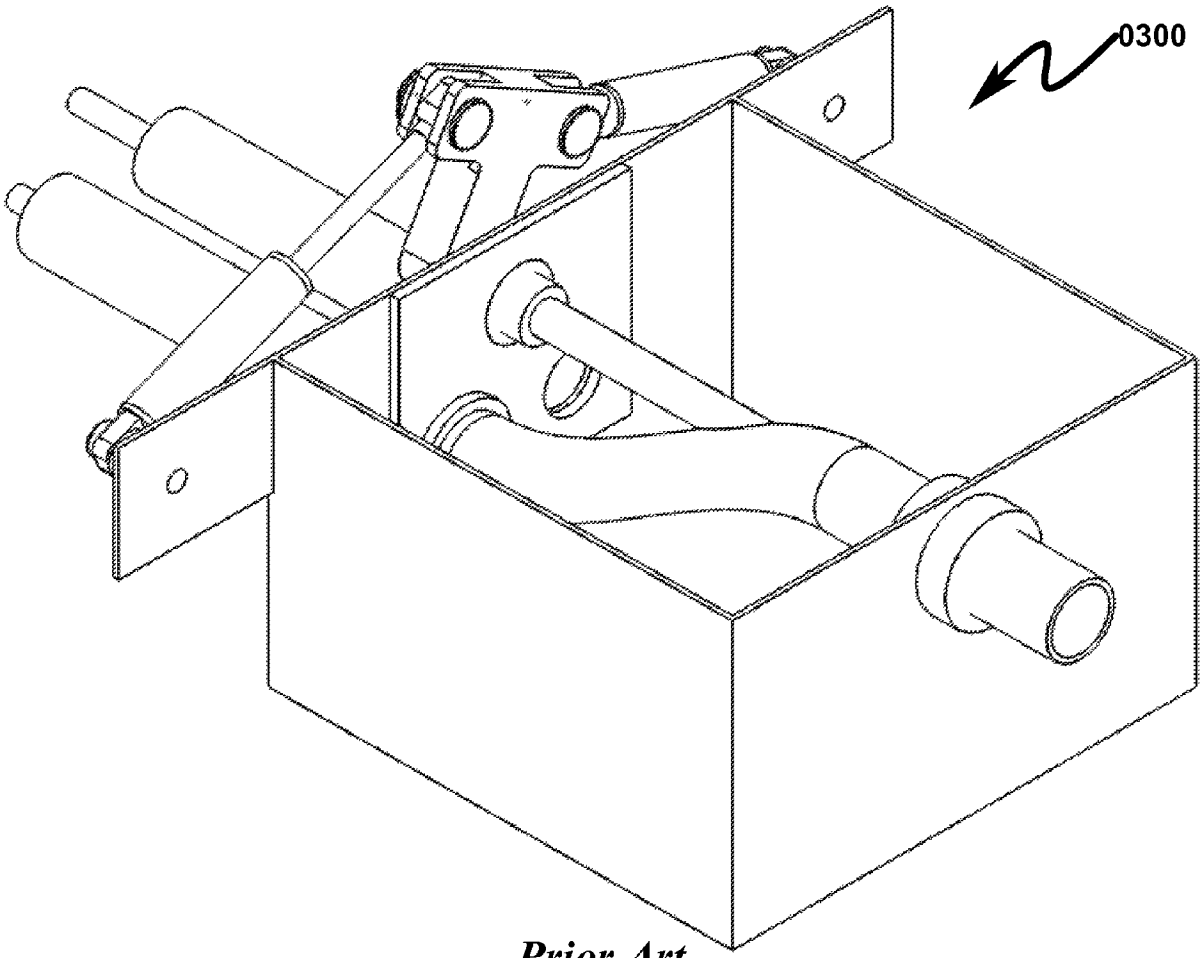
FIG. 3 Prior Art
FIG. 3 illustrates a rear perspective view of a prior art concrete pump.
Figure 4:
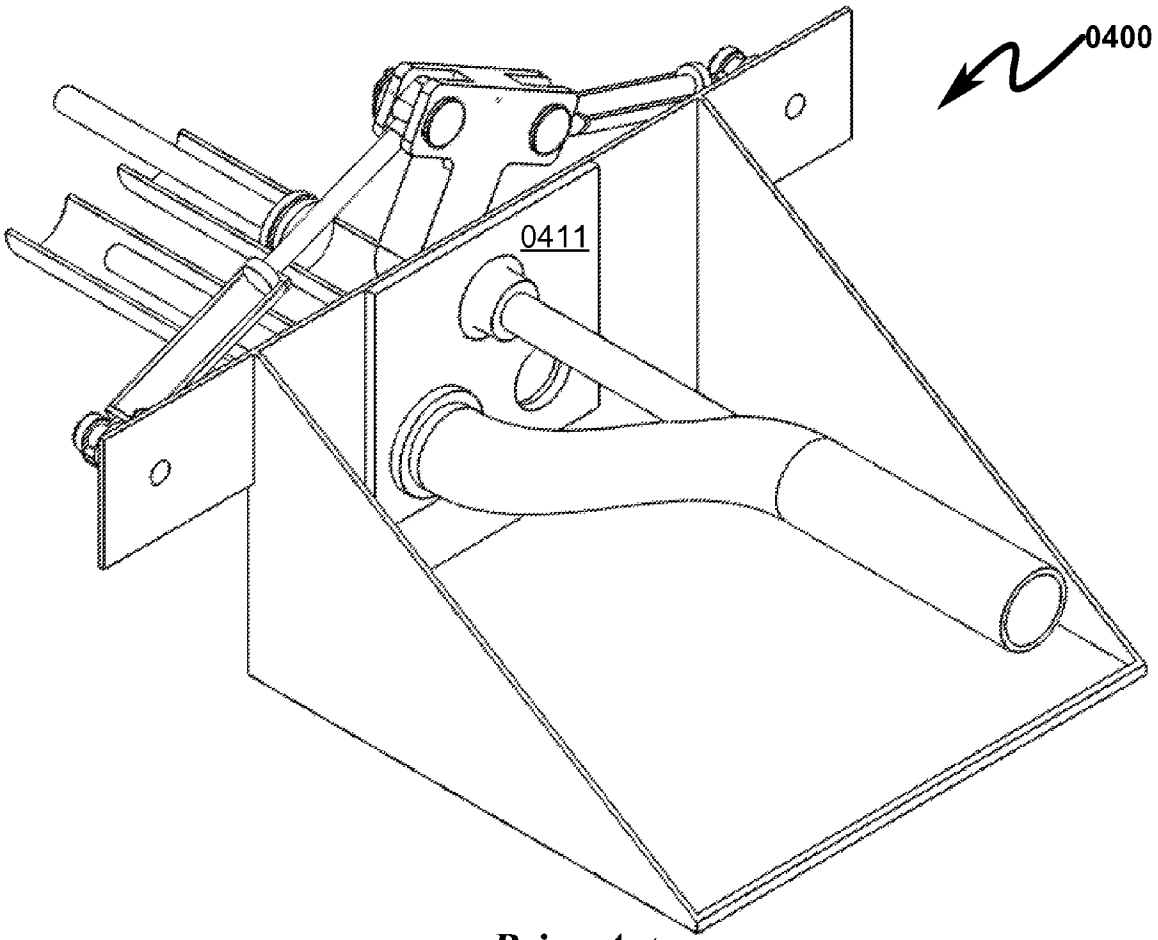
FIG. 4 Prior Art
FIG. 4 illustrates a rear perspective sectional detail view of a prior art concrete pump.
Figure 6:
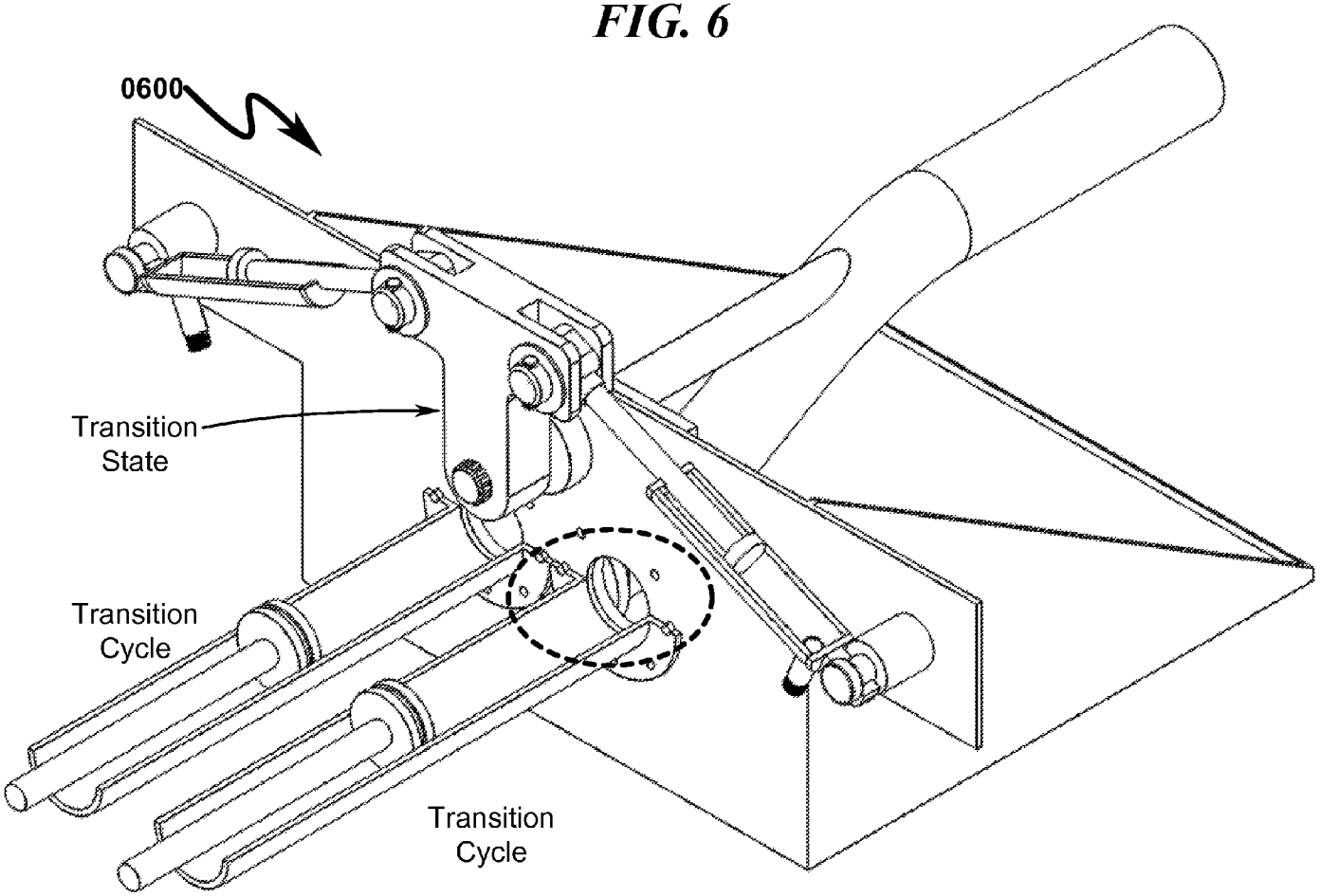
FIG. 6 Prior Art
FIG. 6 illustrates a front perspective sectional view of a prior art concrete pump in transition between left injection and right ejection cycles.
Figure 7:
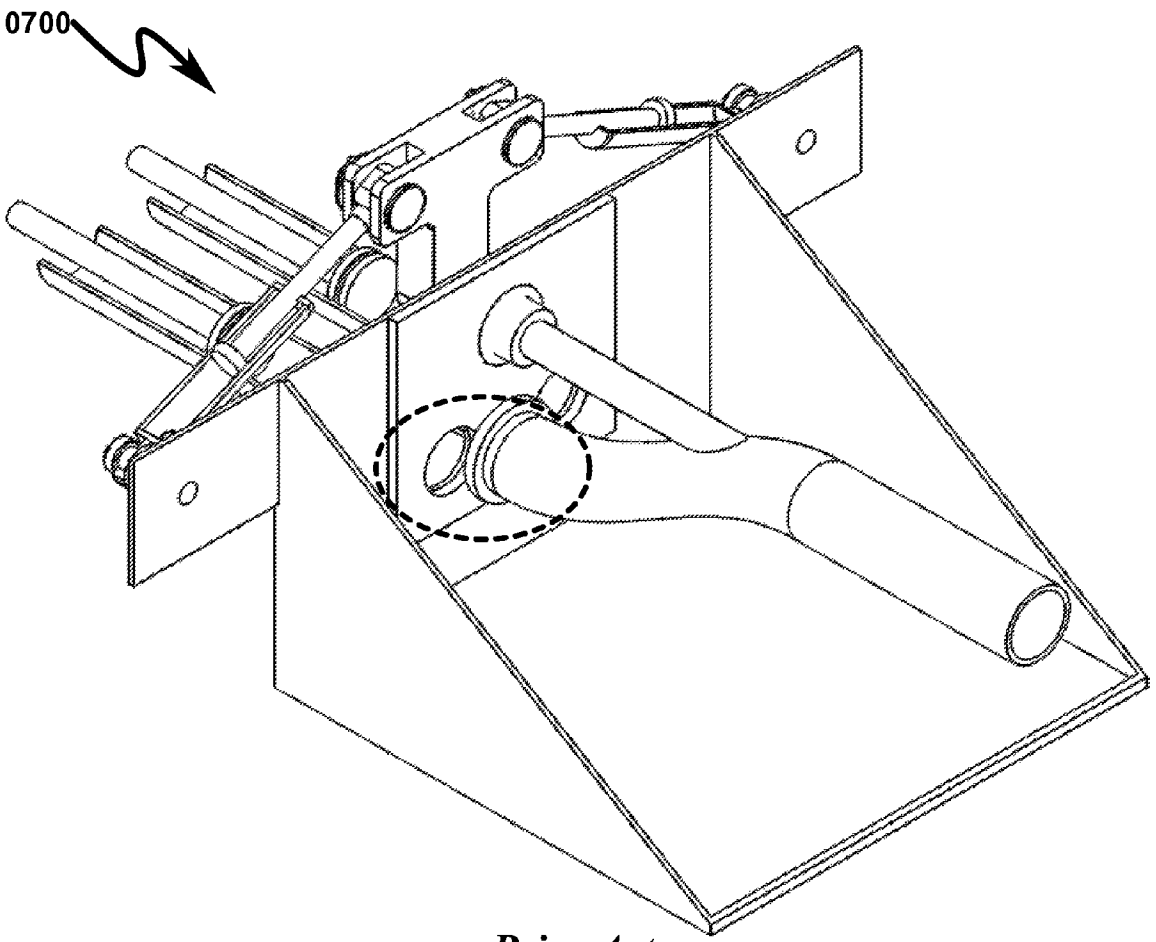
FIG. 7 Prior Art
FIG. 7 illustrates a rear perspective sectional view of a prior art concrete pump in transition between left injection and right ejection cycles.
Figure 8:
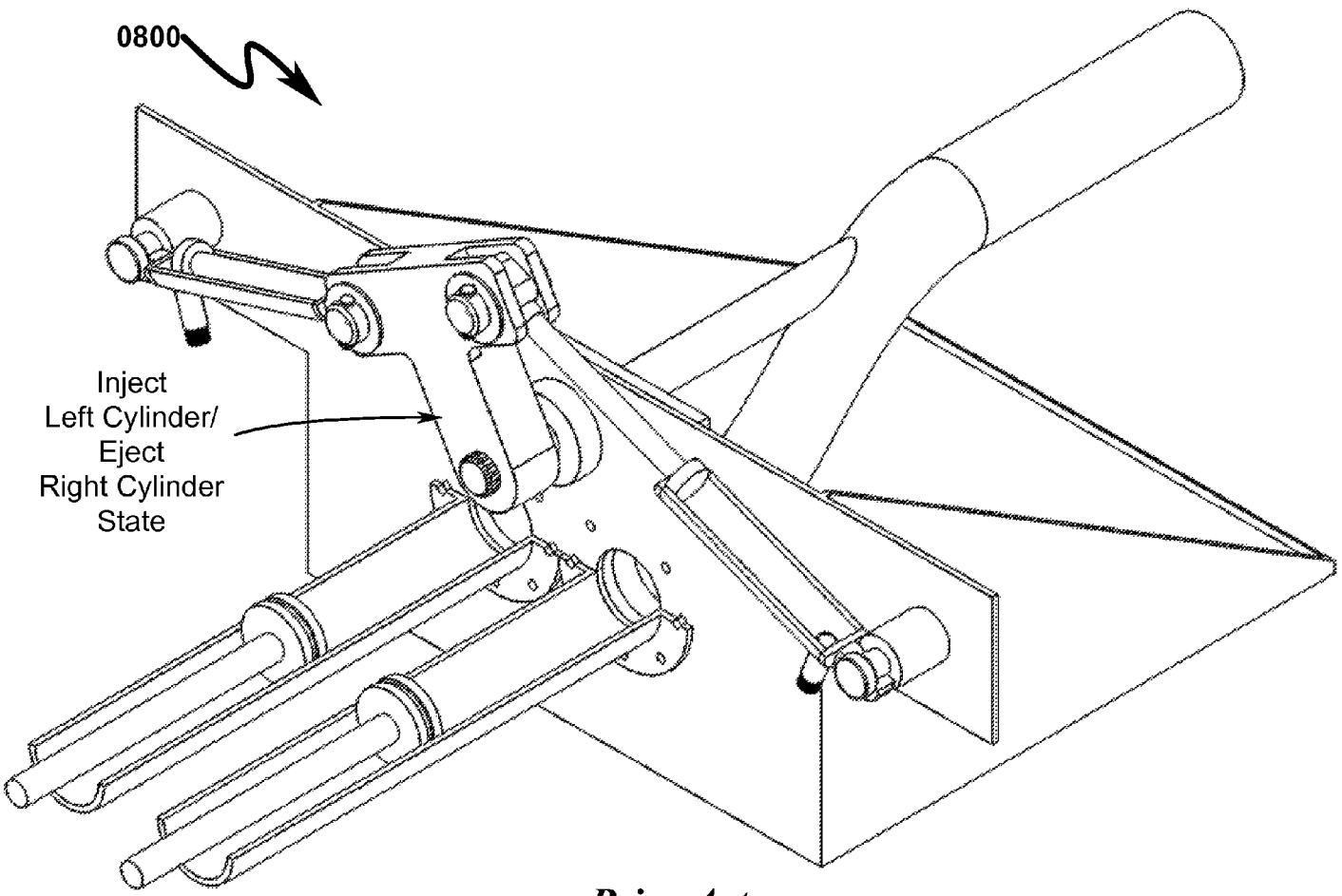
FIG. 8 Prior Art
FIG. 8 illustrates a front perspective sectional view of a prior art concrete pump positioned to inject material into the left pump cylinder and eject material from the right pump cylinder.
Figure 9:
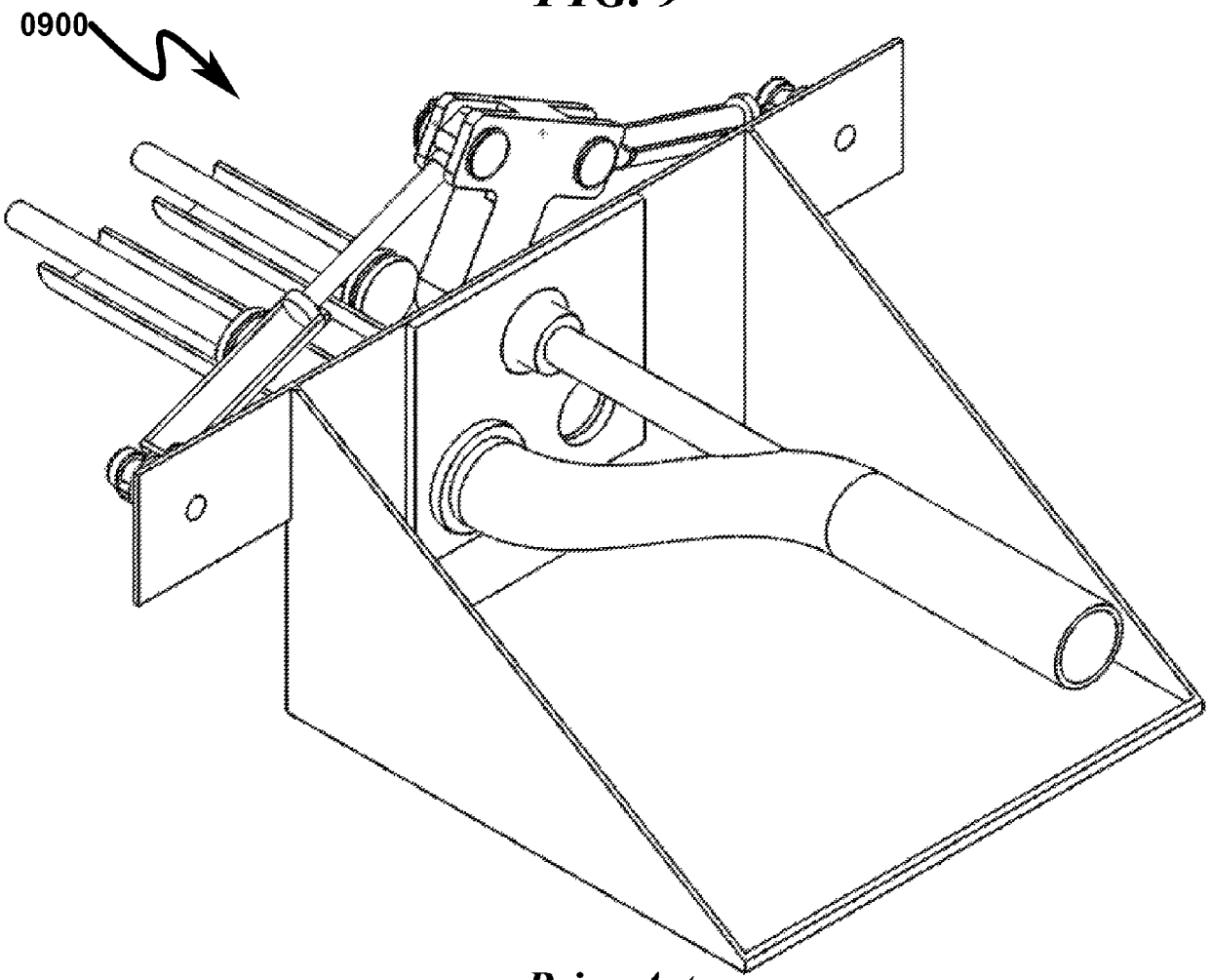
FIG. 9 Prior Art
FIG. 9 illustrates a front perspective sectional view of a prior art concrete pump positioned to inject material into the left pump cylinder and eject material from the right pump cylinder.
Figure 10:
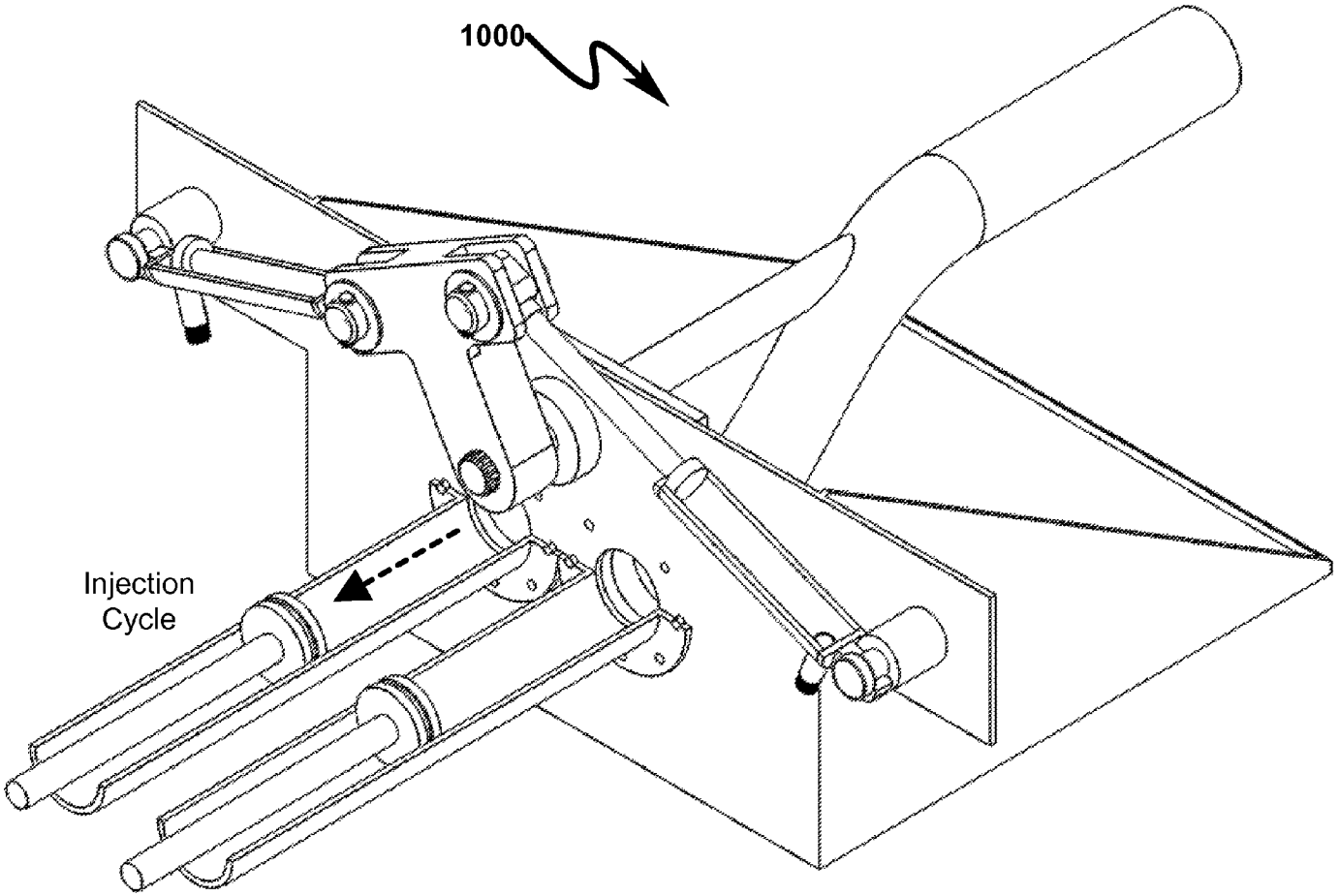
FIG. 10 Prior Art
FIG. 10 illustrates a front perspective sectional view of a prior art concrete pump injecting material into the left pump cylinder.
Figure 11:
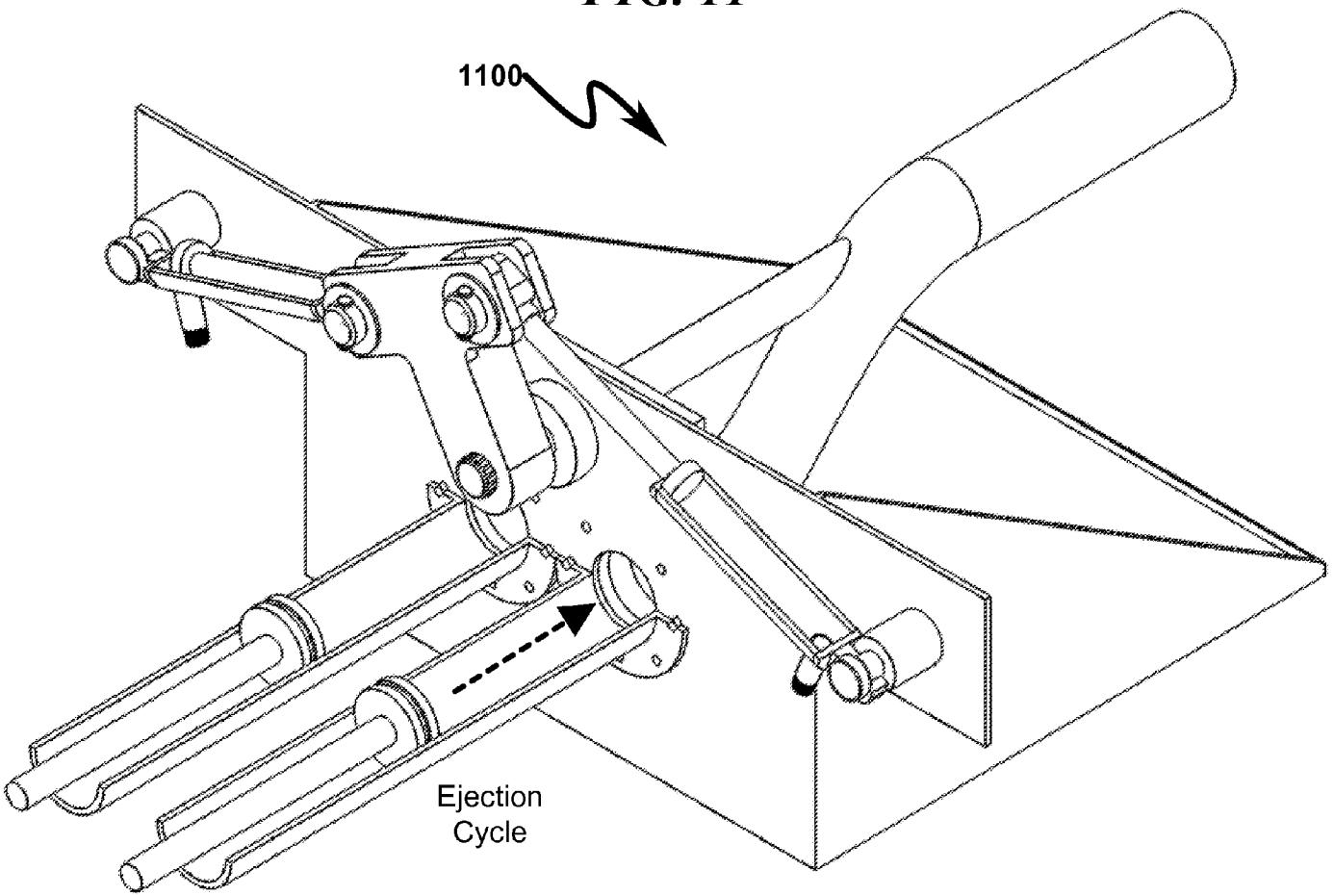
FIG. 11 Prior Art
FIG. 11 illustrates a front perspective sectional view of a prior art concrete pump ejecting material from the right pump cylinder.
Figure 12:
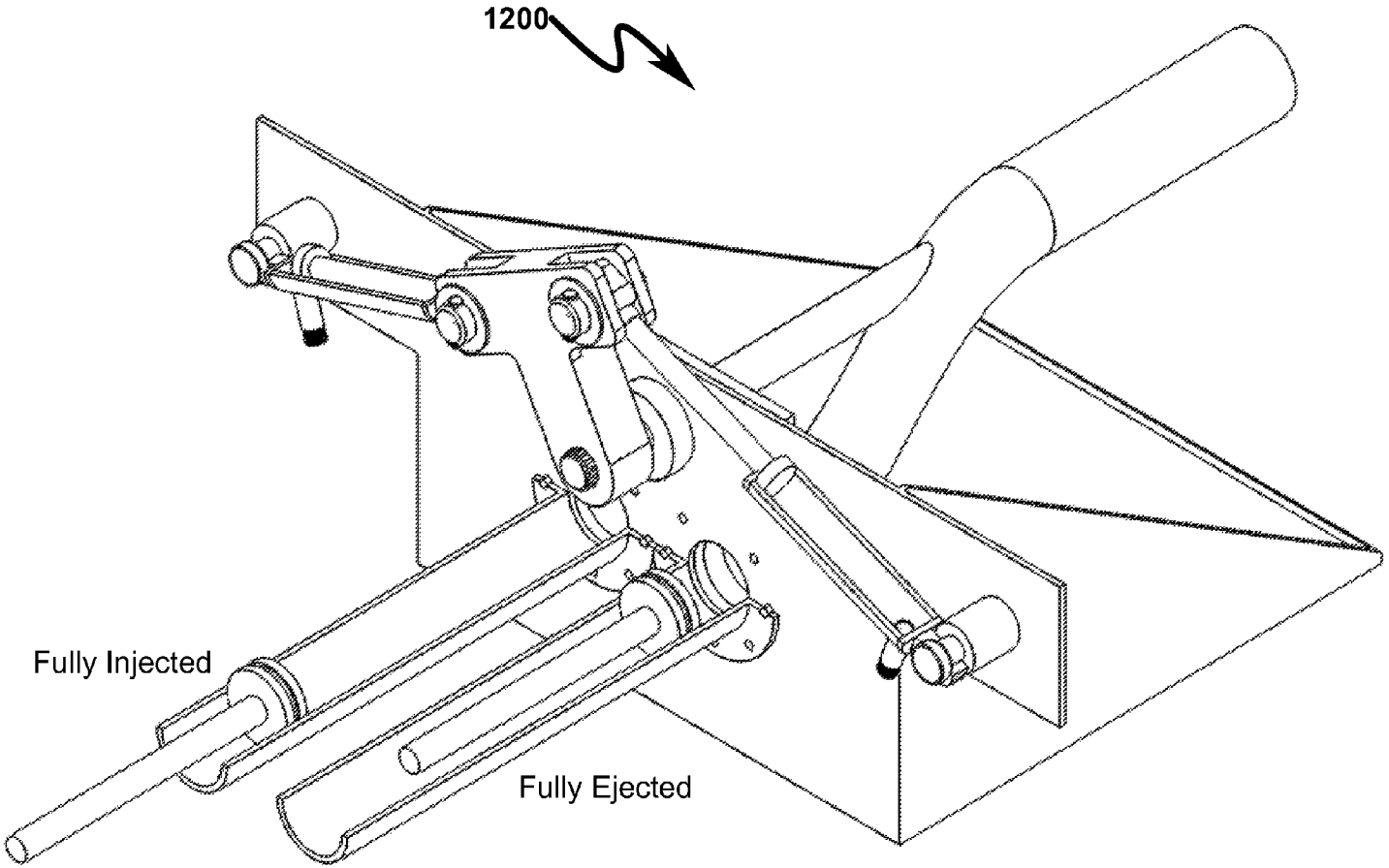
FIG. 12 Prior Art
FIG. 12 illustrates a front perspective sectional view of a prior art concrete pump with the left pump cylinder fully injected and the right pump cylinder fully ejected.
Figure 13:
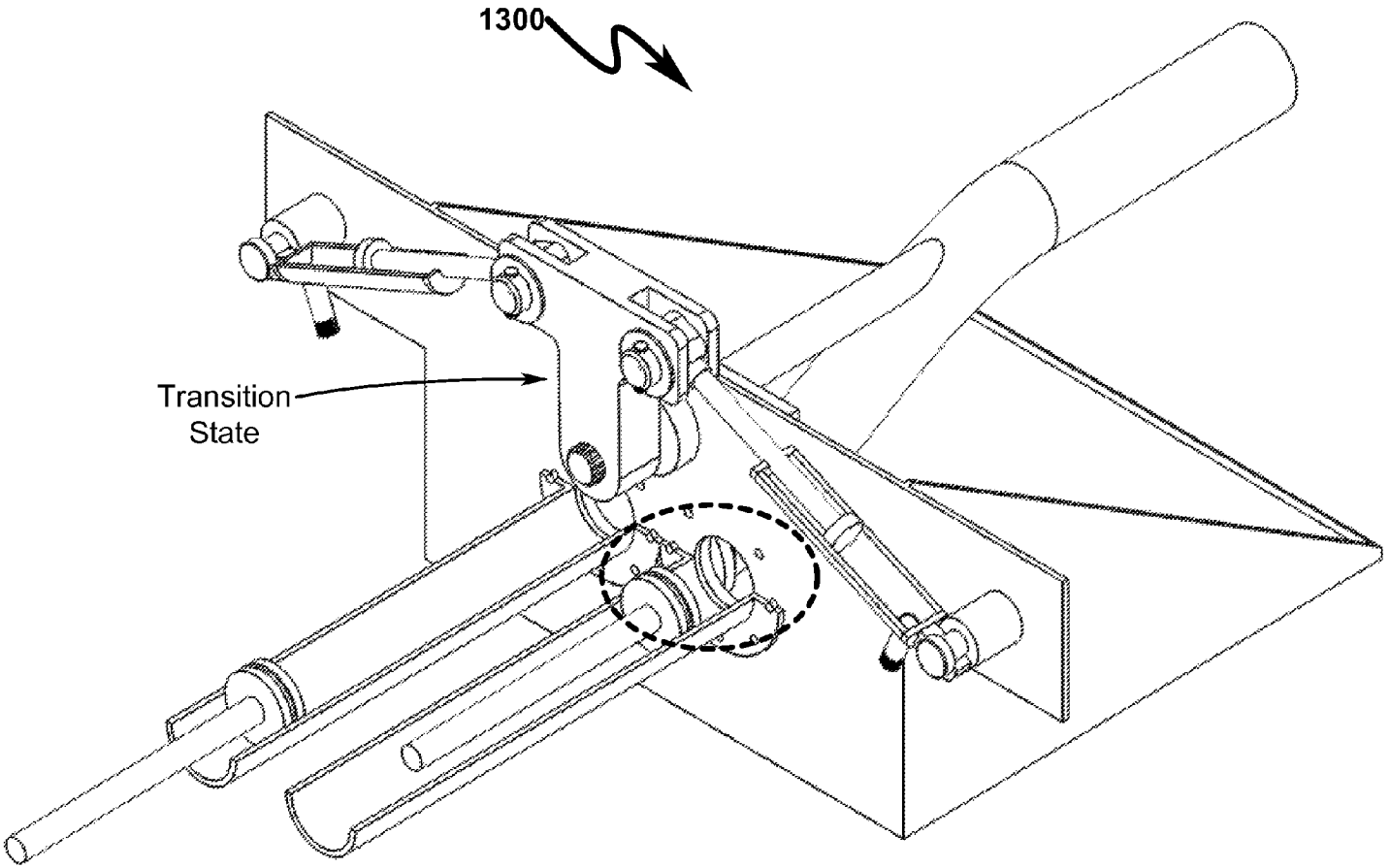
FIG. 13 Prior Art
FIG. 13 illustrates a front perspective sectional view of a prior art concrete pump in transition between right injection and left ejection cycles.
Figure 14:
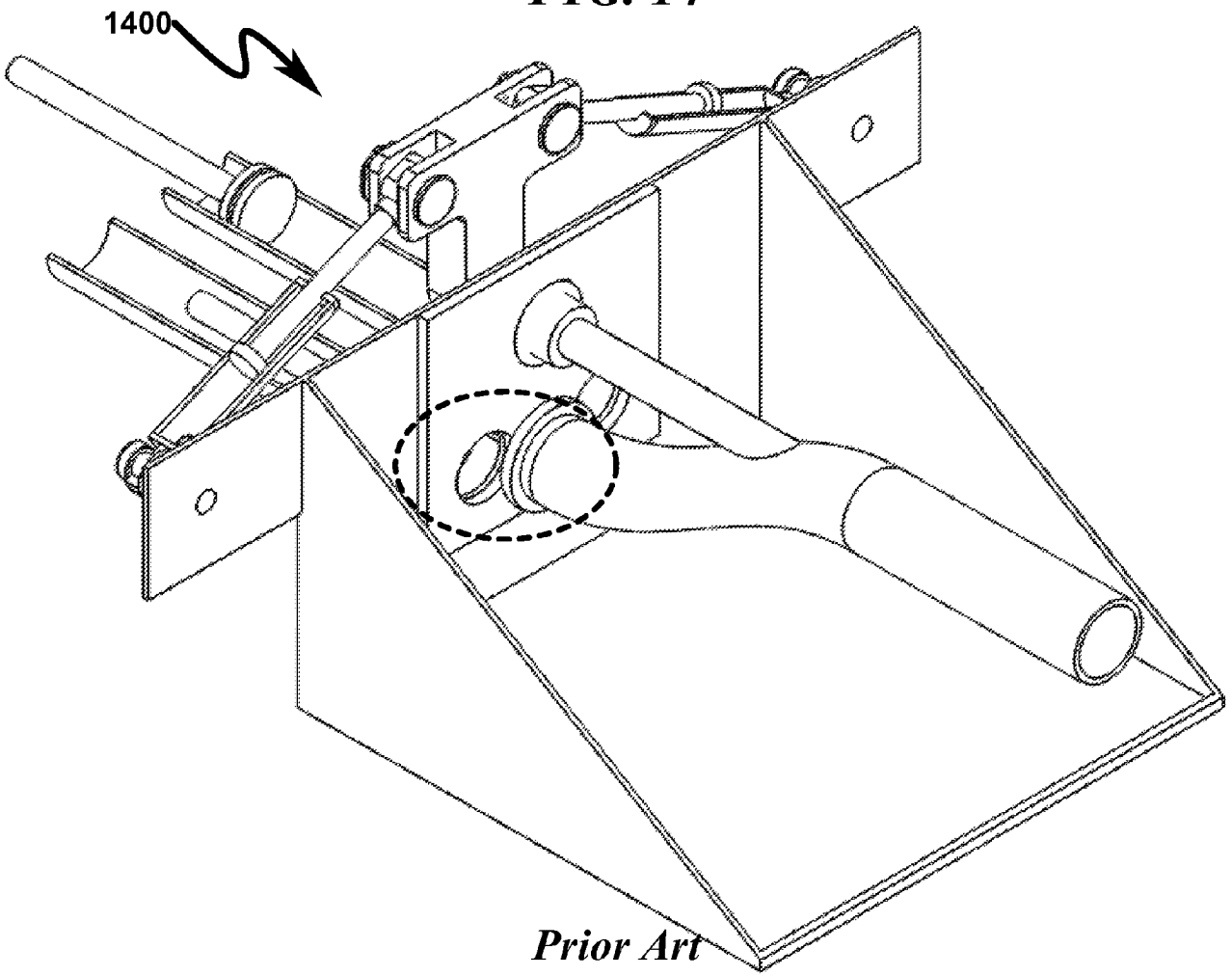
FIG. 14 Prior Art
FIG. 14 illustrates a rear perspective sectional view of a prior art concrete pump in transition between right injection and left ejection cycles.
Figure 15:
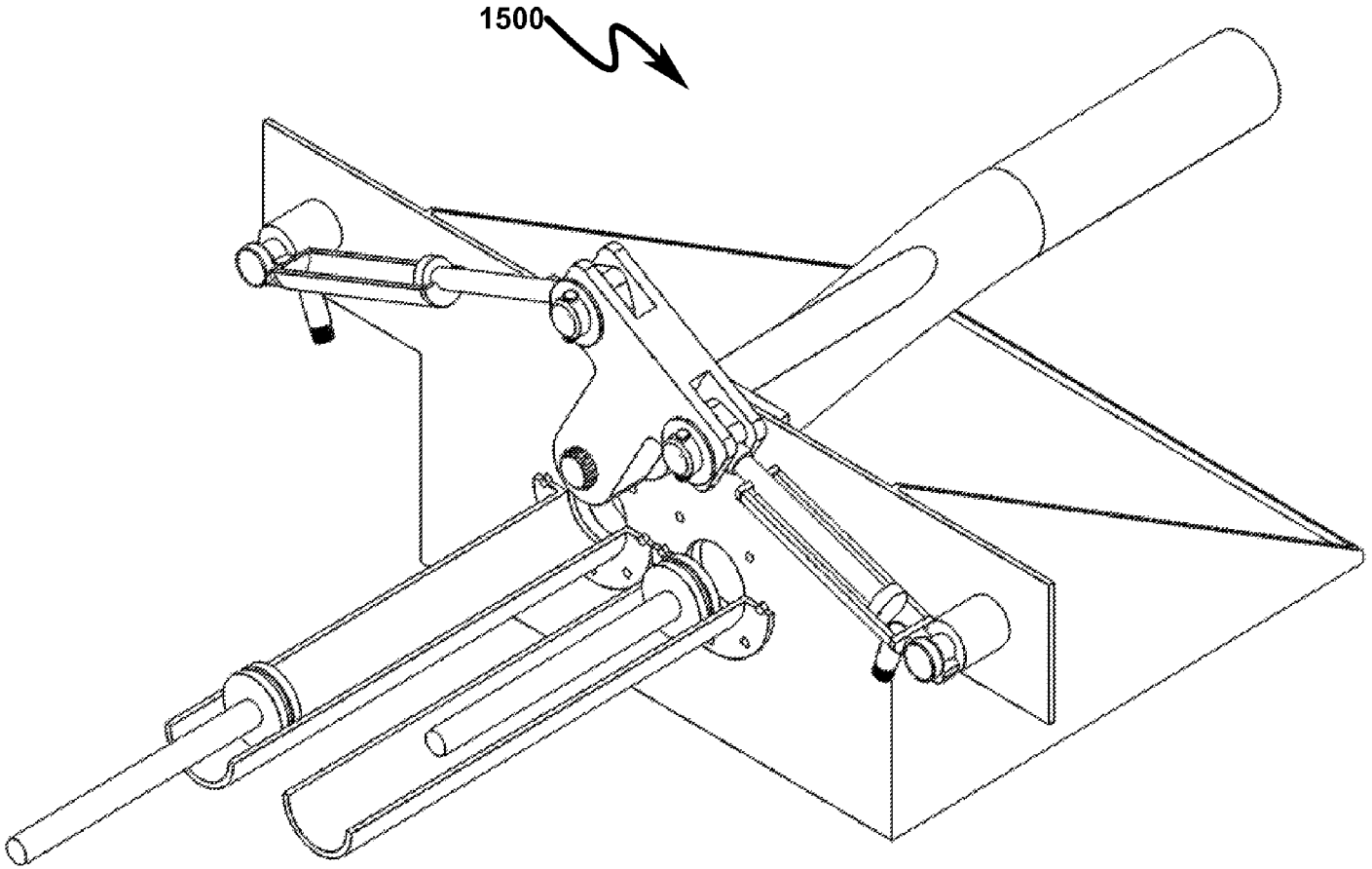
FIG. 15 Prior Art
FIG. 15 illustrates a front perspective sectional view of a prior art concrete pump positioned to inject material into the right pump cylinder and eject material from the left pump cylinder.
Figure 16:
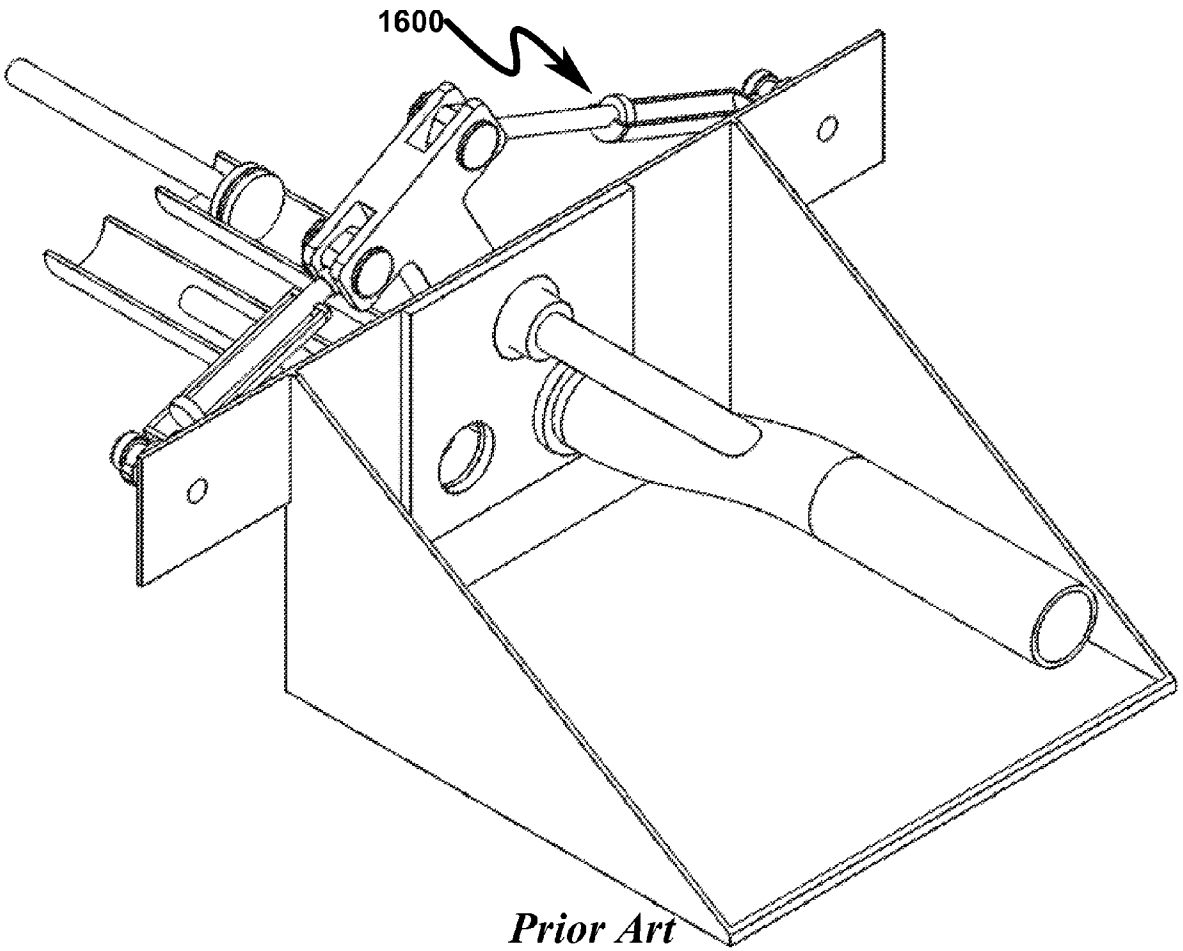
FIG. 16 Prior Art
FIG. 16 illustrates a front perspective sectional view of a prior art concrete pump positioned to inject material from the right pump cylinder and eject material from the left pump cylinder.
Figure 17:
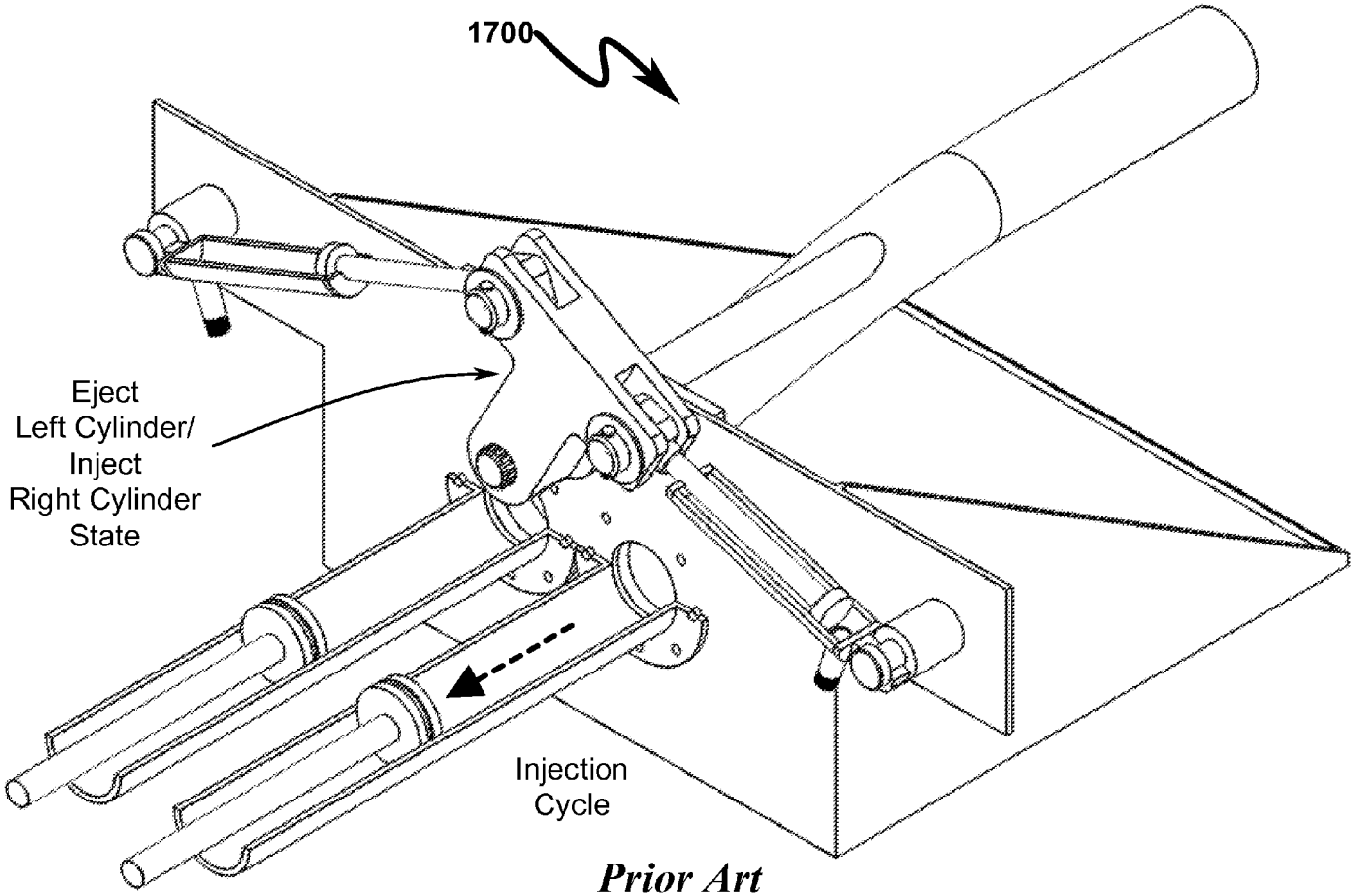
FIG. 17 Prior Art
FIG. 17 illustrates a front perspective sectional view of a prior art concrete pump injecting material into the right pump cylinder.
Figure 18:
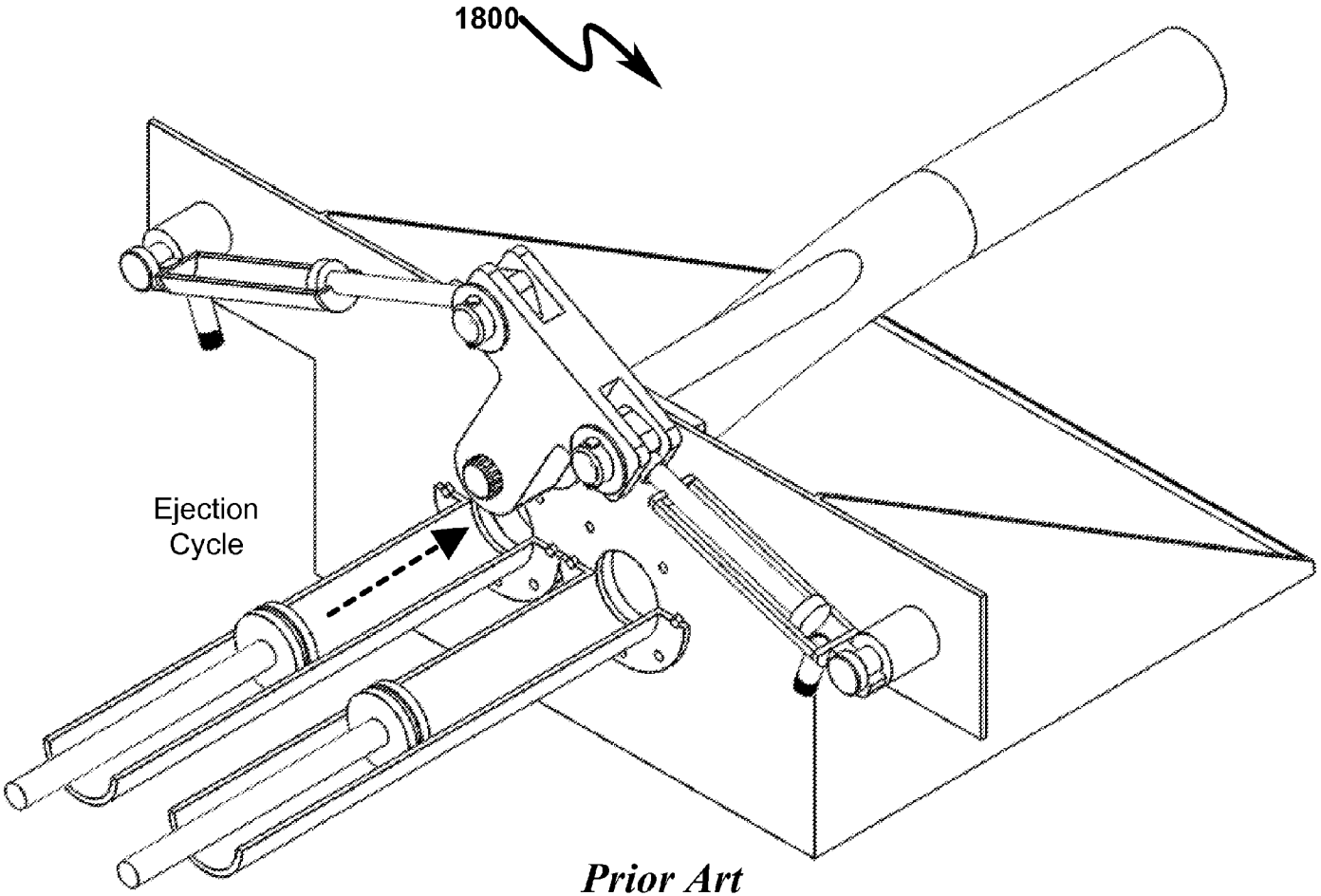
FIG. 18 Prior Art
FIG. 18 illustrates a front perspective sectional view of a prior art concrete pump ejecting material from the left pump cylinder.
Figure 19:
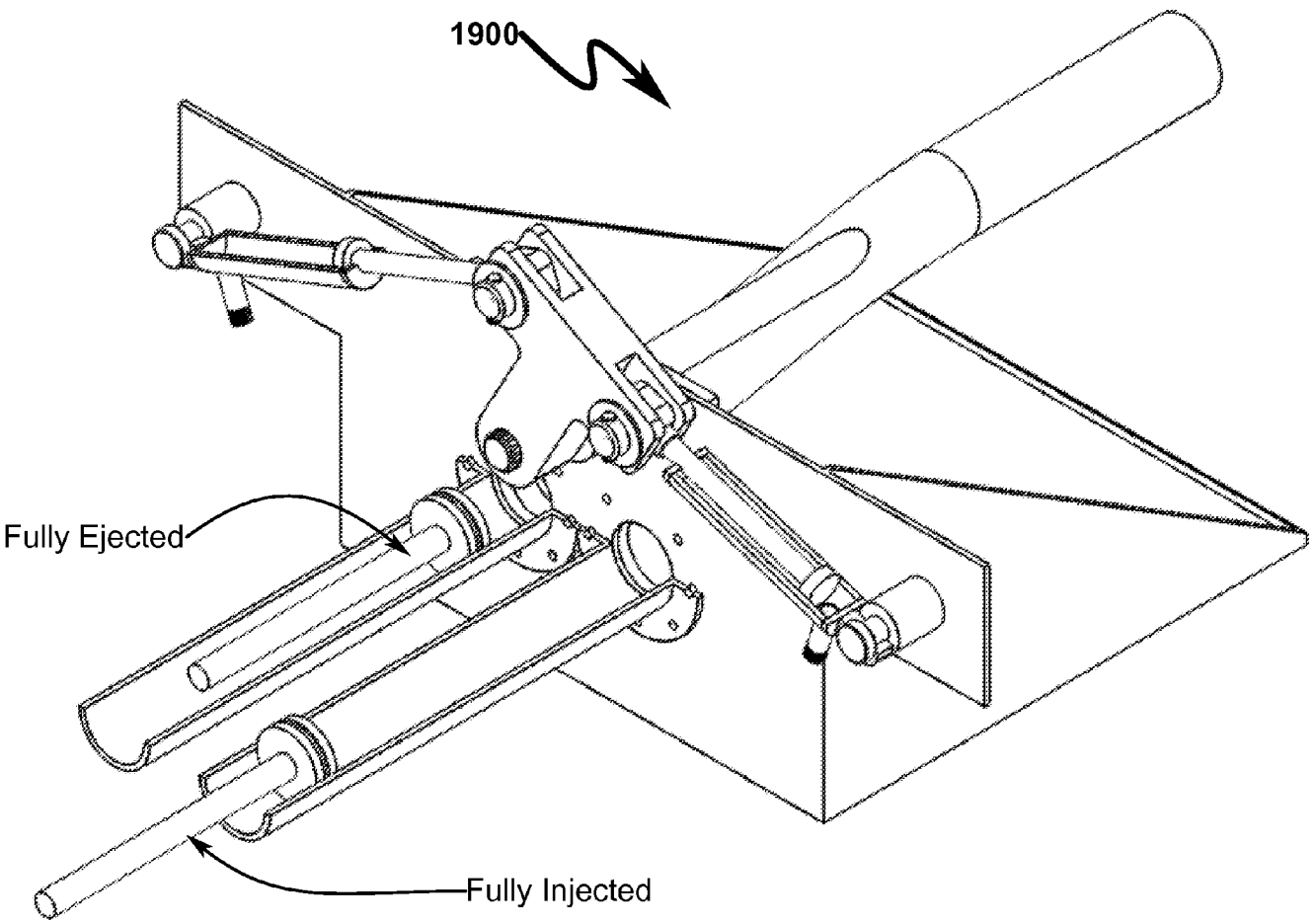
FIG. 19 Prior Art
FIG. 19 illustrates a front perspective sectional view of a prior art concrete pump with the right pump cylinder fully injected and the left pump cylinder fully ejected.
Figure 20:
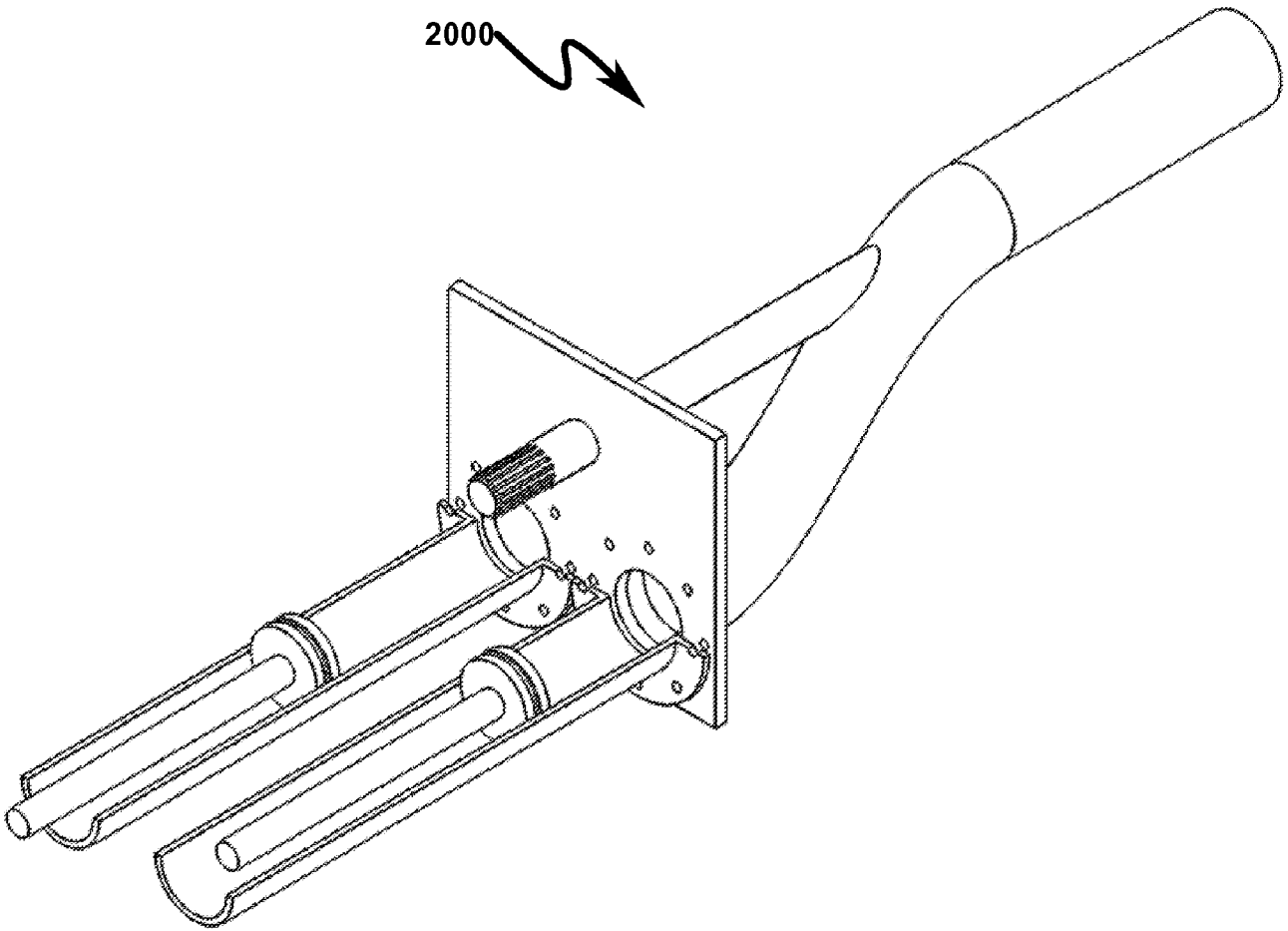
FIG. 20 Prior Art
FIG. 20 illustrates a front perspective sectional view of a prior art concrete pump depicting the left/right hydraulic pump rams and ejection port positioned to fully cover the right portion of the spectacle plate and associated hydraulic pump ram.
Figure 21:
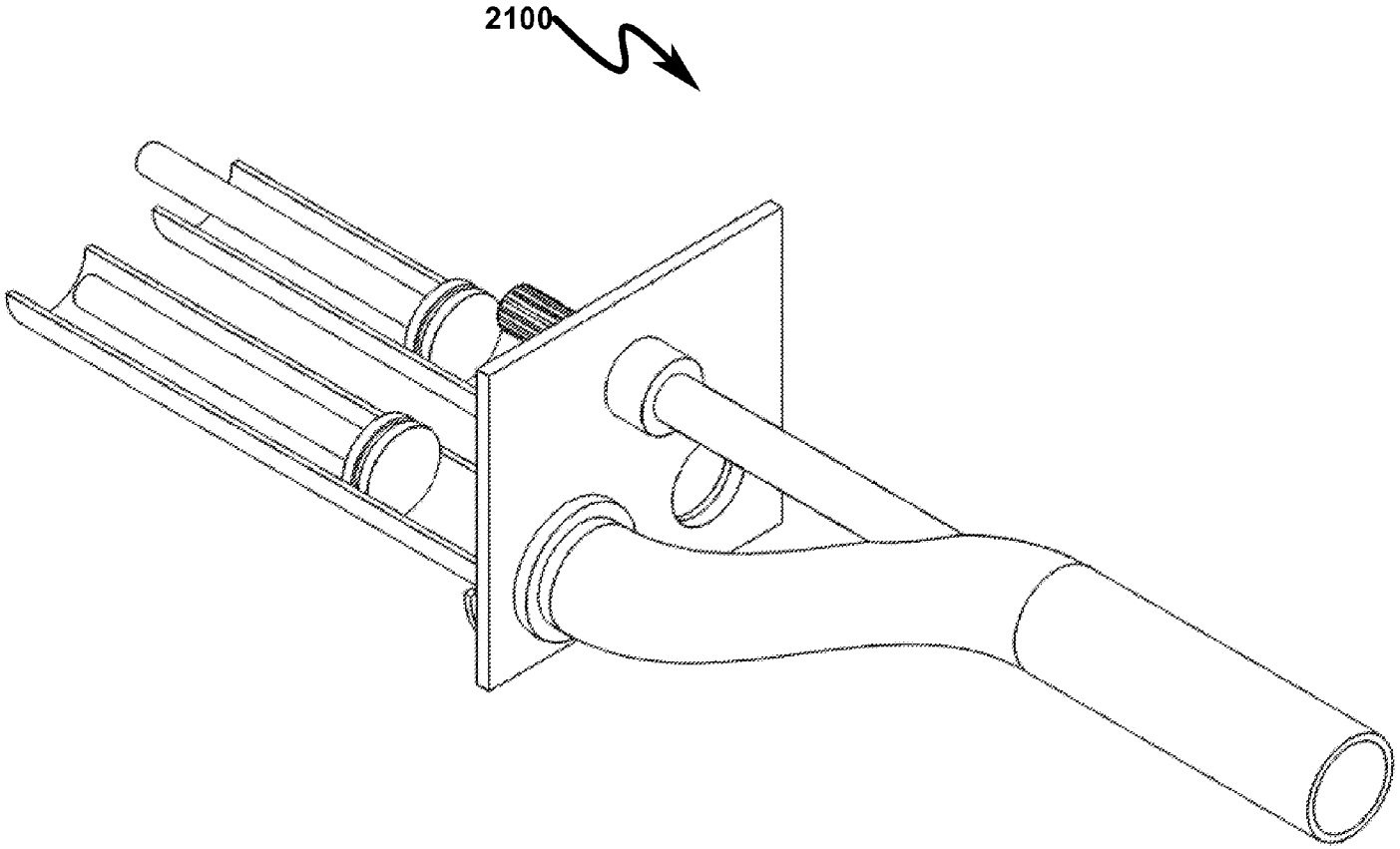
FIG. 21 Prior Art
FIG. 21 illustrates a rear perspective sectional view of a prior art concrete pump depicting the left/right hydraulic pump rams and ejection port positioned to fully cover the right portion of the spectacle plate and associated hydraulic pump ram.
Figure 22:
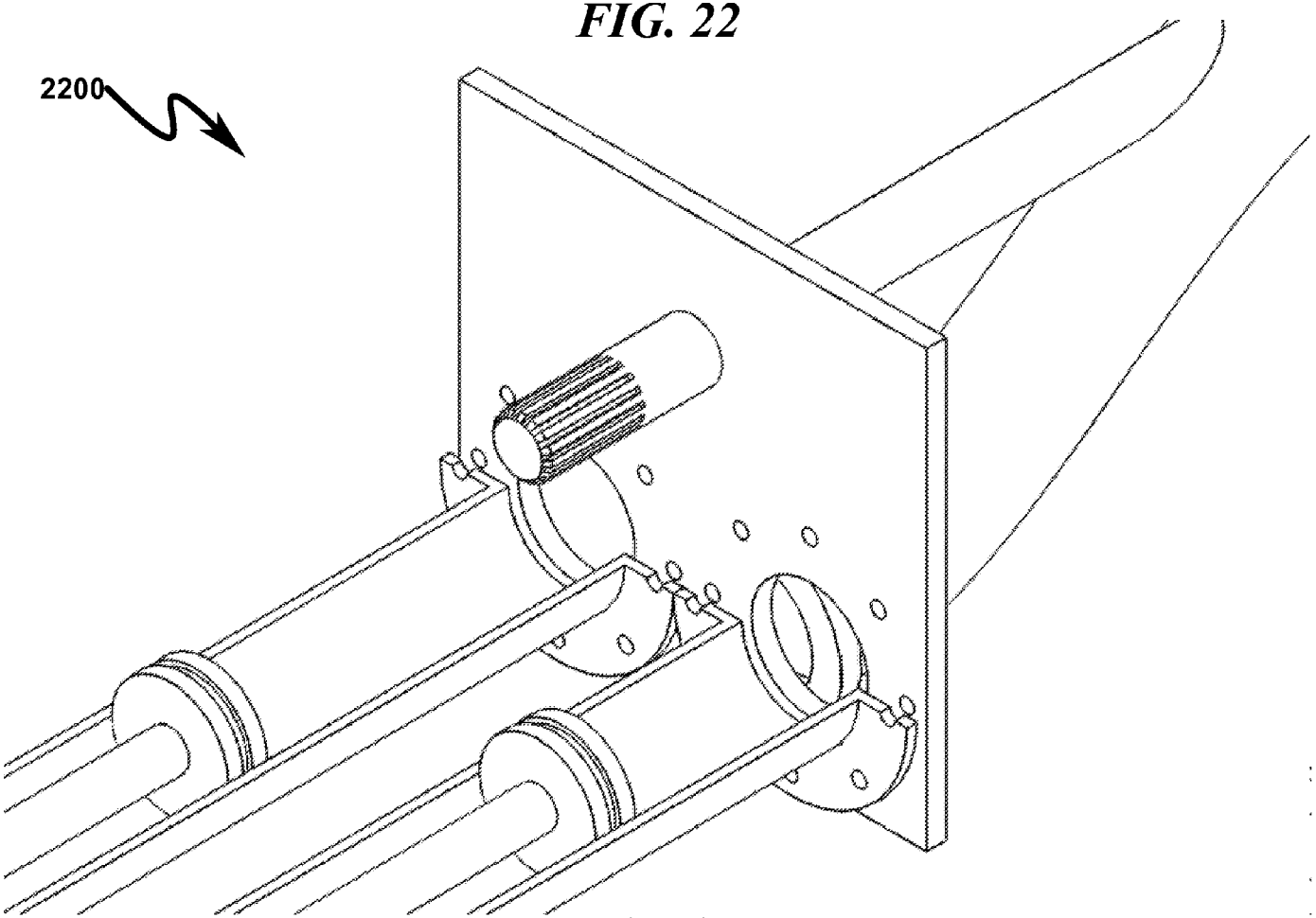
FIG. 22 Prior Art
FIG. 22 illustrates a front perspective sectional view of a prior art concrete pump depicting the left/right hydraulic pump rams and ejection port positioned to partially cover the right portion of the spectacle plate and associated hydraulic pump ram.
Figure 23:
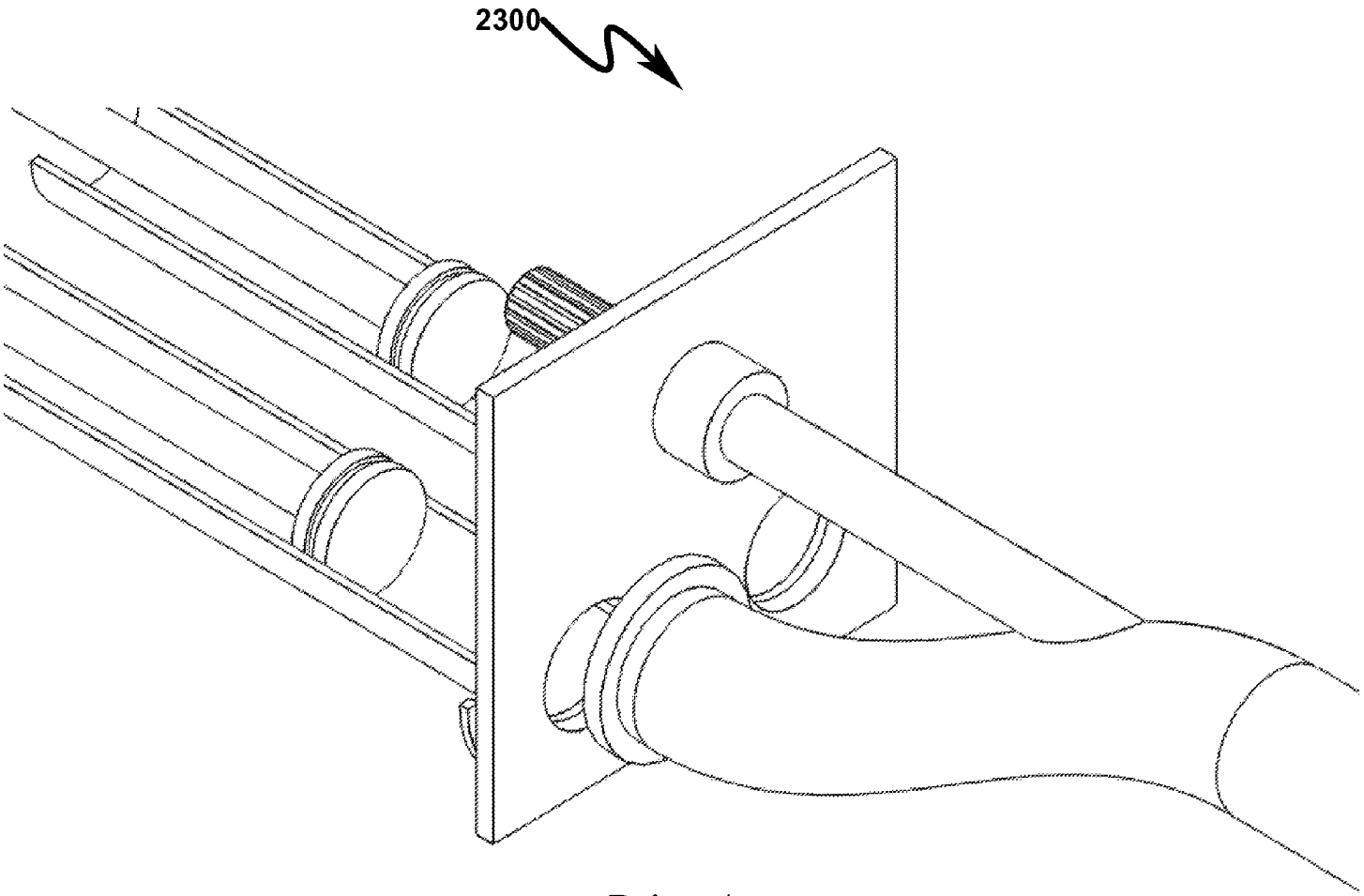
FIG. 23 Prior Art
FIG. 23 illustrates a rear perspective sectional view of a prior art concrete pump depicting the left/right hydraulic pump rams and ejection port positioned to partially cover the right portion of the spectacle plate and associated hydraulic pump ram.
Figure 24:
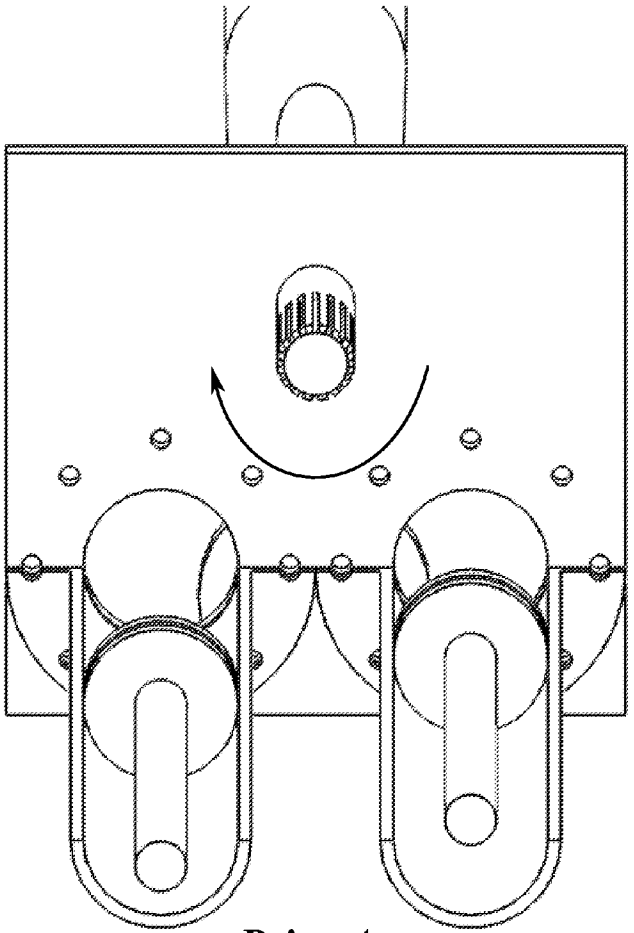
FIG. 24 Prior Art
FIG. 24 illustrates a front perspective sectional view of a prior art concrete pump depicting the left/right hydraulic pump rams and ejection port positioned at the center of the spectacle plate and associated left/right hydraulic pump rams.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a CONCRETE PUMP SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Trapezoid not Limitive

The present invention description herein makes general reference to the construction of portions of the invention as having the shape of a "trapezoid" or being "trapezoidal" in shape. However, this terminology may have a variety of definitions within the mathematical arts and as such should be broadly construed to include any of the following:

- four-sided polygons having exactly two sides that are parallel;
- four-sided polygons having two sets of sides that are parallel;
- four-sided polygons in which the legs on opposite sides of the polygon have the same length and the base angles have the same measure (isosceles trapezoid);
- four-sided polygons in which two adjacent angles are right angles (right trapezoid; also called right-angled trapezoid);
- four-sided polygons which have an inscribed circle (tangential trapezoid);
- four-sided parallelograms (including rhombuses, rectangles and squares); and
- annular sectors comprising one or more sectors of an annulus or annular ring that approximate an isosceles trapezoid.

One skilled in the art will recognize that the construction of the present invention may make use of a variety of geometric shapes (some of which may not be polygonal in shape) to accomplish the goal of providing substantially uniform material flow from the concrete pumping system.

System Overview (2500)-(3200)

Figure 25:
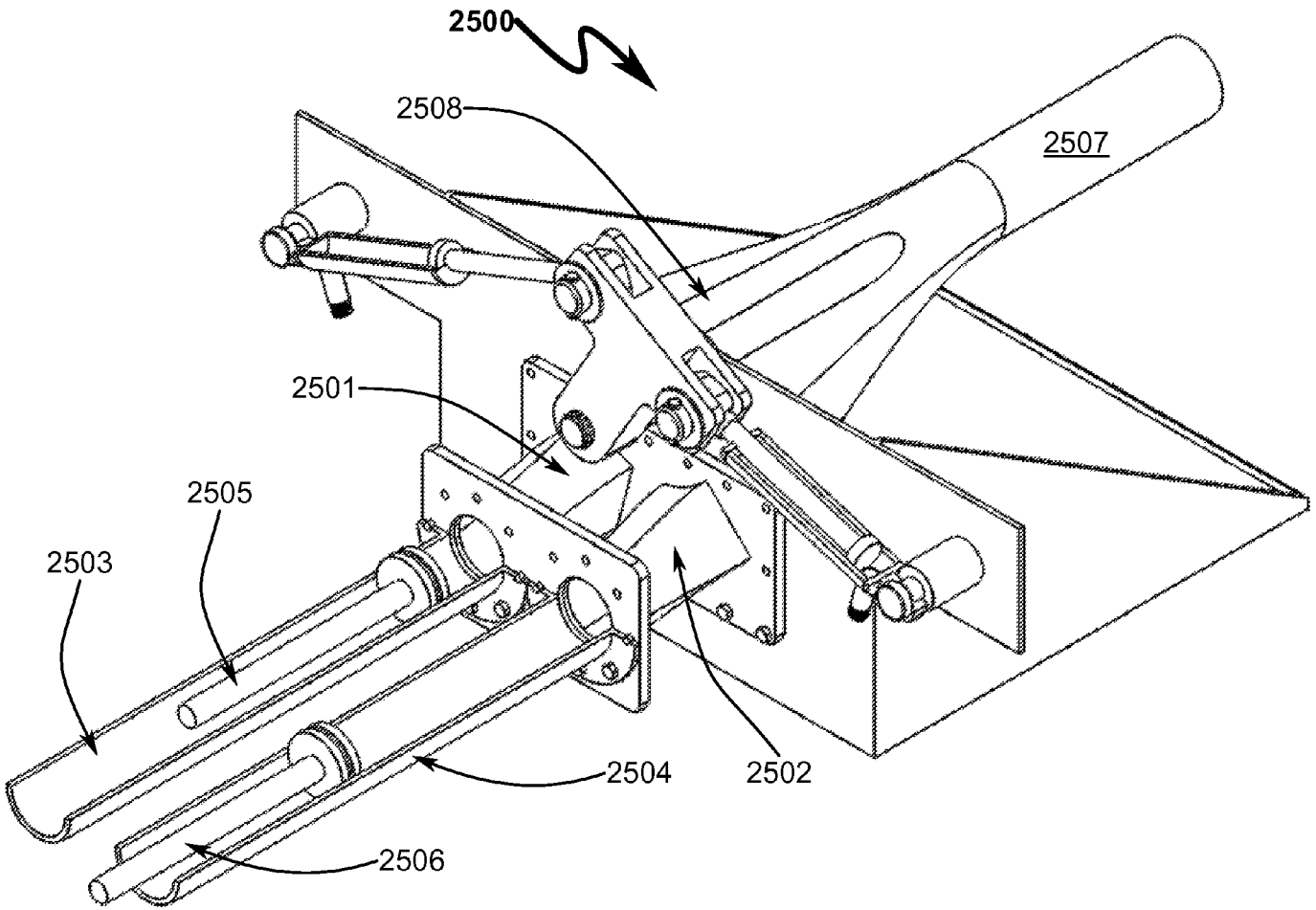
FIG. 25 illustrates a front perspective view of a preferred exemplary embodiment of the present invention utilizing a sectioned annular-ring-shaped spectacle plate and corresponding ejection port/cutting plate.
Figure 26:
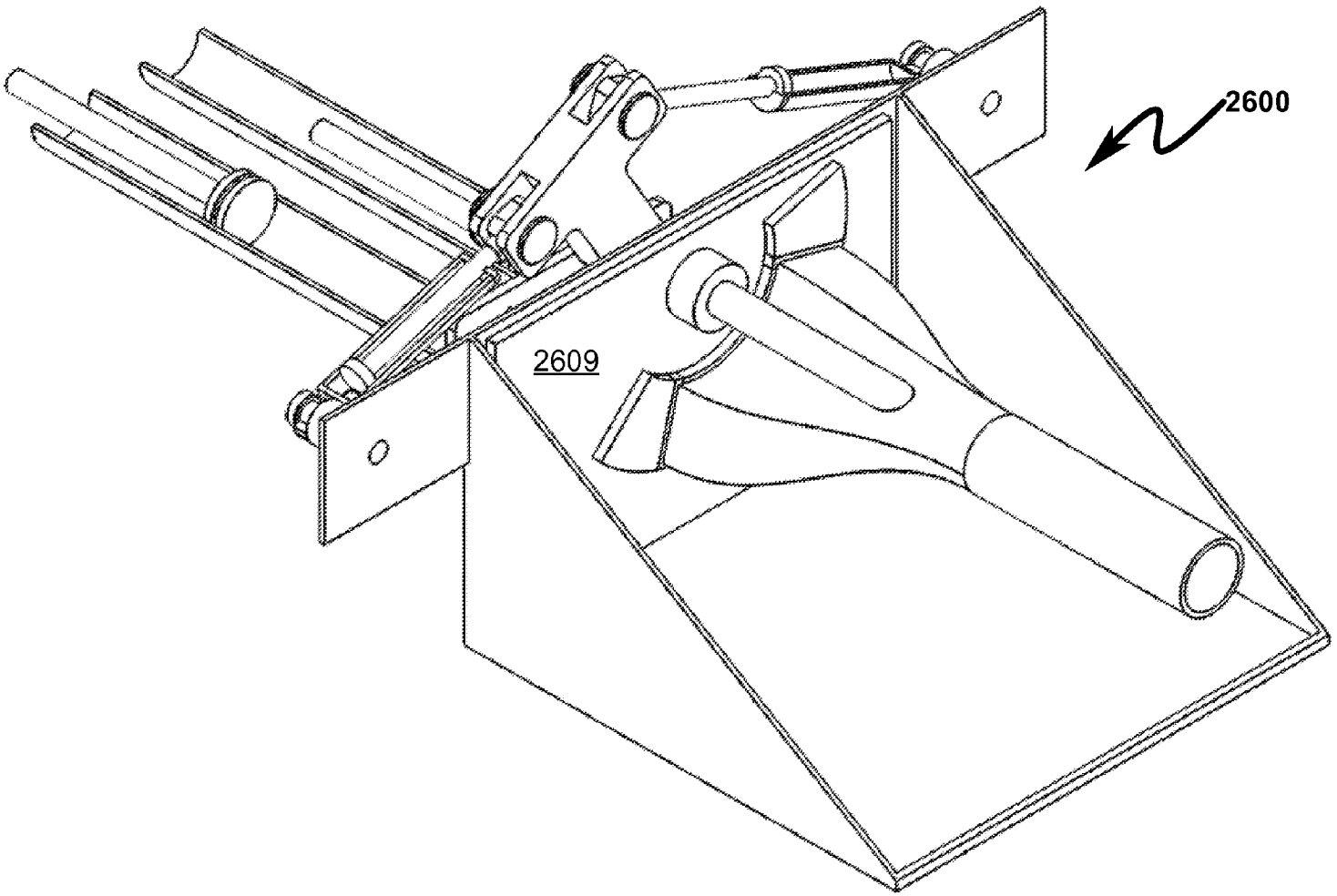
FIG. 26 illustrates a rear perspective view of a preferred exemplary embodiment of the present invention utilizing a sectioned annular-ring-shaped spectacle plate and corresponding ejection port/cutting plate.
Figure 32:
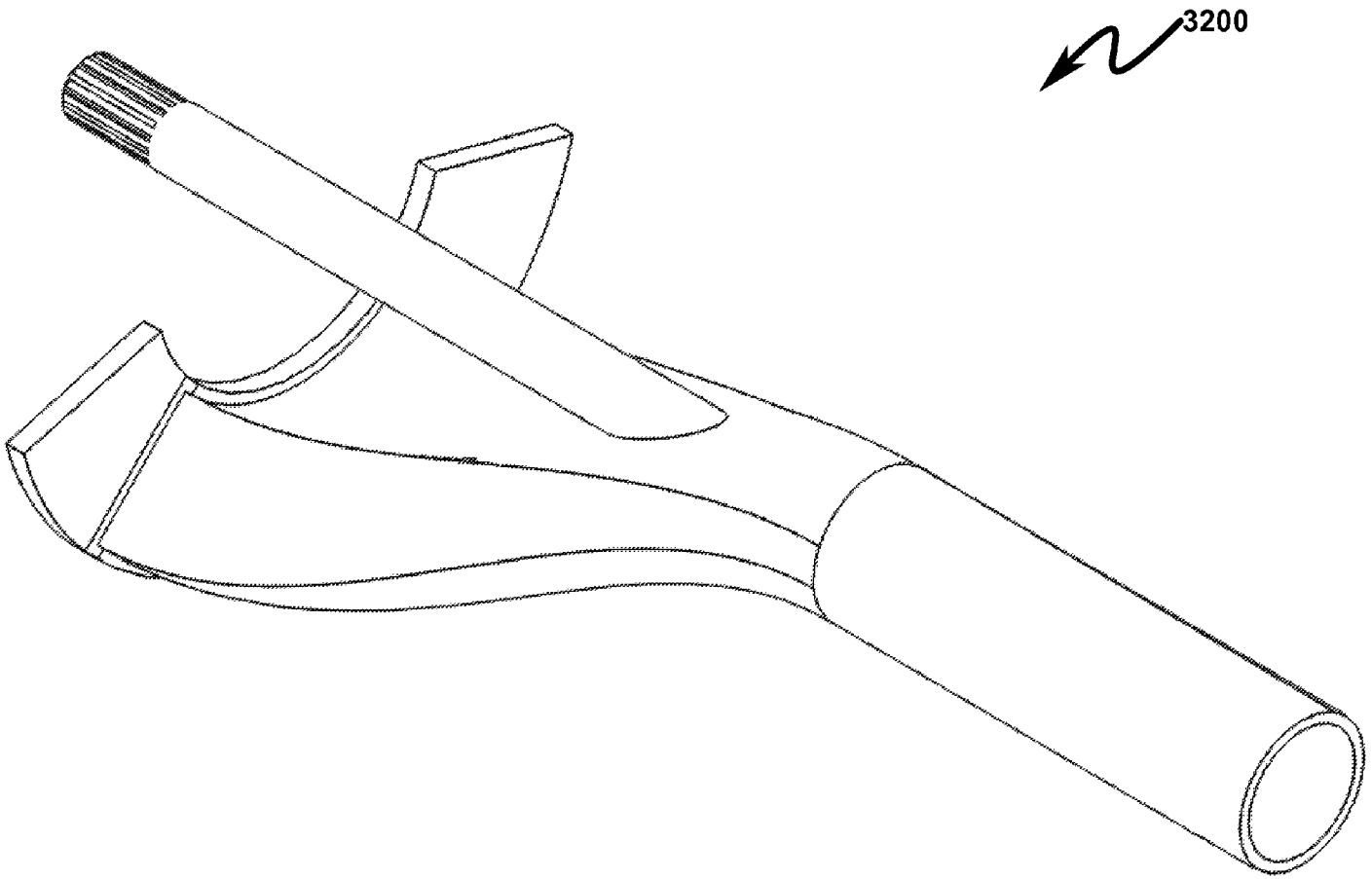
FIG. 32 illustrates a rear perspective detail view of a preferred exemplary embodiment of the present invention utilizing a sectioned annular-ring-shaped spectacle plate and corresponding ejection port/cutting plate and detailing the ejection port and cutting plate construction.

The present invention in various embodiments addresses one or more of the above objectives in the following manner as generally depicted in FIG. 25 (2500)-FIG. 32 (3200). As depicted in FIG. 25 (2500), the system provides for trapezoidal-shaped transition regions (2501, 2502) between the hydraulic pump cylinders (2503, 2504), their corresponding hydraulic pump rams (2505, 2506) and the material ejection port (2507). The ejection port (2507) is configured with a trapezoidal-shaped transition region (2508) that articulates between the left (2503) and right (2504) pump cylinders through the spectacle plate (2609) as depicted in FIG. 26 (2600).

Figure 27:
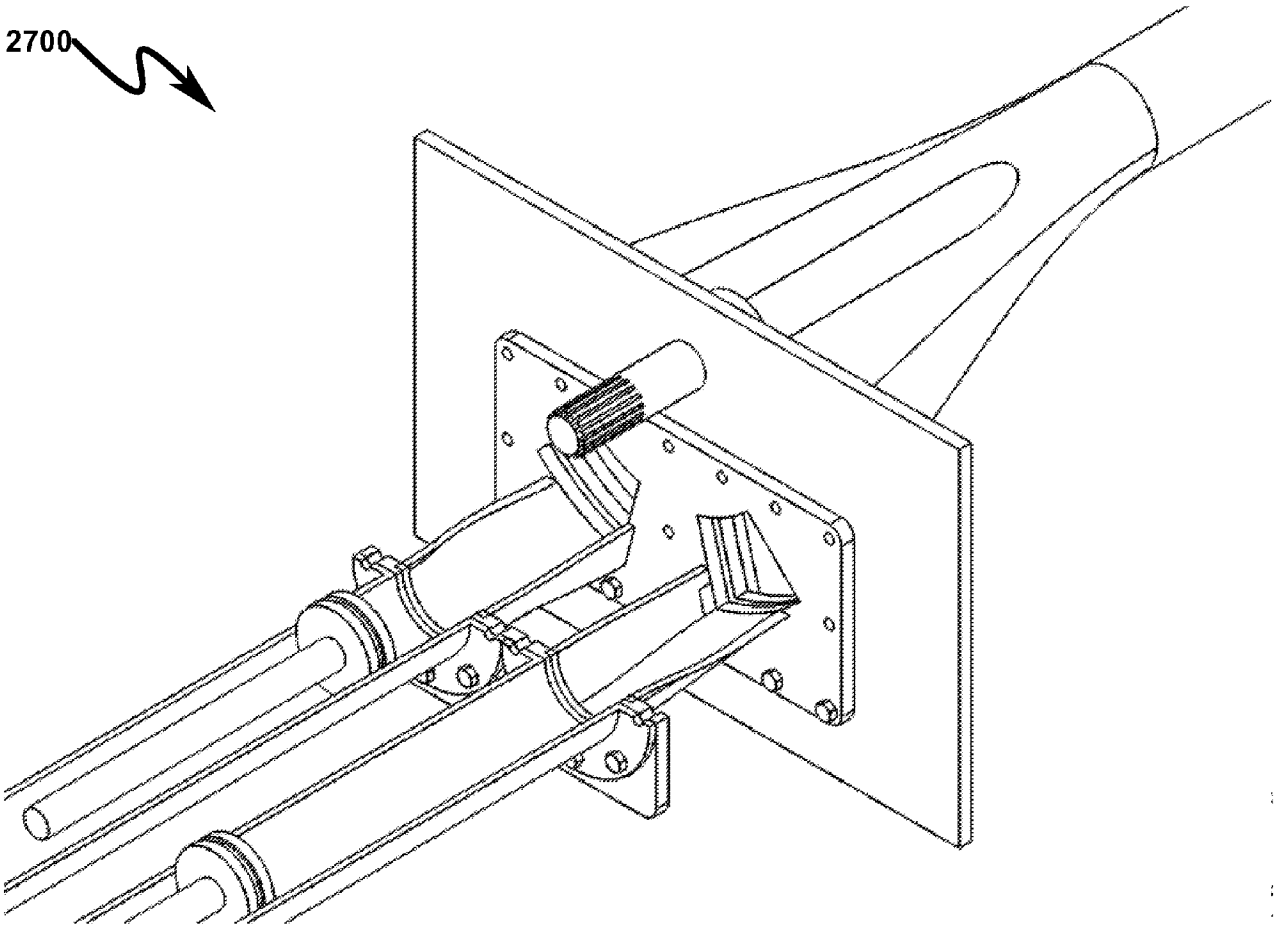
FIG. 27 illustrates a front perspective detail view of a preferred exemplary embodiment of the present invention utilizing a sectioned annular-ring-shaped spectacle plate and corresponding ejection port/cutting plate with transition hydraulic pump ram inputs in section view.
Figure 28:
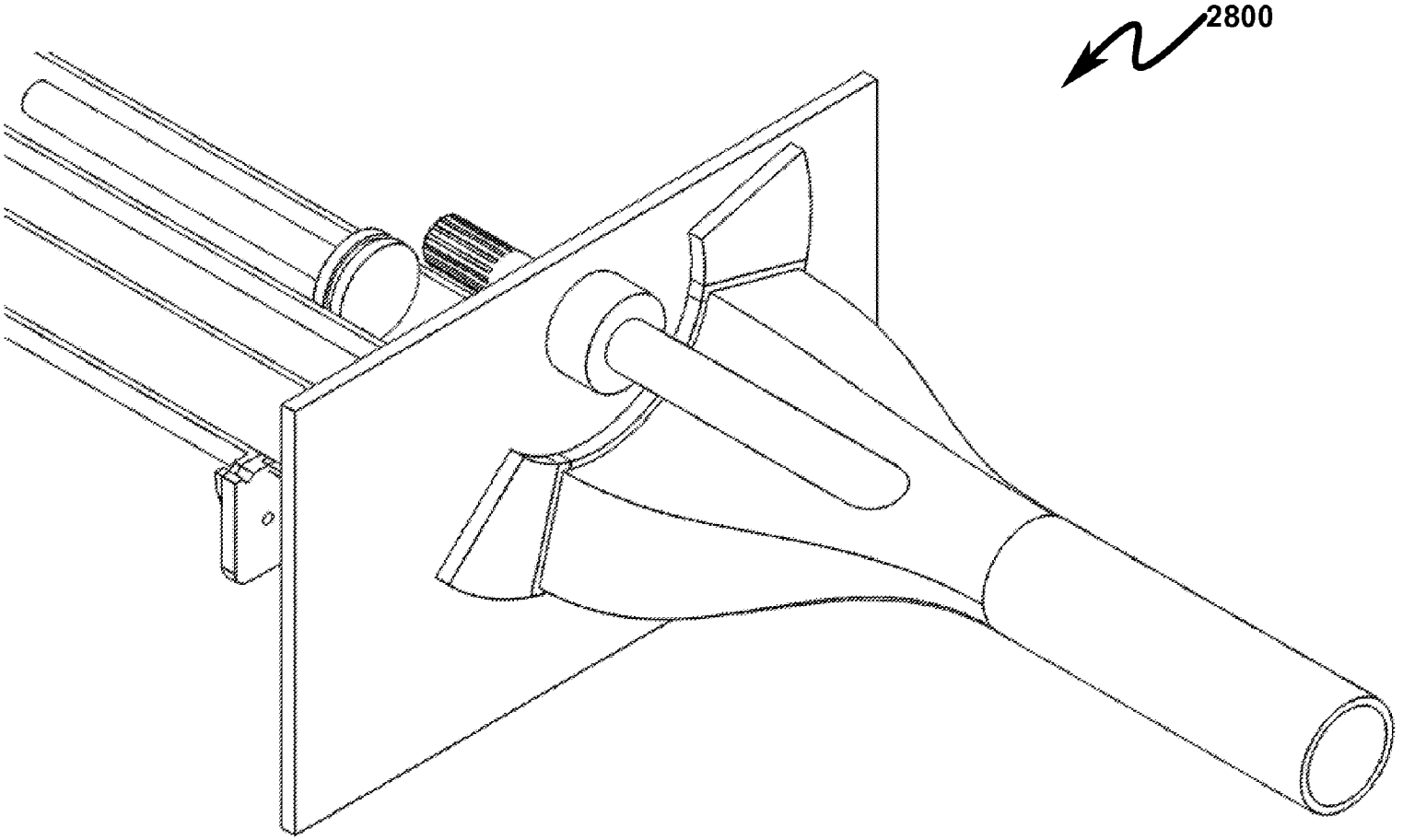
FIG. 28 illustrates a rear perspective detail view of a preferred exemplary embodiment of the present invention utilizing a sectioned annular-ring-shaped spectacle plate and corresponding ejection port/cutting plate with transition hydraulic pump ram inputs in section view.
Figure 29:
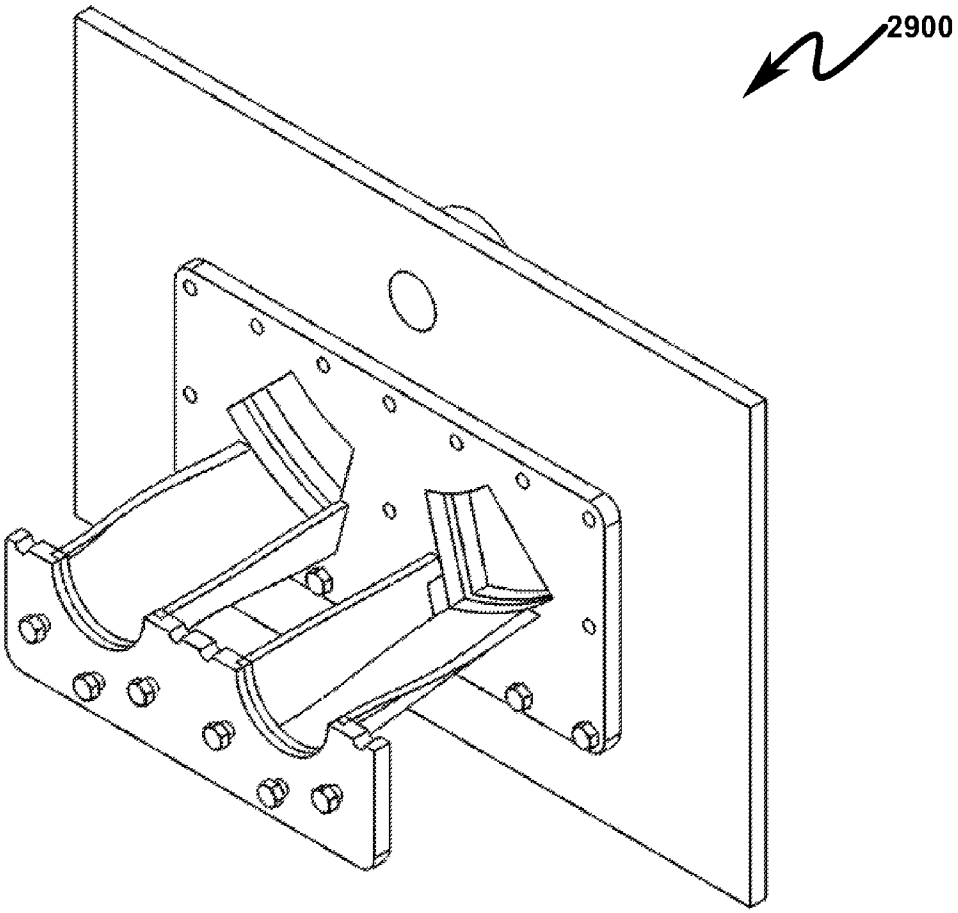
FIG. 29 illustrates a front perspective detail view of a preferred exemplary embodiment of the present invention utilizing a sectioned annular-ring-shaped spectacle plate and corresponding ejection port/cutting plate detailing the transition port apertures in the spectacle plate.
Figure 30:
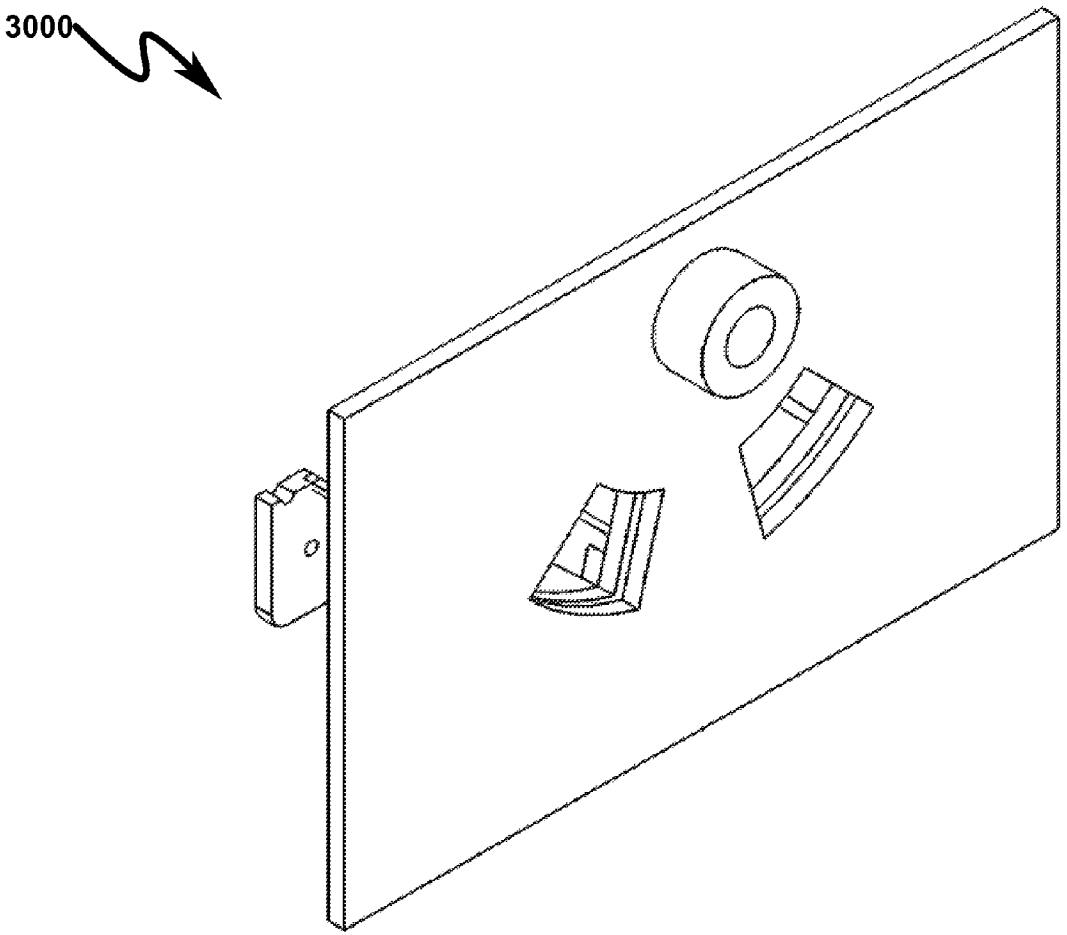
FIG. 30 illustrates a rear perspective detail view of a preferred exemplary embodiment of the present invention utilizing a sectioned annular-ring-shaped spectacle plate and corresponding ejection port/cutting plate detailing the transition port apertures in the spectacle plate.
Figure 31:
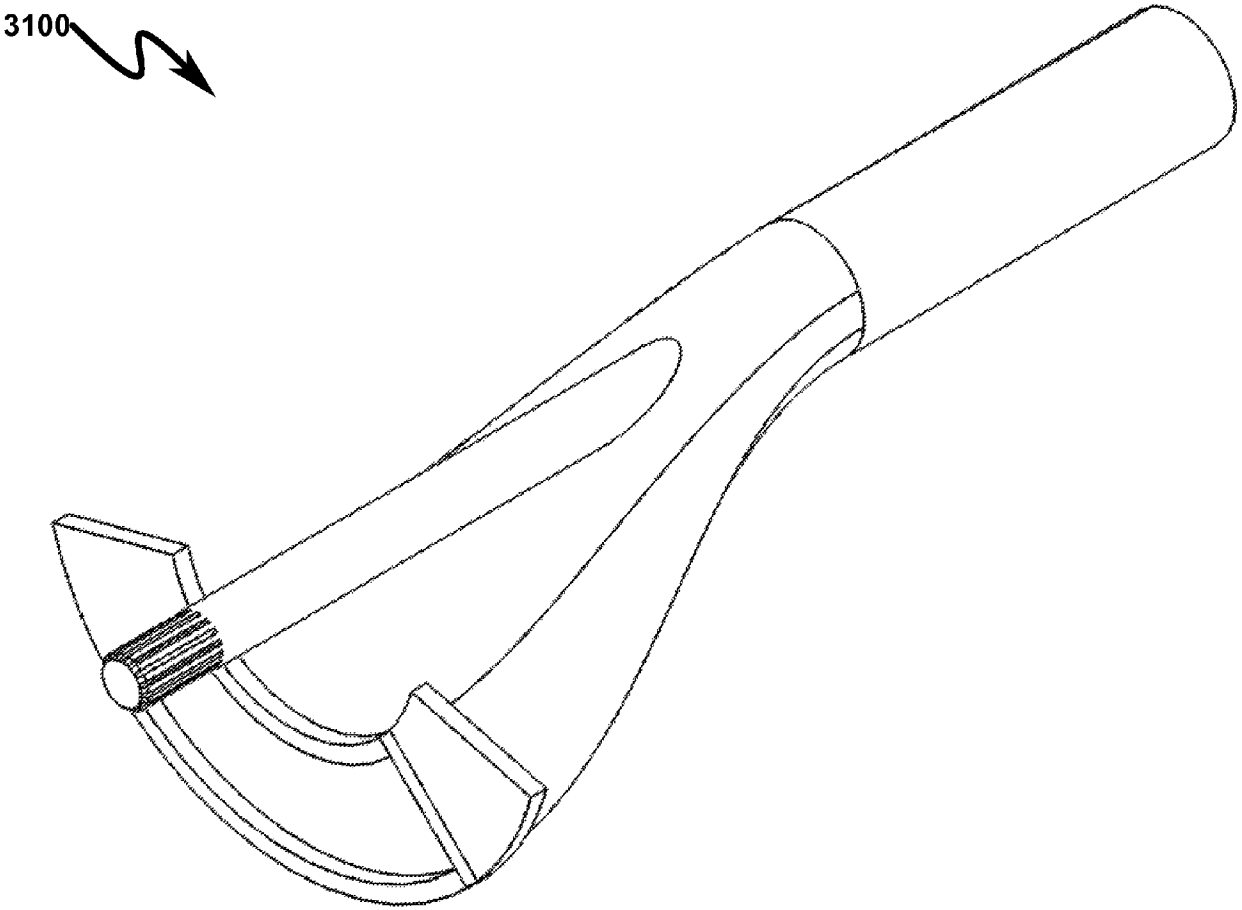
FIG. 31 illustrates a front perspective detail view of a preferred exemplary embodiment of the present invention utilizing a sectioned annular-ring-shaped spectacle plate and detailing the ejection port and cutting plate construction.

Further detail of the trapezoidal-shaped transition regions (2501, 2502) and spectacle plate (2609) are depicted in the sectional views of FIG. 27 (2700) and FIG. 28 (2800). FIG. 29 (2900) and FIG. 30 (3000) detail the trapezoidal-shaped transition regions (2501, 2502) and spectacle plate (2609) without the hydraulic pump cylinders and ejection port/cutting plate. The ejection port/cutting plate (with splined driveshaft) are illustrated in detail in the perspective views of FIG. 31 (3100) and FIG. 32 (3200).

One skilled in the art will recognize that the various embodiments depicted herein may be combined to produce a variety of system configurations consistent with the teachings of the invention.

Trapezoidal-Shaped Spectacle Plate Embodiment (3300)-(4000)

Figure 33:
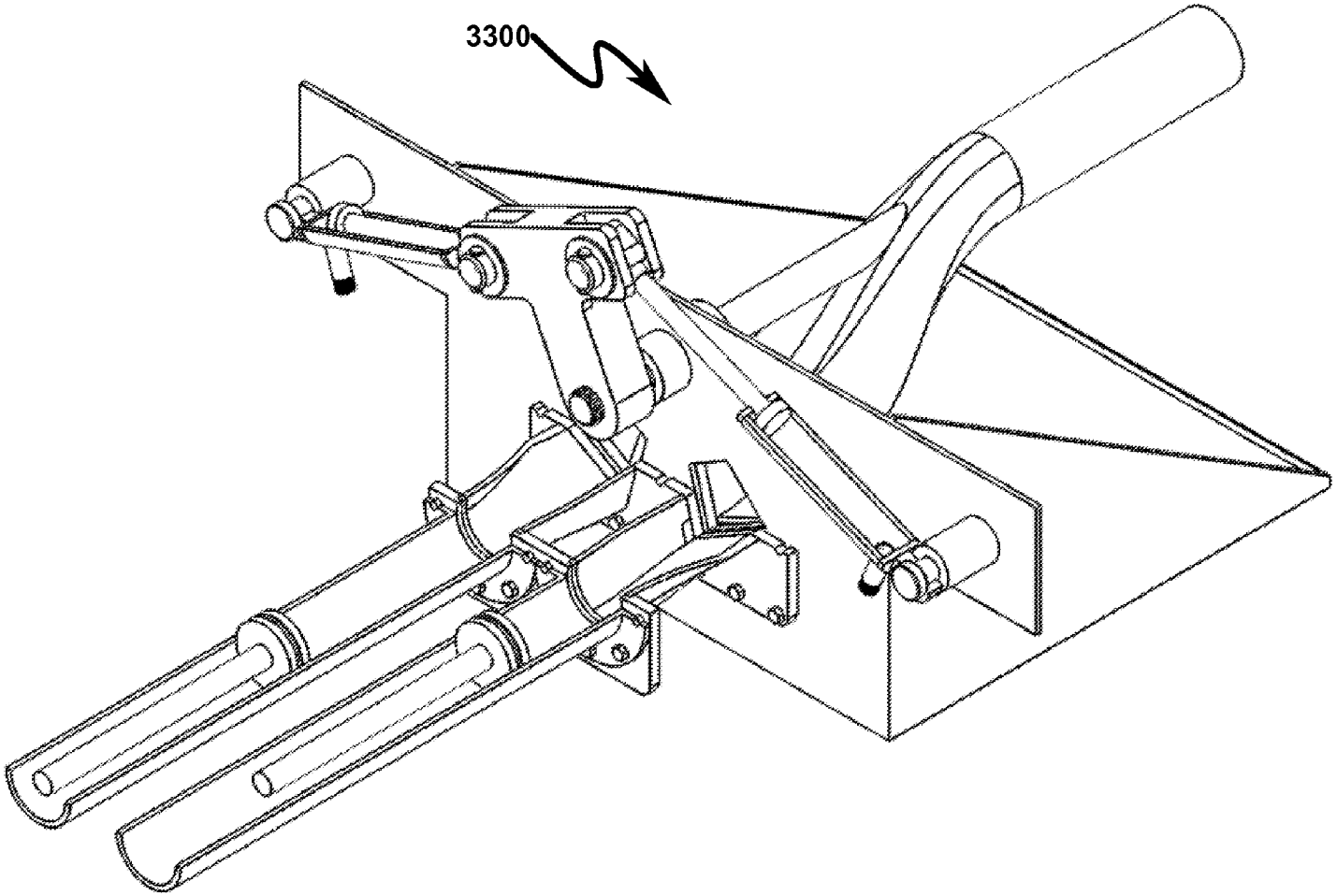
FIG. 33 illustrates a front perspective view of a preferred exemplary embodiment of the present invention utilizing a trapezoidal-shaped spectacle plate and corresponding ejection port/cutting plate.
Figure 34:
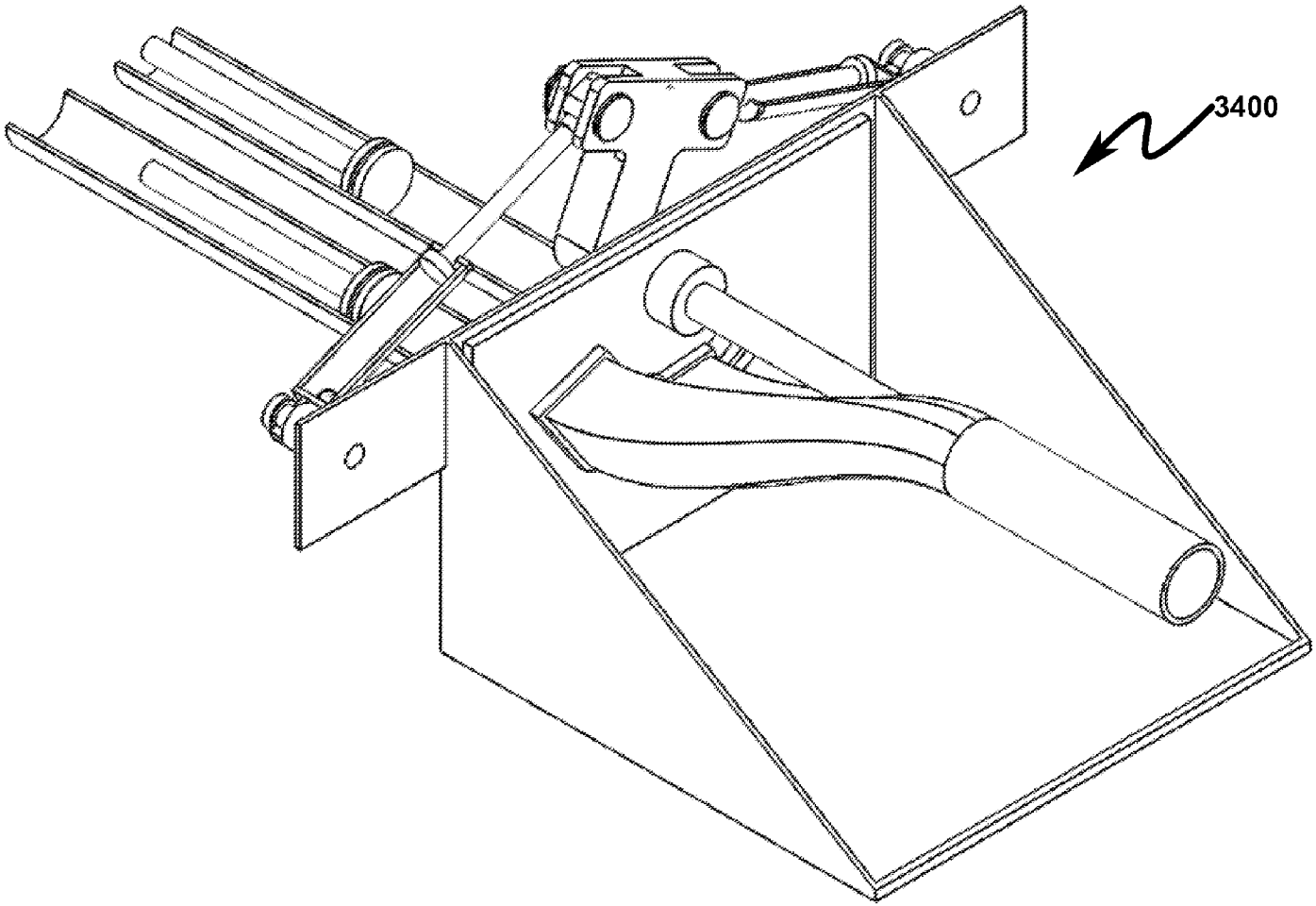
FIG. 34 illustrates a rear perspective view of a preferred exemplary embodiment of the present invention utilizing a trapezoidal-shaped spectacle plate and corresponding ejection port/cutting plate.
Figure 35:
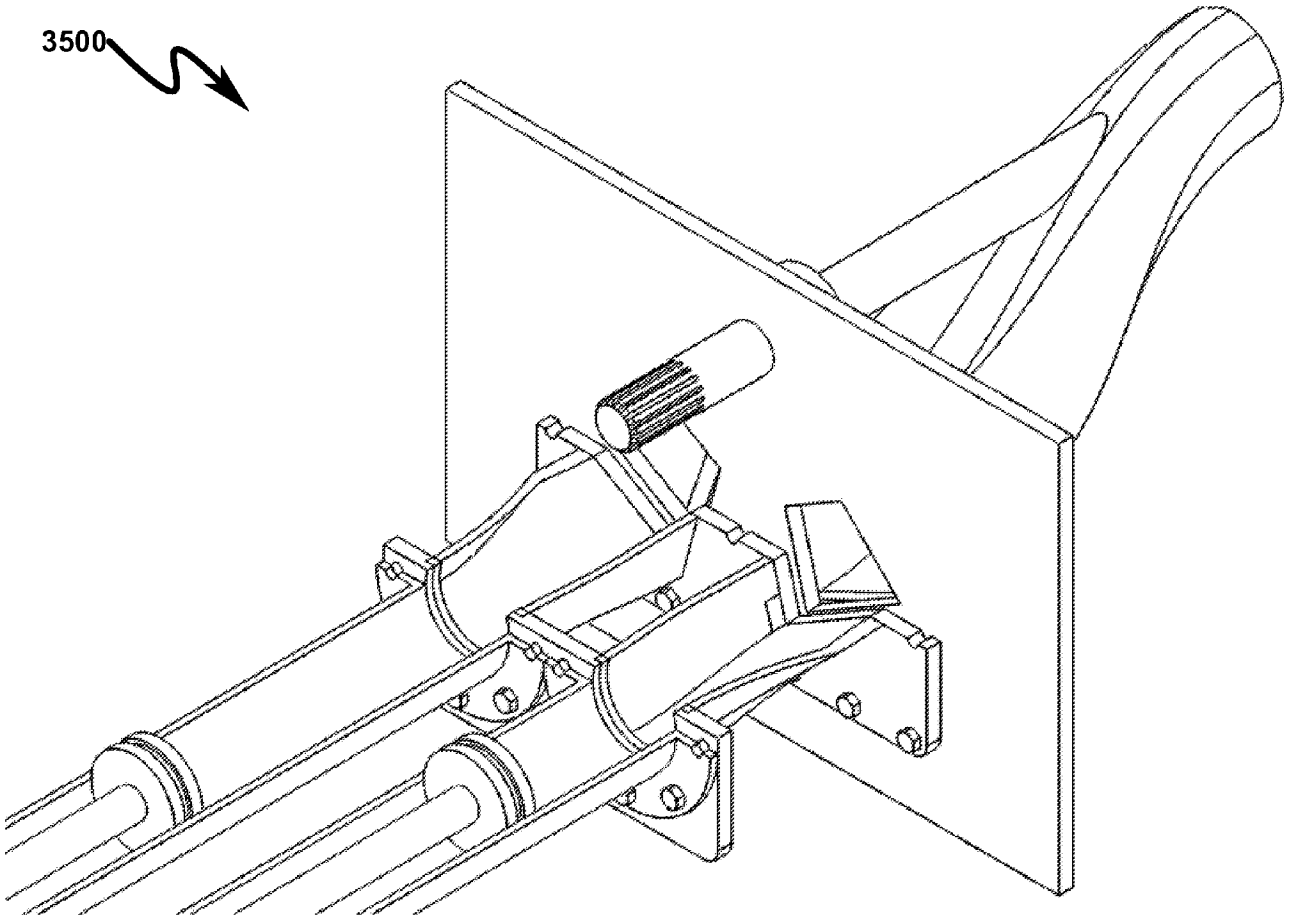
FIG. 35 illustrates a front perspective detail view of a preferred exemplary embodiment of the present invention utilizing a trapezoidal-shaped spectacle plate and corresponding ejection port/cutting plate with transition hydraulic pump ram inputs in section view.
Figure 36:
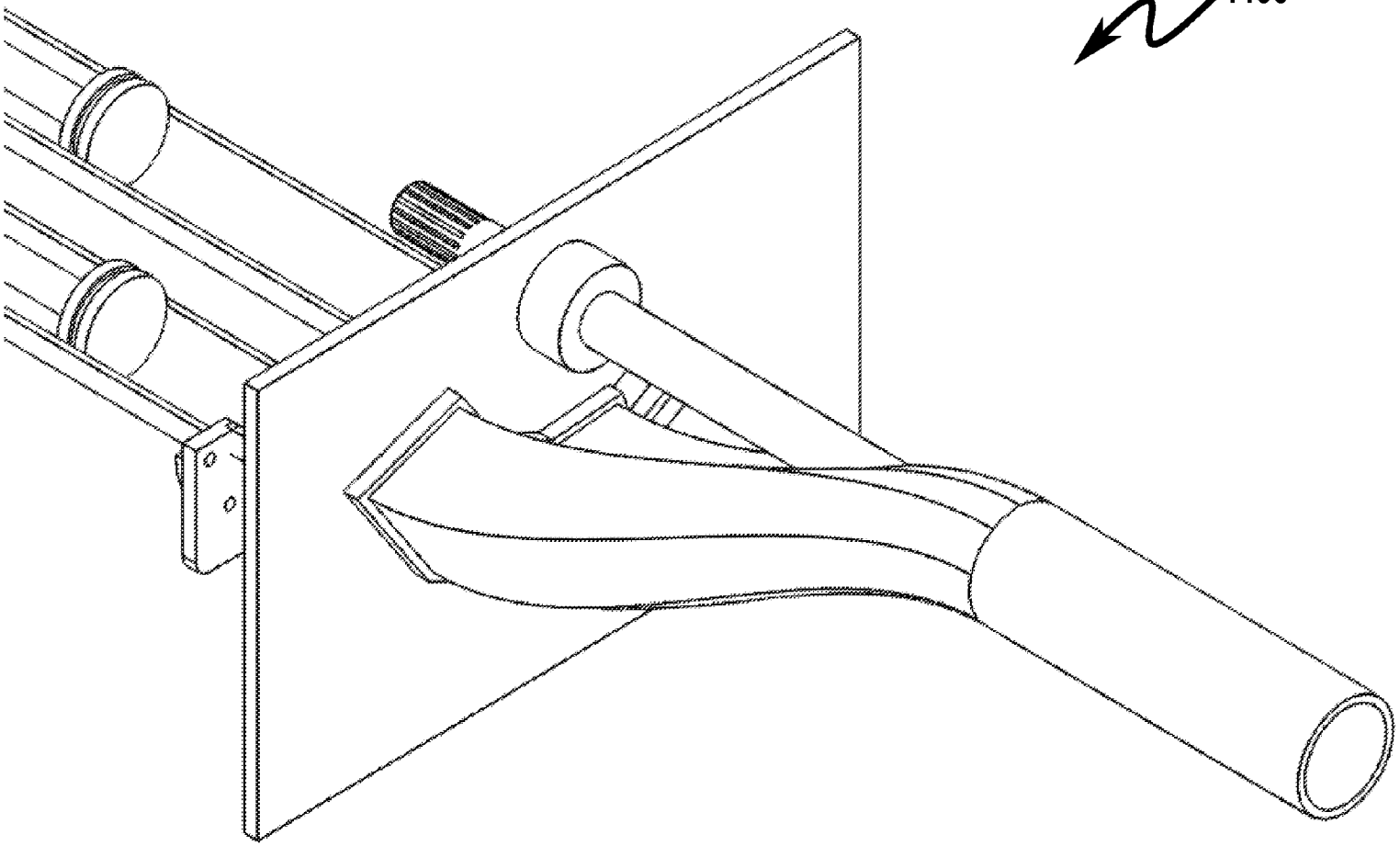
FIG. 36 illustrates a rear perspective detail view of a preferred exemplary embodiment of the present invention utilizing a trapezoidal-shaped spectacle plate and corresponding ejection port/cutting plate with transition hydraulic pump ram inputs in section view.
Figure 37:
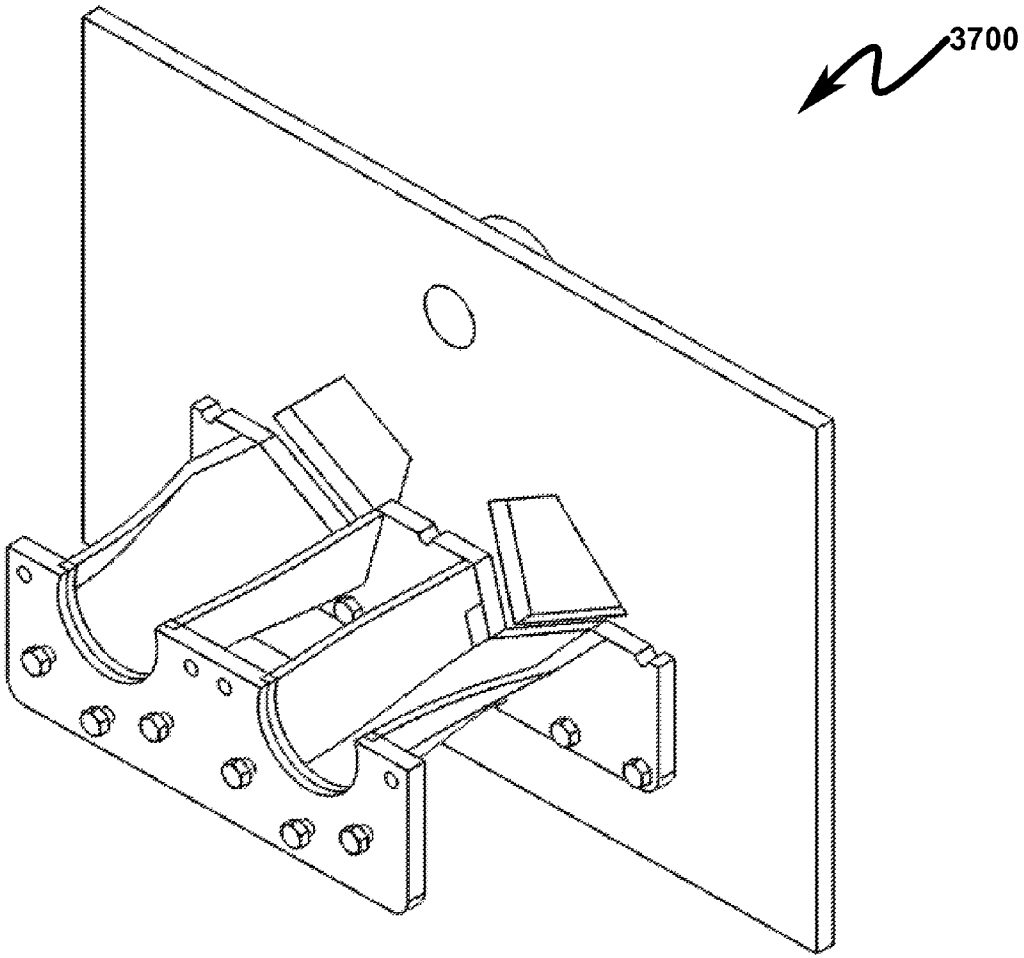
FIG. 37 illustrates a front perspective detail view of a preferred exemplary embodiment of the present invention utilizing a trapezoidal-shaped spectacle plate and corresponding ejection port/cutting plate detailing the transition port apertures in the spectacle plate.
Figure 38:
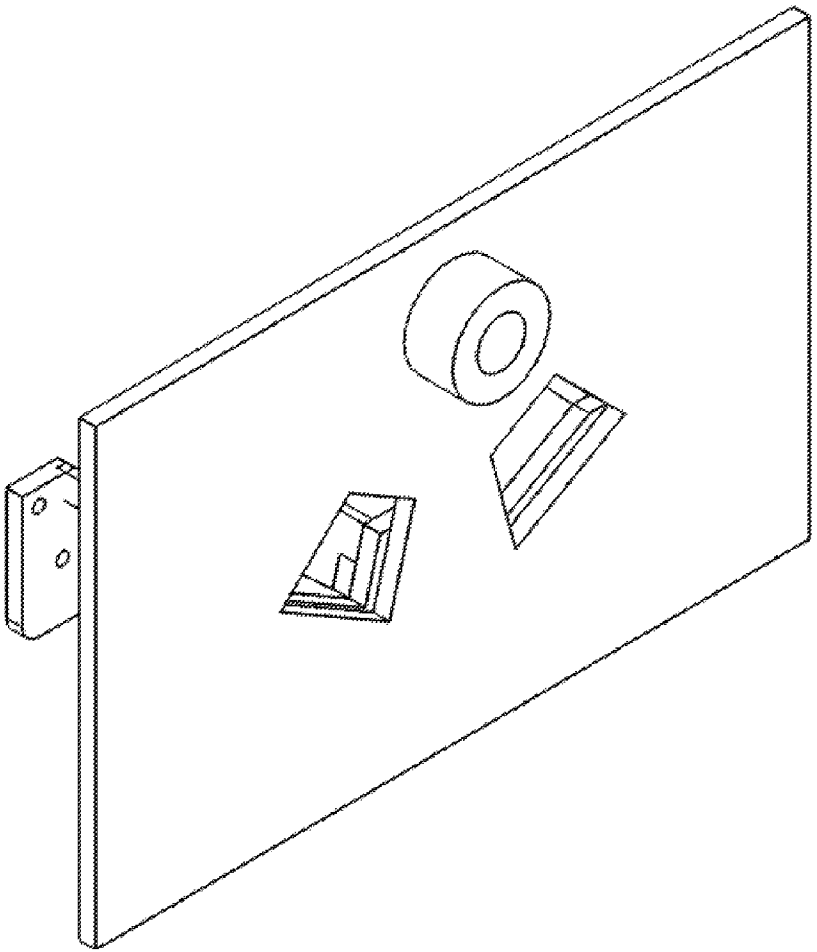
FIG. 38 illustrates a rear perspective detail view of a preferred exemplary embodiment of the present invention utilizing a trapezoidal-shaped spectacle plate and corresponding ejection port/cutting plate detailing the transition port apertures in the spectacle plate.
Figure 39:
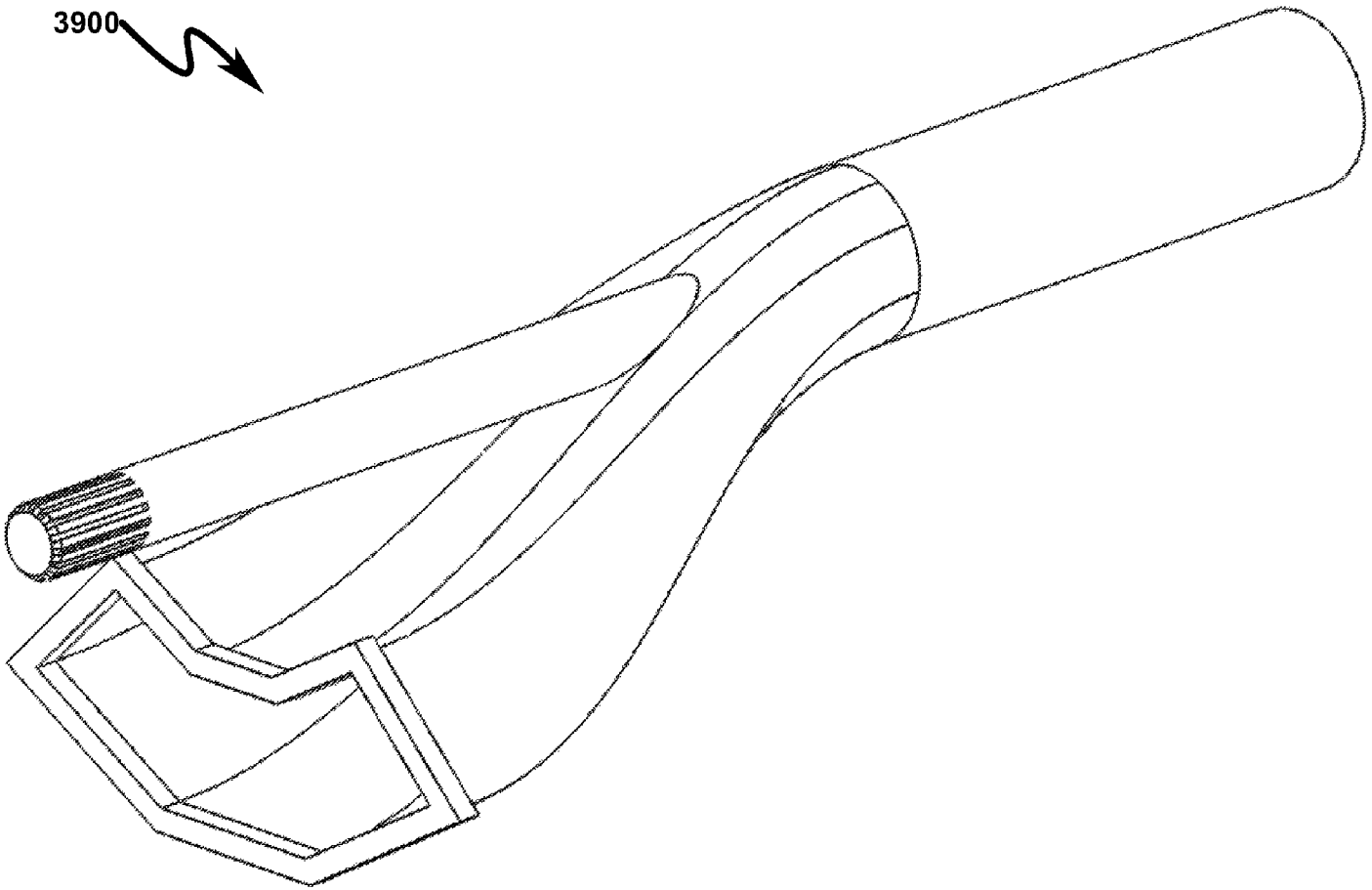
FIG. 39 illustrates a front perspective detail view of a preferred exemplary embodiment of the present invention utilizing a trapezoidal-shaped spectacle plate and detailing the ejection port and cutting plate construction.

As mentioned previously, the term "trapezoidal" should be given a broad interpretation in defining the scope of the present invention. As depicted in FIG. 25 (2500)-FIG. 32 (3200), this is embodied as a sector of an annulus or annular ring. However, as depicted in FIG. 33 (3300)-FIG. 40 (4000), the spectacle plate aperture (and corresponding ejection port cutting plate) may be configured using conventional trapezoidal structures as shown. Combinations of these two constructs are also anticipated by the present invention. The key features of (a) providing port flow during all portions of the pumping cycle and (b) sealing off access to the material hopper from the ejection port during cycle shifts are the only restraints on the invention operation and construction.

Method Overview (4100)-(6100)

Figure 44:
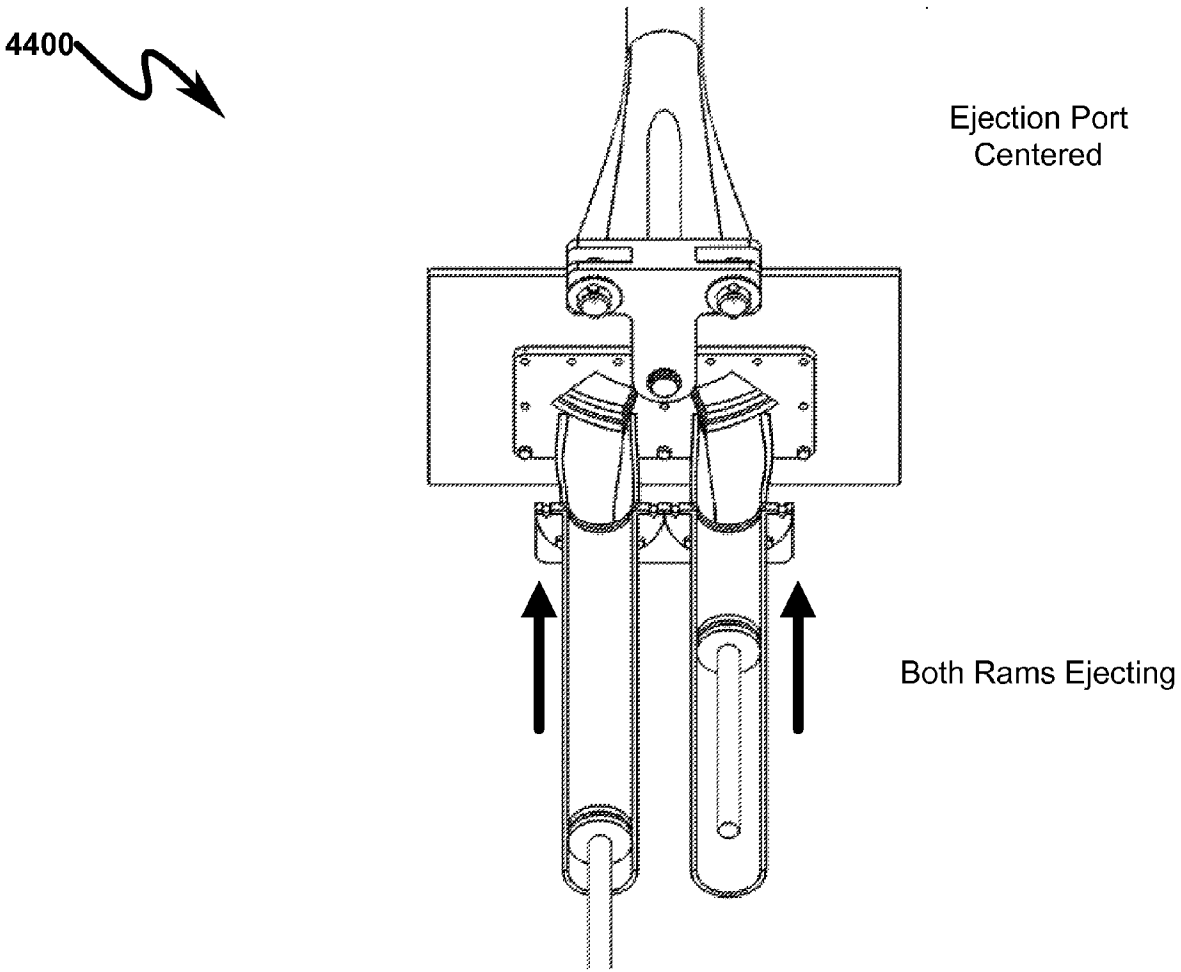
FIG. 44 illustrates a front perspective view of a preferred exemplary embodiment of the present invention utilizing a sectioned annular-ring-shaped spectacle plate configured with the ejection port centered and both rams ejecting.
Figure 45:
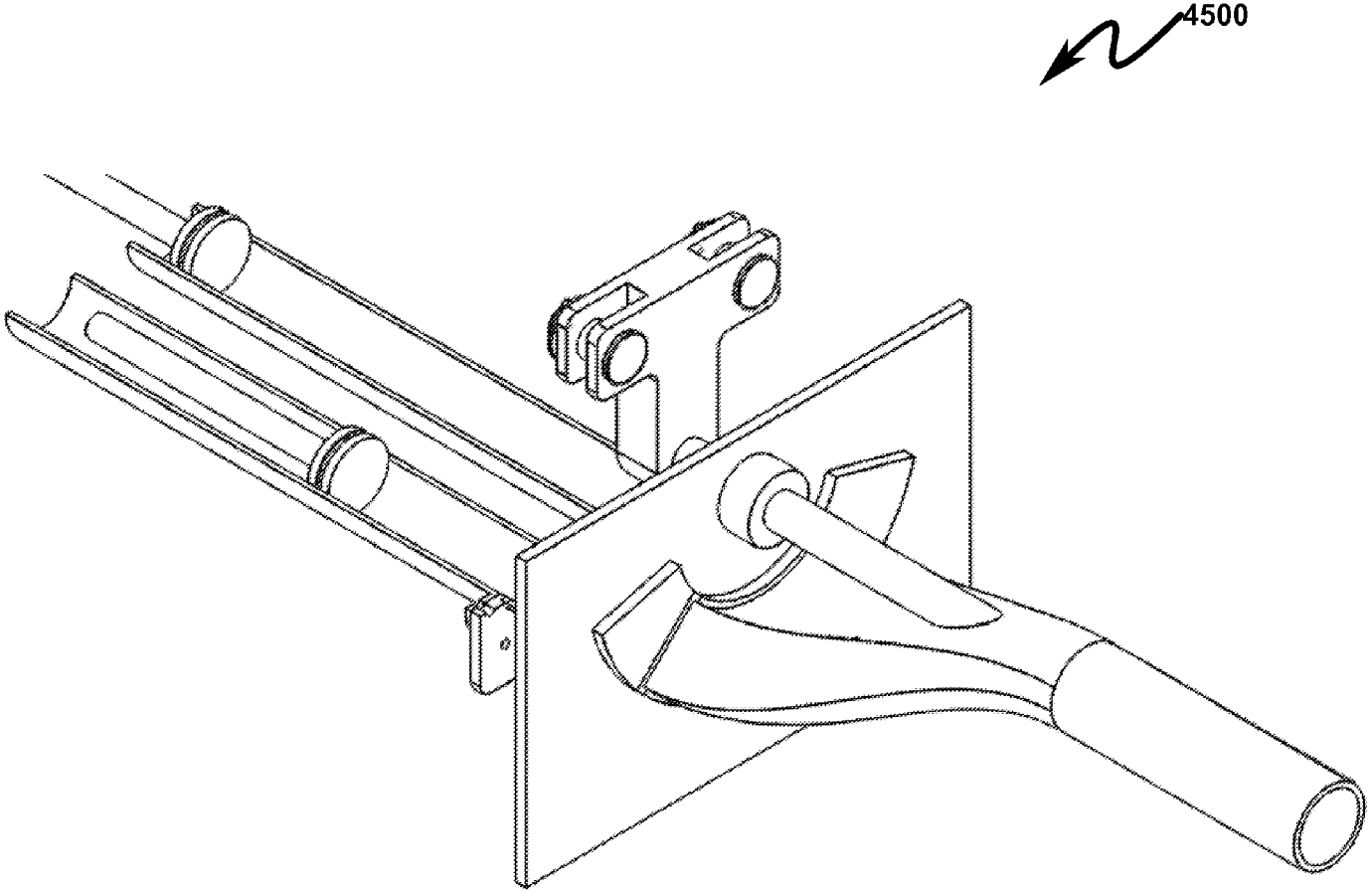
FIG. 45 illustrates a rear perspective view of a preferred exemplary embodiment of the present invention utilizing a sectioned annular-ring-shaped spectacle plate configured with the ejection port centered and both rams ejecting.
Figure 46:
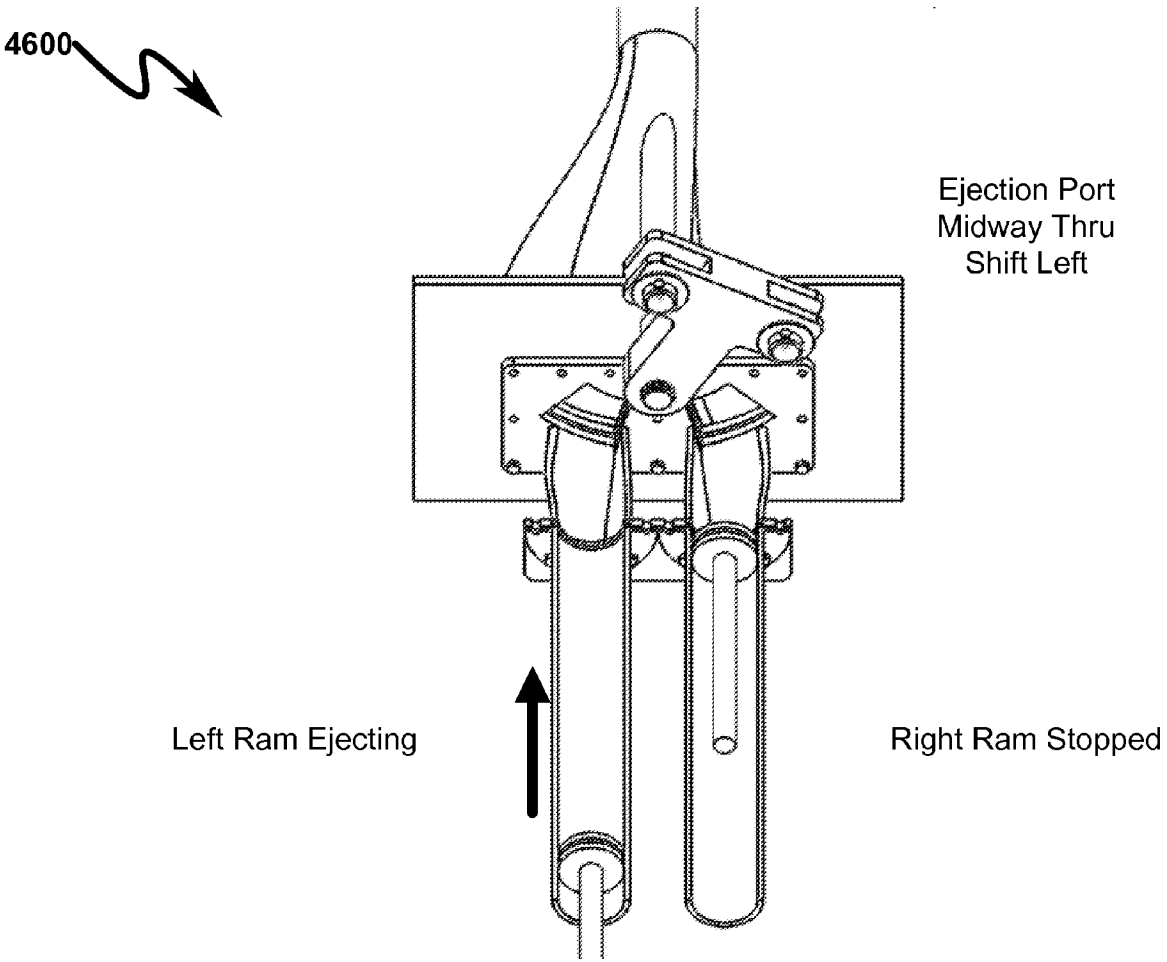
FIG. 46 illustrates a front perspective view of a preferred exemplary embodiment of the present invention utilizing a sectioned annular-ring-shaped spectacle plate configured with the ejection port positioned midway through shift left with the left ram ejecting and the right ram stopped.
Figure 47:
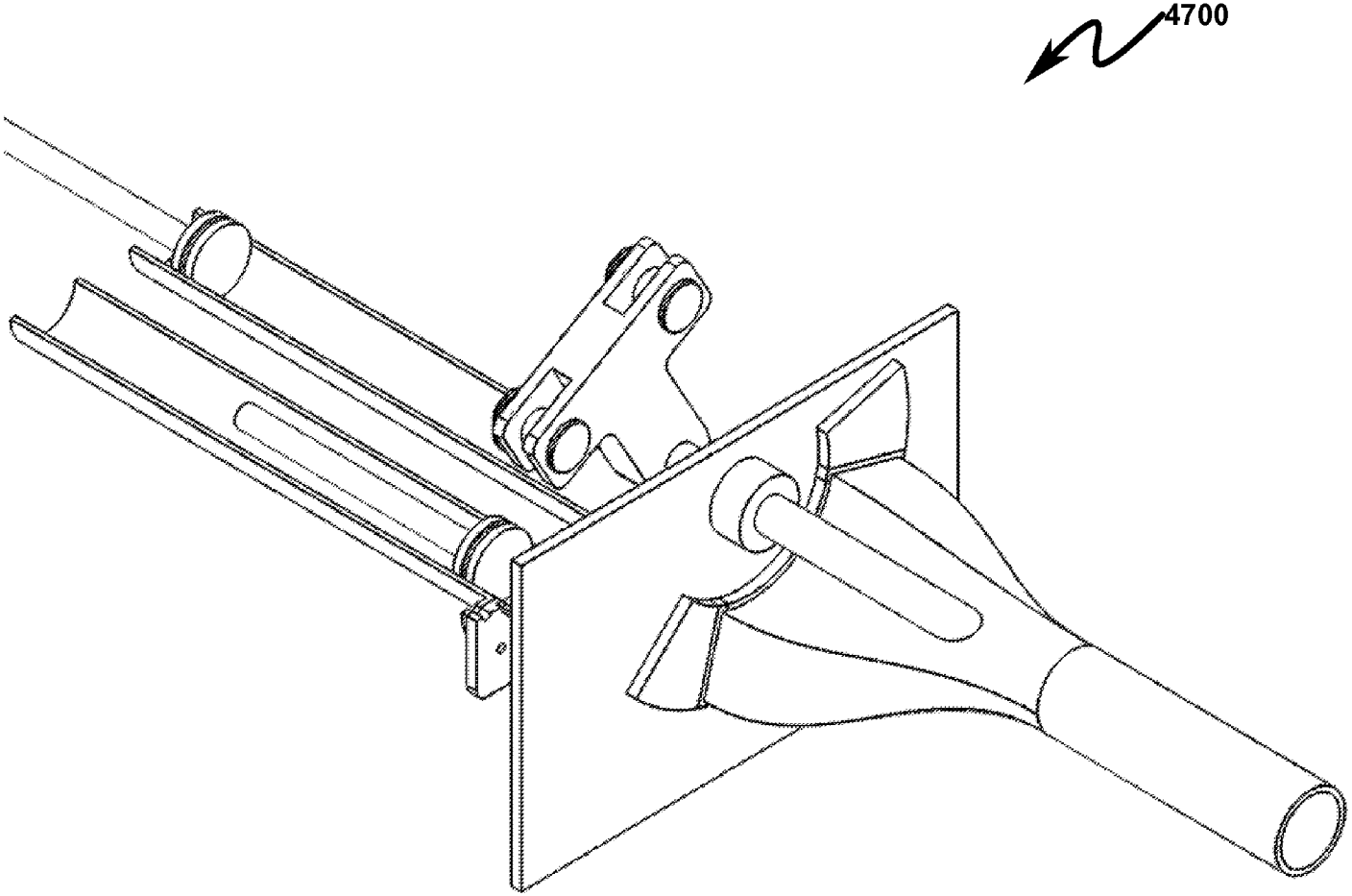
FIG. 47 illustrates a rear perspective view of a preferred exemplary embodiment of the present invention utilizing a sectioned annular-ring-shaped spectacle plate configured with the ejection port positioned midway through shift left with the left ram ejecting and the right ram stopped.
Figure 48:
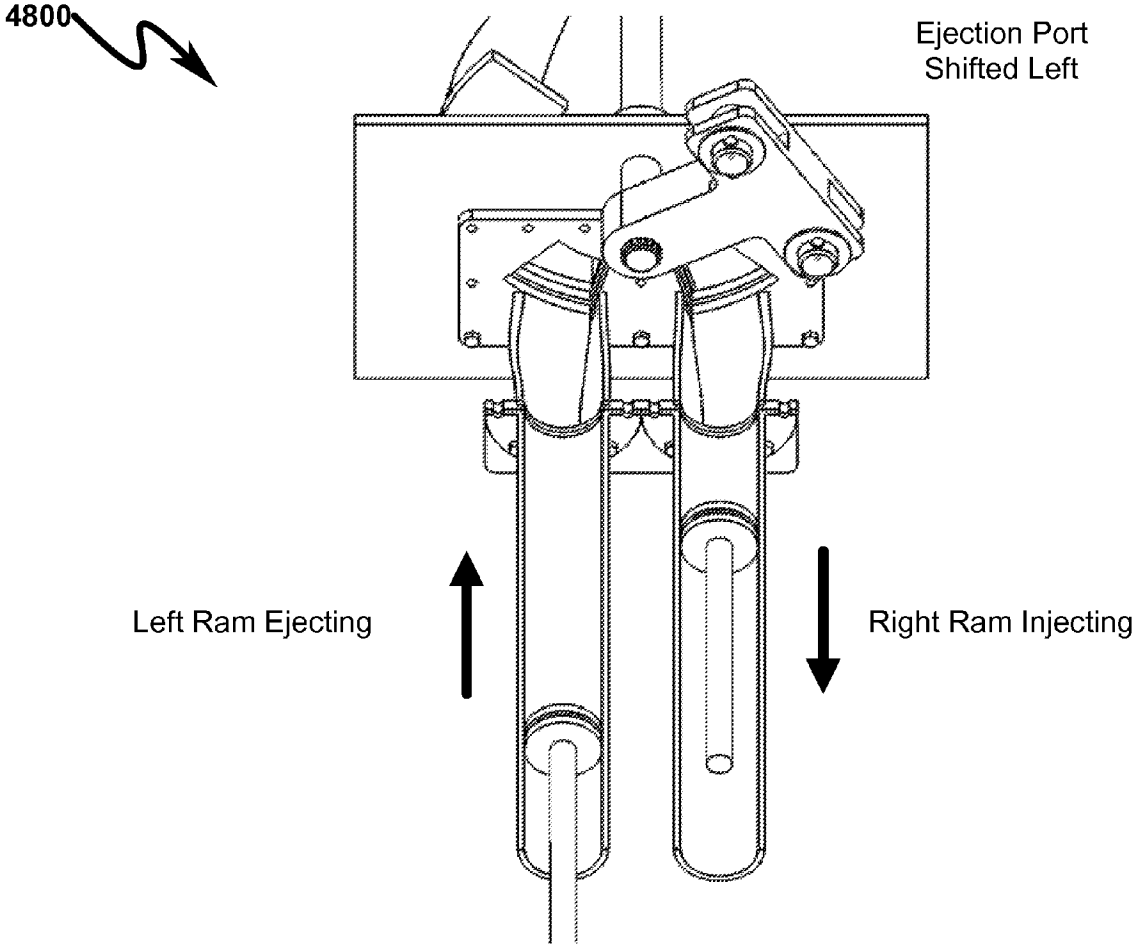
FIG. 48 illustrates a front perspective view of a preferred exemplary embodiment of the present invention utilizing a sectioned annular-ring-shaped spectacle plate configured with the ejection port shifted left with the left ram ejecting and the right ram injecting.
Figure 49:
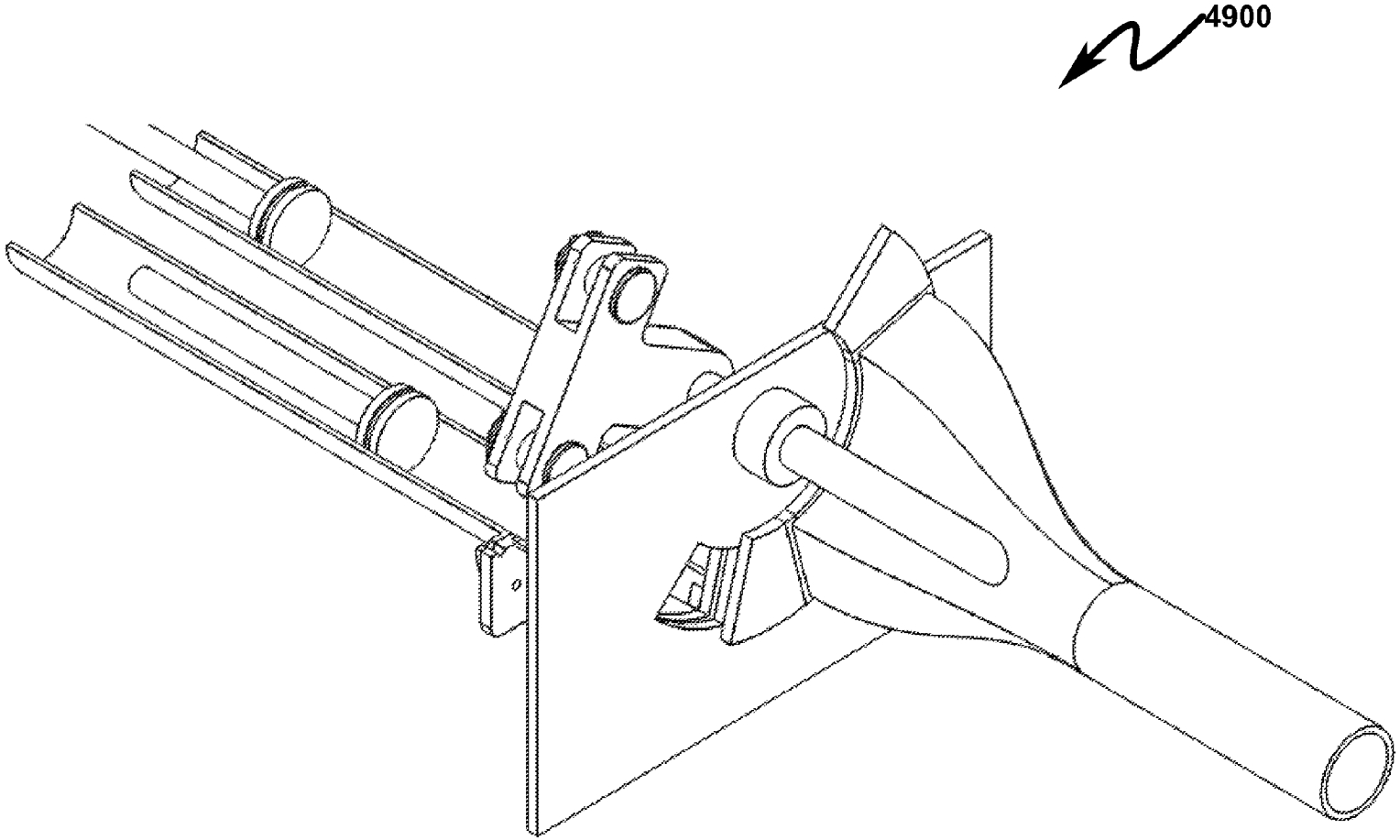
FIG. 49 illustrates a rear perspective view of a preferred exemplary embodiment of the present invention utilizing a sectioned annular-ring-shaped spectacle plate configured with the ejection port shifted left with the left ram ejecting and the right ram injecting.
Figure 50:
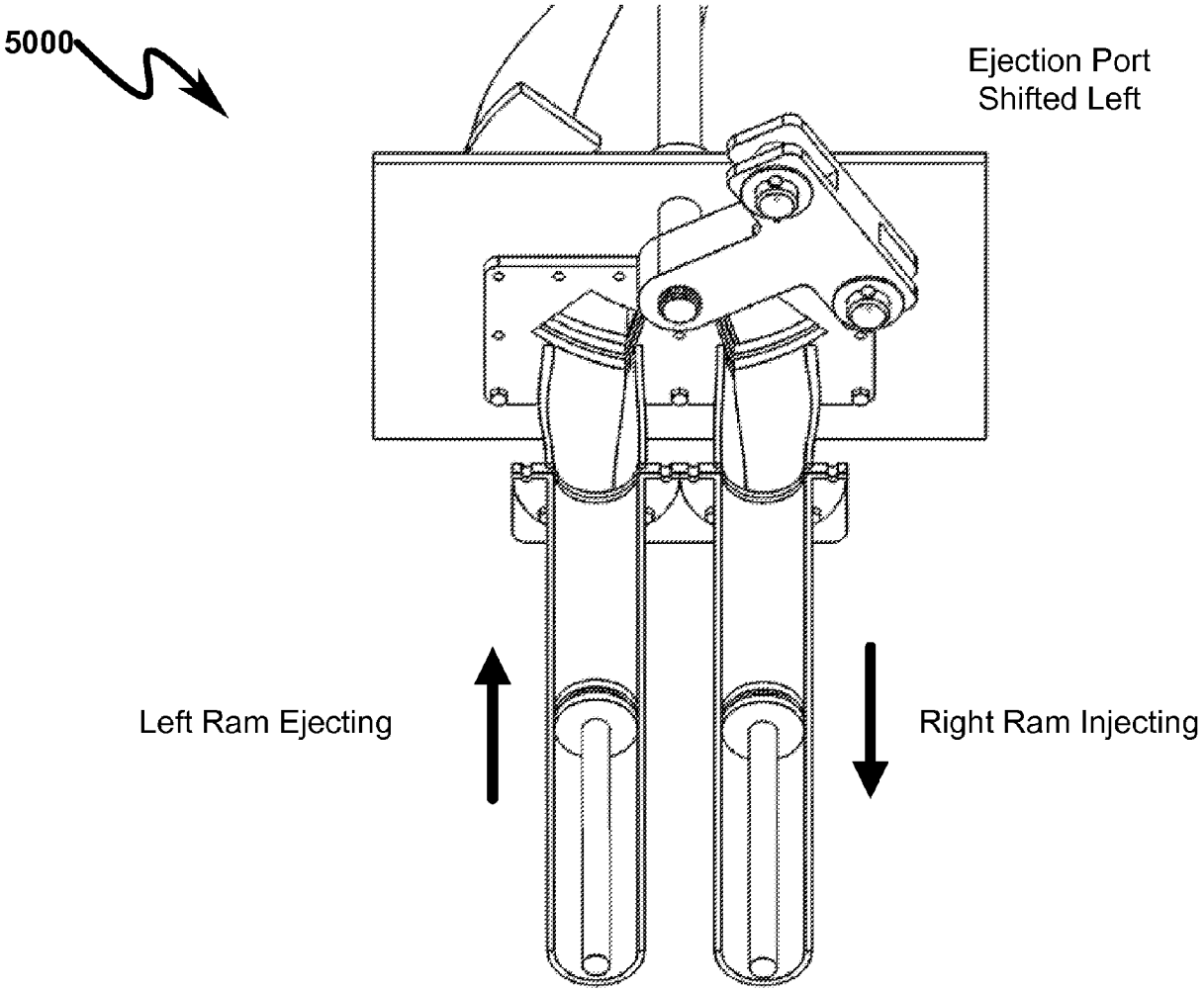
FIG. 50 illustrates a front perspective view of a preferred exemplary embodiment of the present invention utilizing a sectioned annular-ring-shaped spectacle plate configured with the ejection port shifted left with the left ram ejecting and the right ram injecting.
Figure 51:
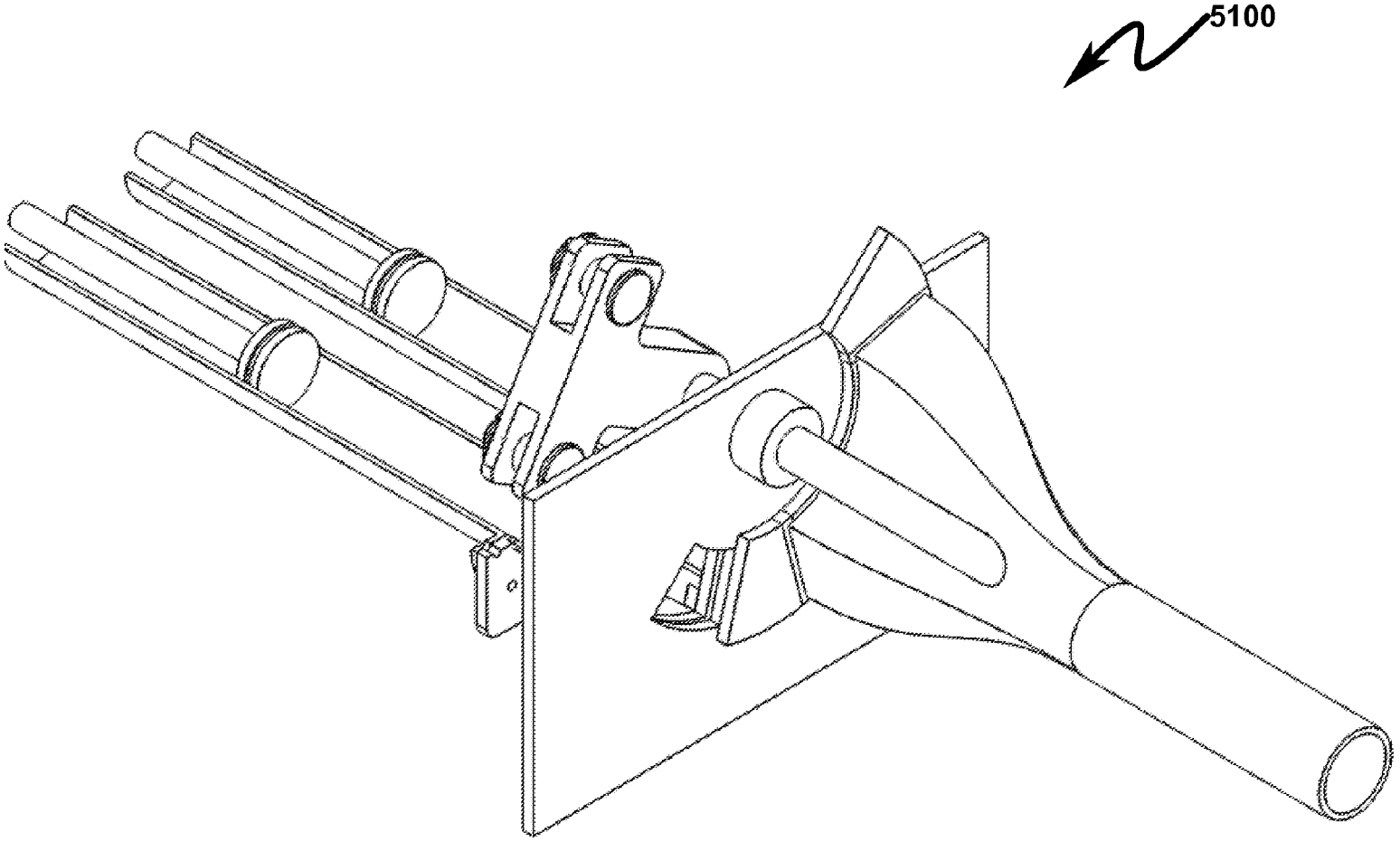
FIG. 51 illustrates a rear perspective view of a preferred exemplary embodiment of the present invention utilizing a sectioned annular-ring-shaped spectacle plate configured with the ejection port shifted left with the left ram ejecting and the right ram injecting.
Figure 52:
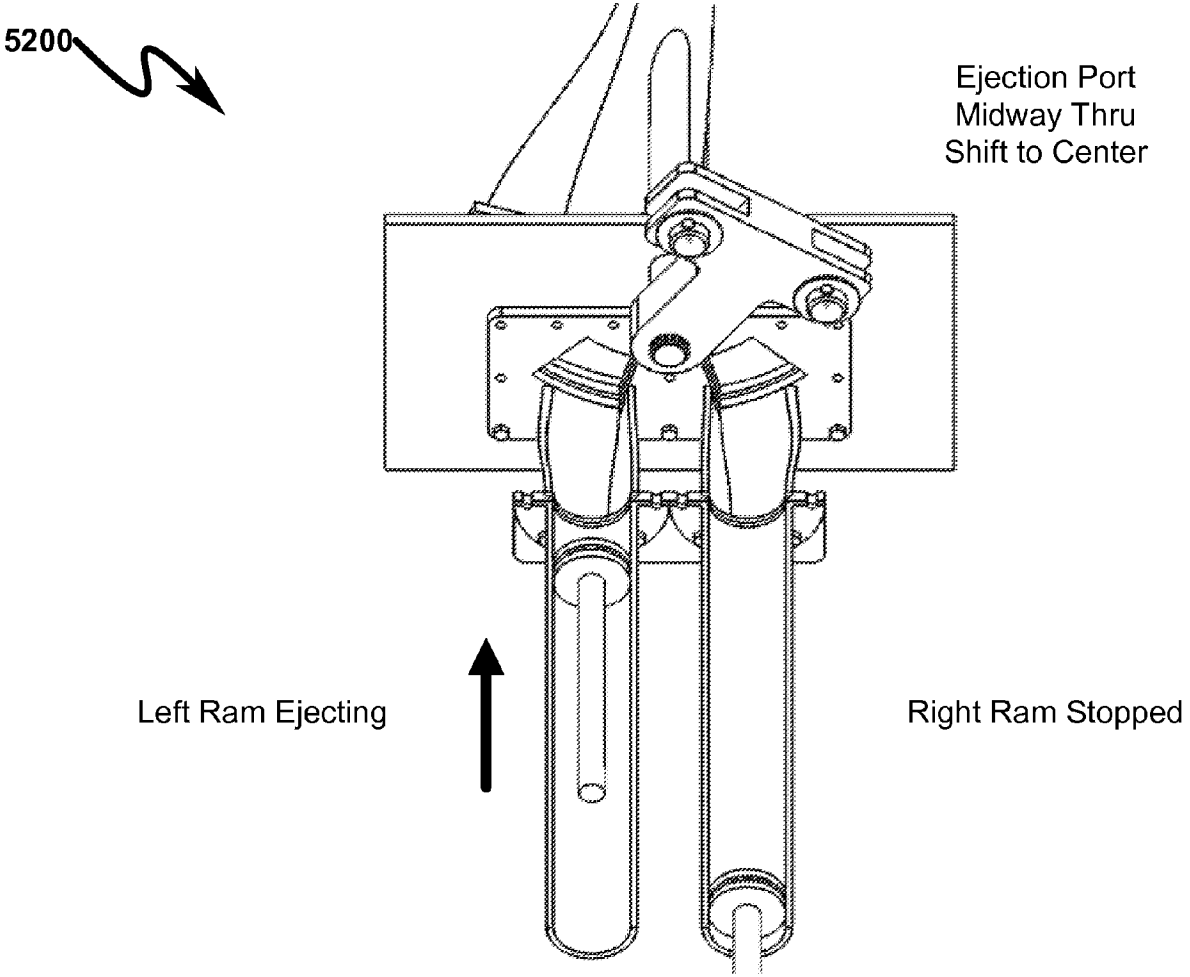
FIG. 52 illustrates a front perspective view of a preferred exemplary embodiment of the present invention utilizing a sectioned annular-ring-shaped spectacle plate configured with the ejection port positioned midway thru shift to center with the left ram ejecting and the right ram stopped.
Figure 53:
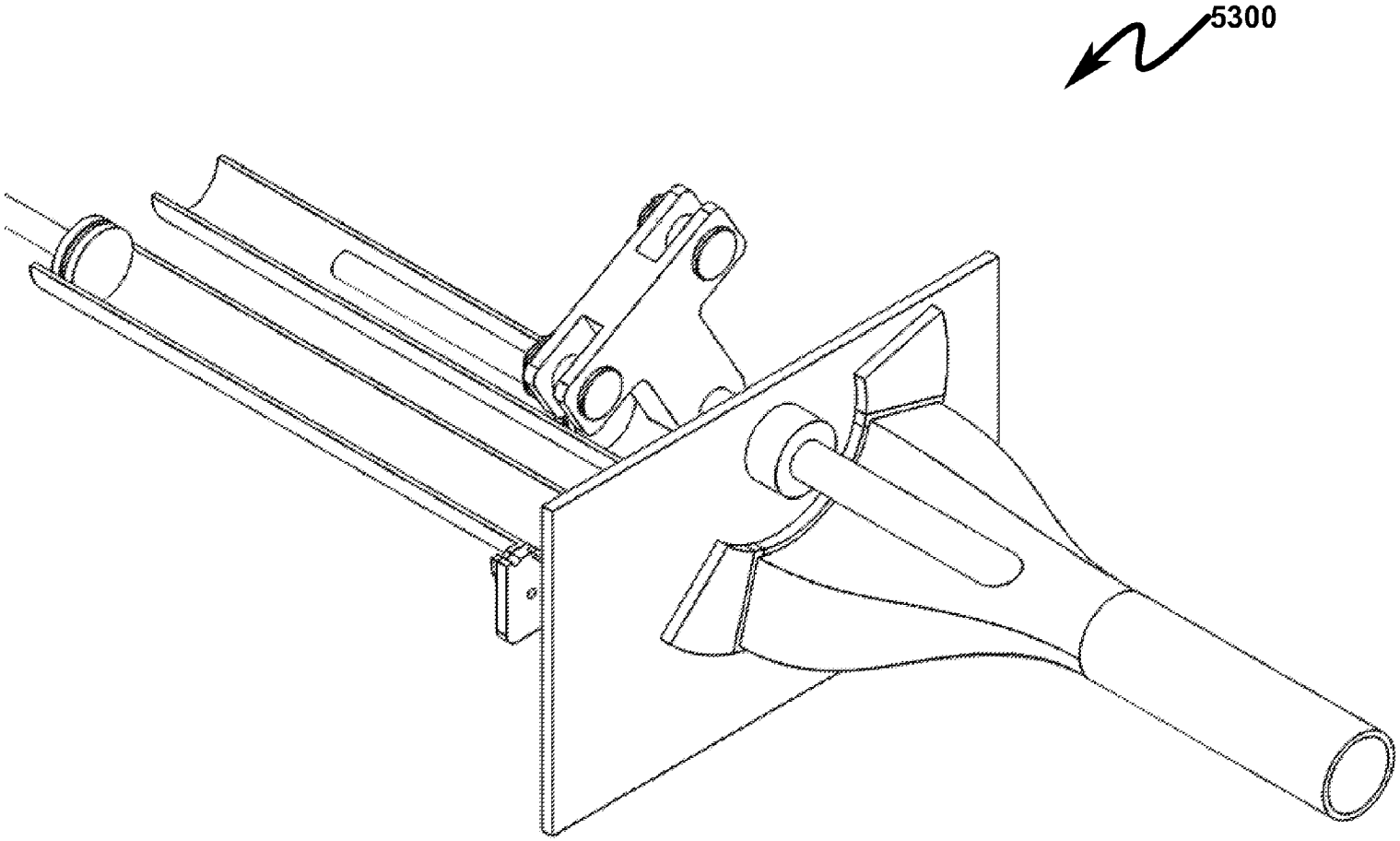
FIG. 53 illustrates a rear perspective view of a preferred exemplary embodiment of the present invention utilizing a sectioned annular-ring-shaped spectacle plate configured with the ejection port positioned midway thru shift to center with the left ram ejecting and the right ram stopped.
Figure 54:
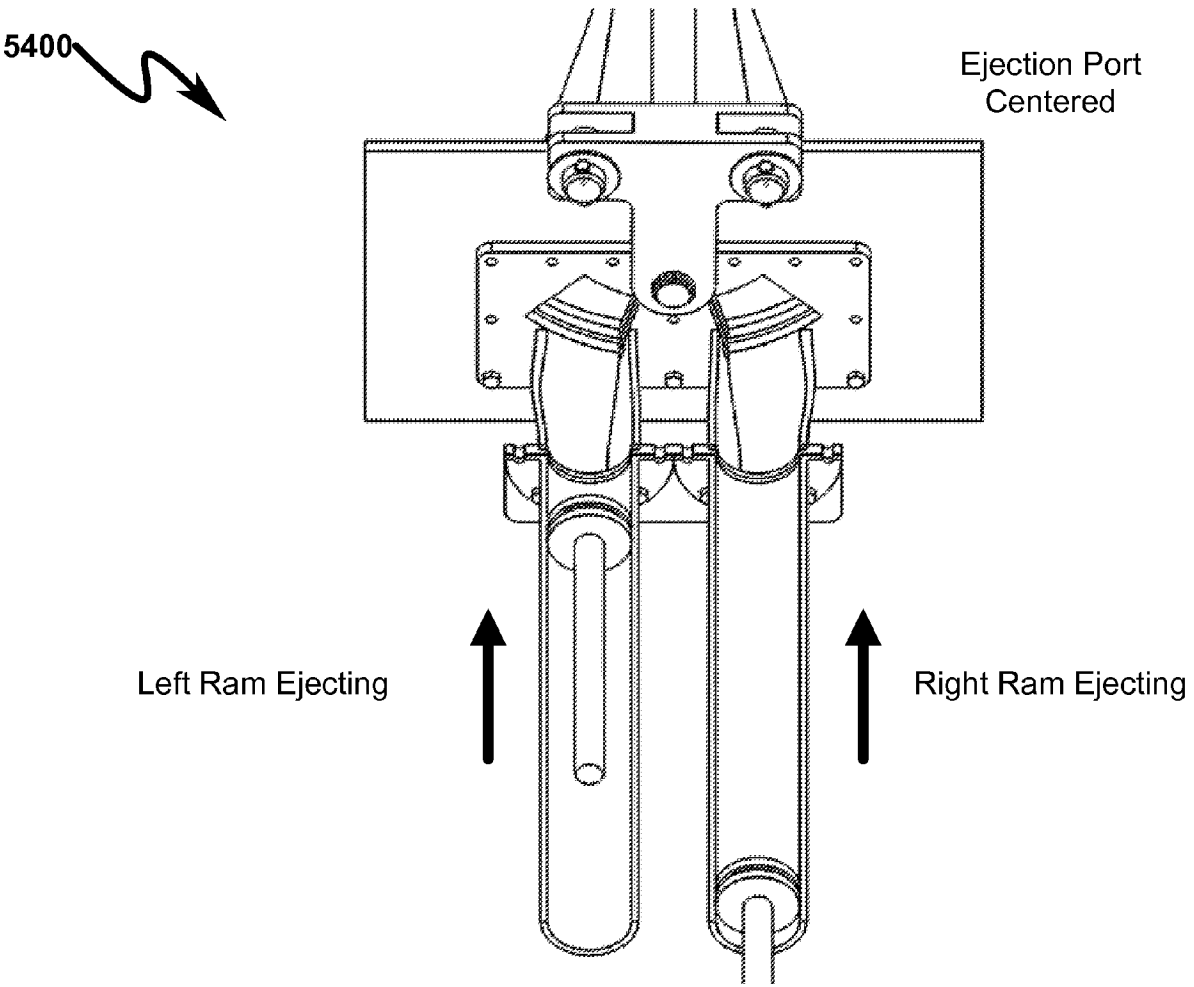
FIG. 54 illustrates a front perspective view of a preferred exemplary embodiment of the present invention utilizing a sectioned annular-ring-shaped spectacle plate configured with the ejection port centered with the left ram ejecting and the right ram ejecting.
Figure 55:
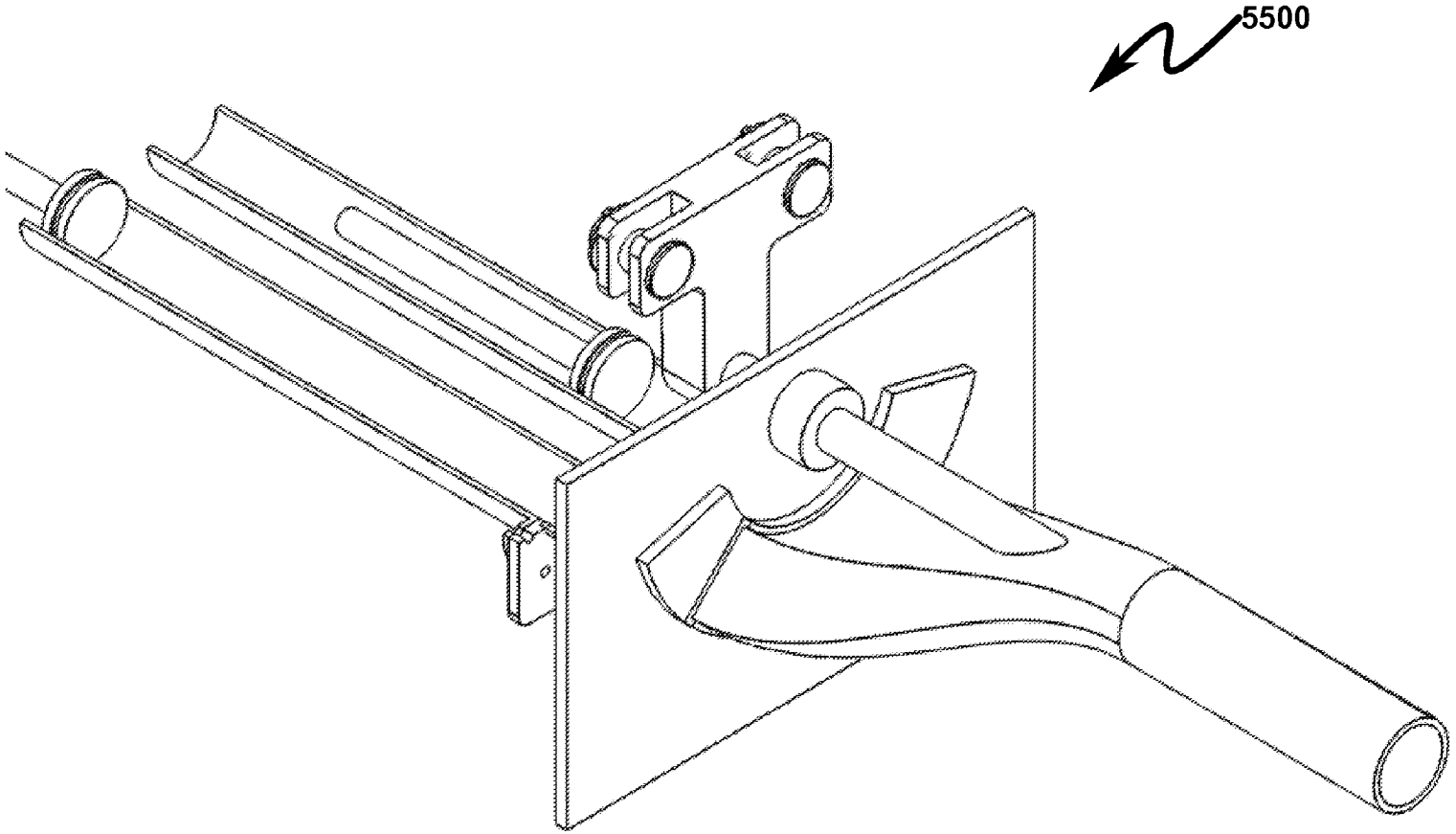
FIG. 55 illustrates a rear perspective view of a preferred exemplary embodiment of the present invention utilizing a sectioned annular-ring-shaped spectacle plate configured with the ejection port centered with the left ram ejecting and the right ram ejecting.
Figure 56:
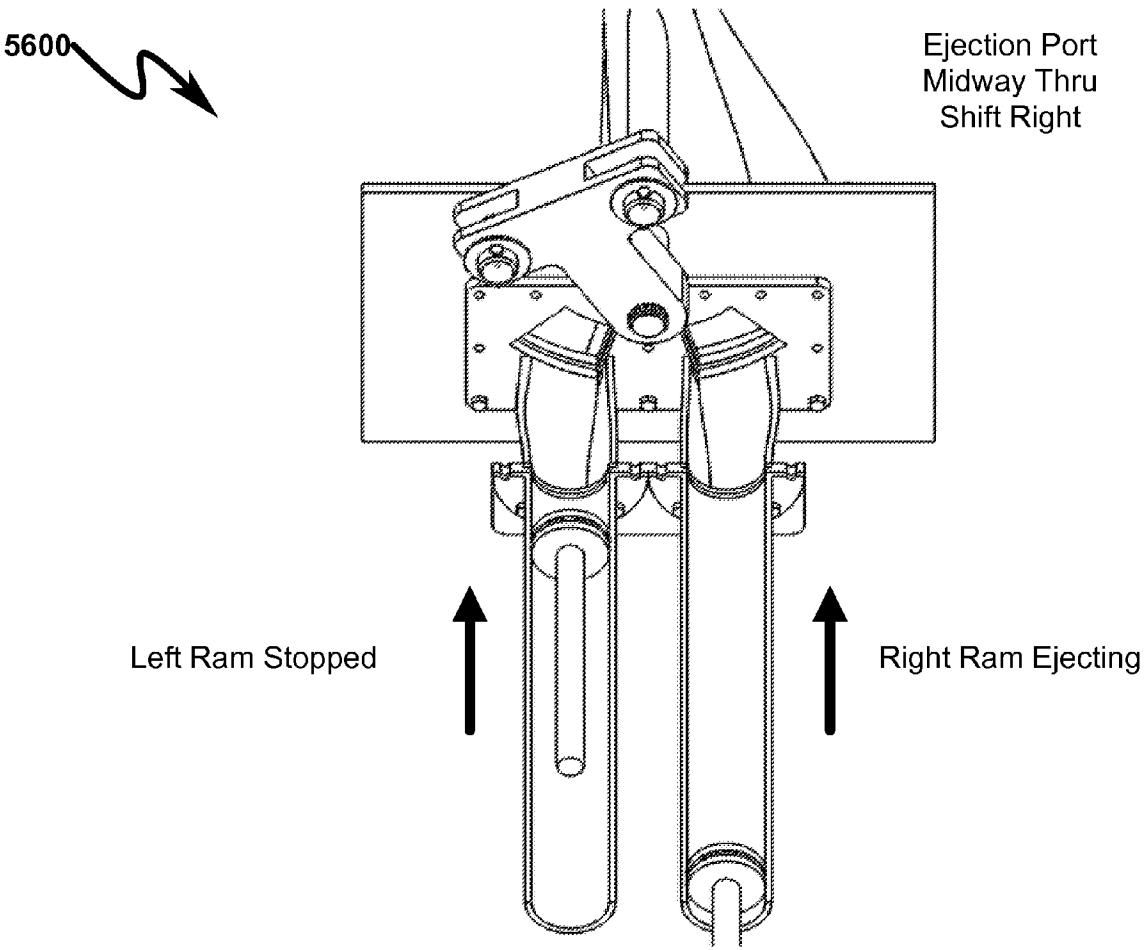
FIG. 56 illustrates a front perspective view of a preferred exemplary embodiment of the present invention utilizing a sectioned annular-ring-shaped spectacle plate configured with the ejection port positioned midway thru shift right with the left ram stopped and the right ram ejecting.
Figure 57:
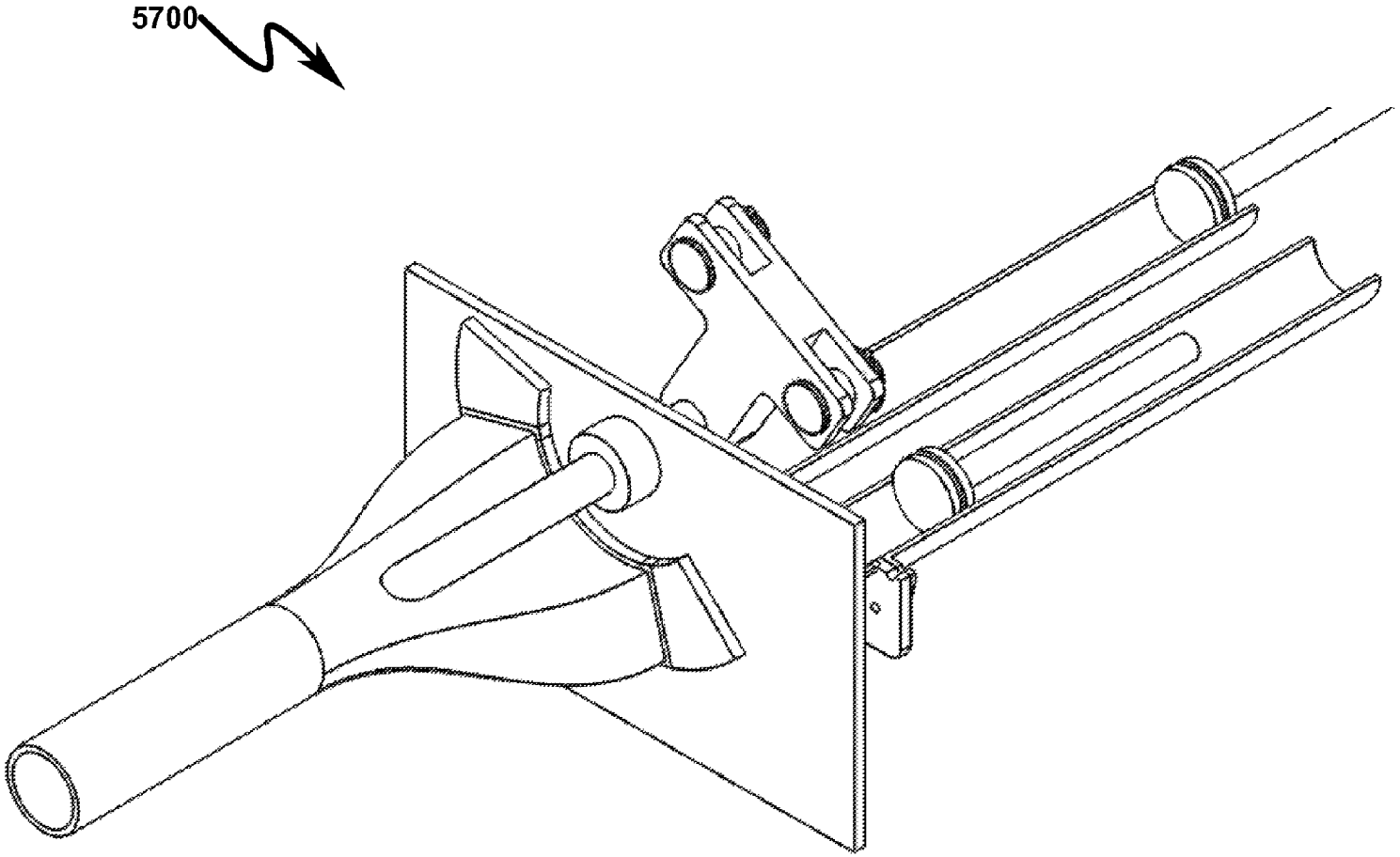
FIG. 57 illustrates a rear perspective view of a preferred exemplary embodiment of the present invention utilizing a sectioned annular-ring-shaped spectacle plate configured with the ejection port positioned midway thru shift right with the left ram stopped and the right ram ejecting.
Figure 58:
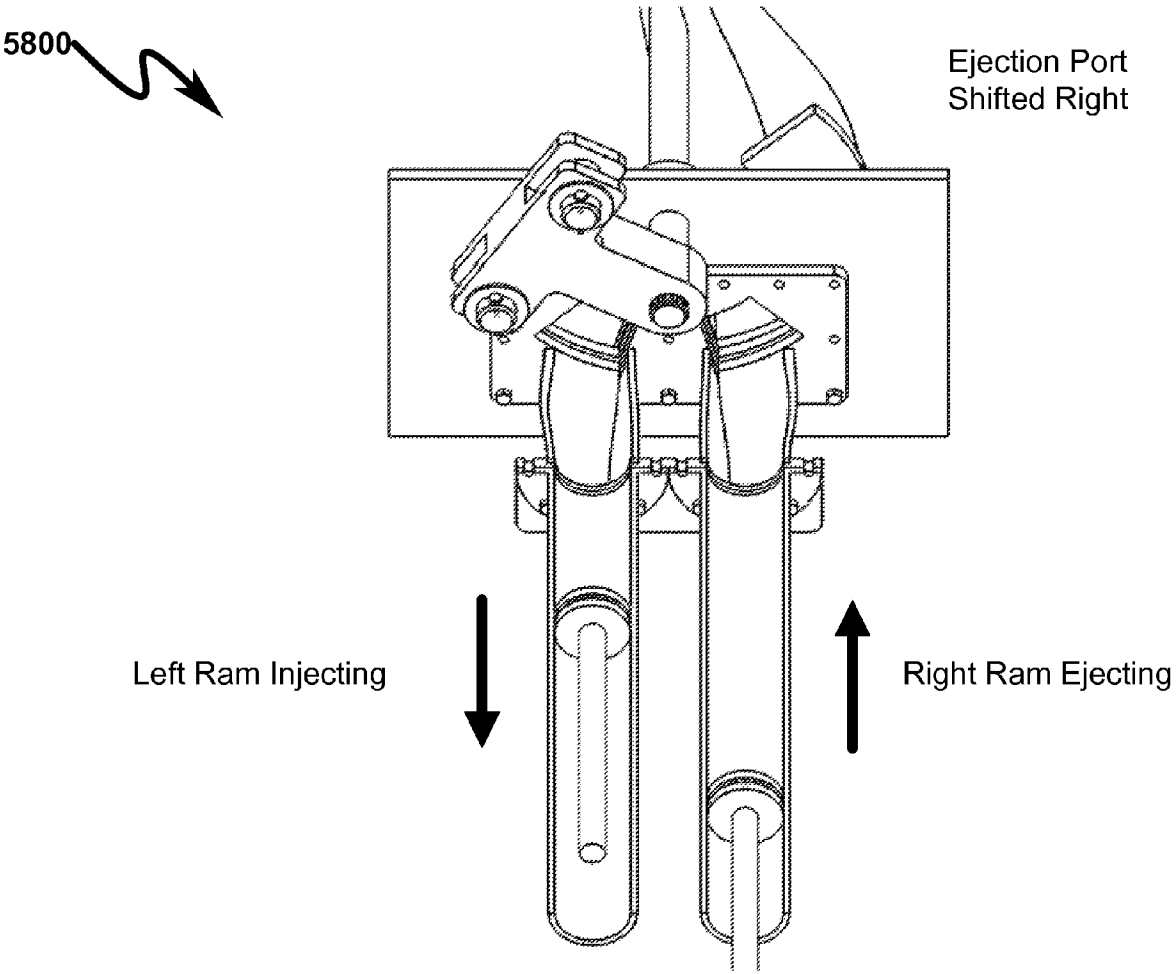
FIG. 58 illustrates a front perspective view of a preferred exemplary embodiment of the present invention utilizing a sectioned annular-ring-shaped spectacle plate configured with the ejection port shifted right with the left ram injecting and the right ram ejecting.
Figure 59:
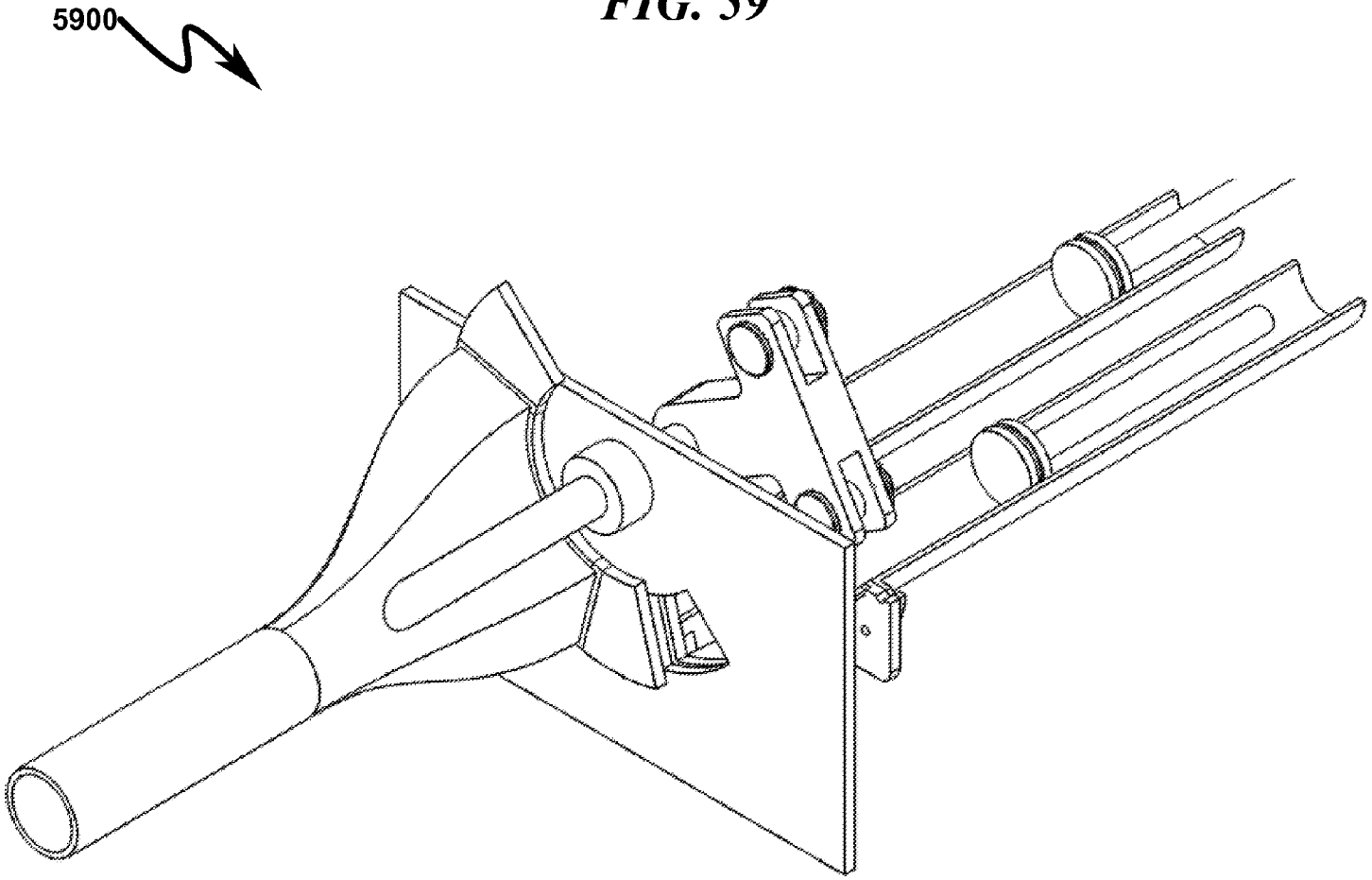
FIG. 59 illustrates a rear perspective view of a preferred exemplary embodiment of the present invention utilizing a sectioned annular-ring-shaped spectacle plate configured with the ejection port shifted right with the left ram injecting and the right ram ejecting.
Figure 60:
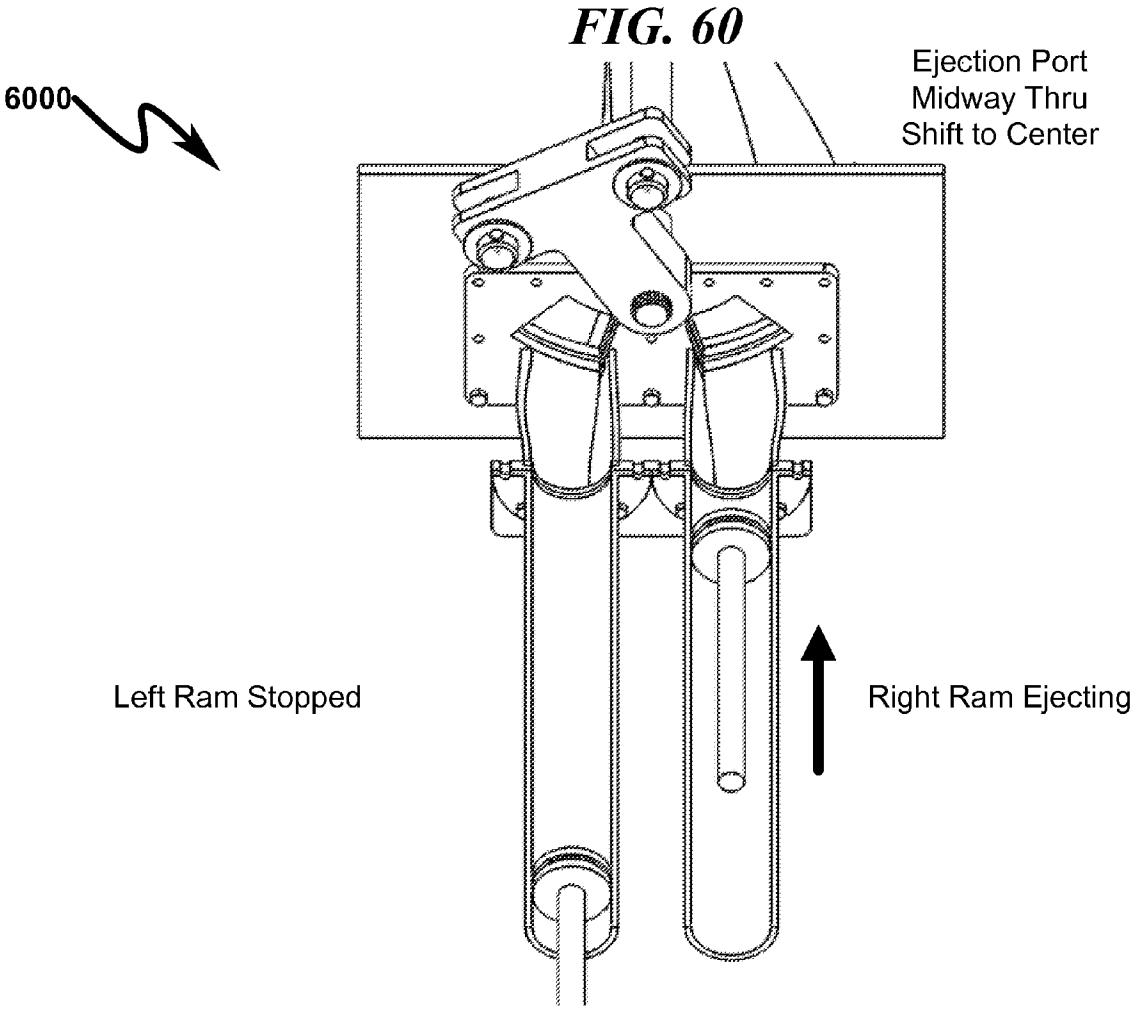
FIG. 60 illustrates a front perspective view of a preferred exemplary embodiment of the present invention utilizing a sectioned annular-ring-shaped spectacle plate configured with the ejection port positioned midway thru shift to center with the left ram stopped and the right ram ejecting.
Figure 61:
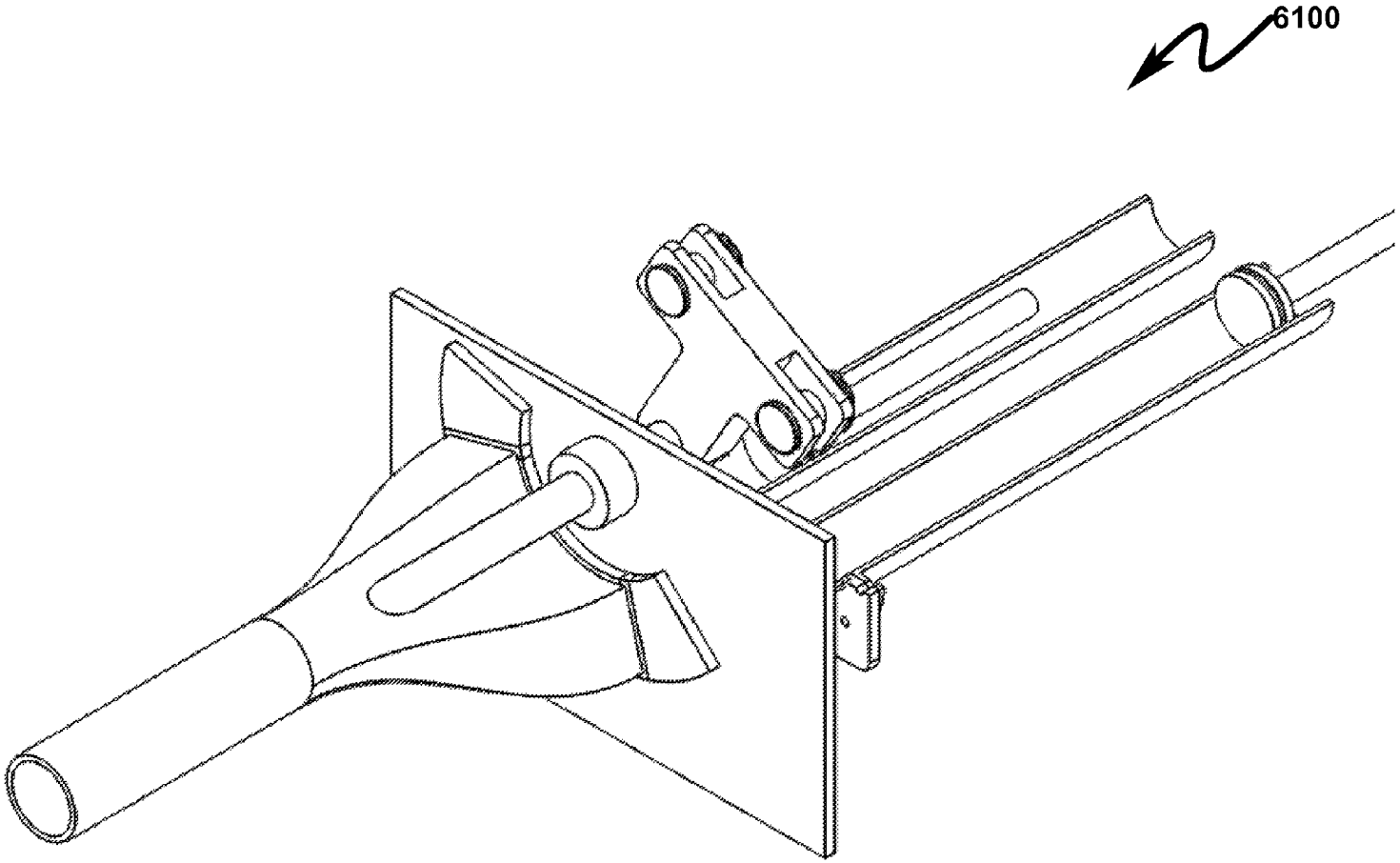
FIG. 61 illustrates a rear perspective view of a preferred exemplary embodiment of the present invention utilizing a sectioned annular-ring-shaped spectacle plate configured with the ejection port positioned midway thru shift to center with the left ram stopped and the right ram ejecting.

A preferred invention method embodiment may be generalized as illustrated in the flowcharts depicted in FIG. 41 (4100)-FIG. 43 (4300) and corresponding positional diagrams depicted in FIG. 44 (4400)-FIG. 61 (6100) wherein the method operates in conjunction with a concrete pump system comprising:

(a) material hopper (MHOP);
(b) trapezoidal-shaped spectacle plate (TSSP);
(c) hydraulic pump;

(d) trapezoidal-shaped cutting ring (TSCR); and (e) ejection port;

wherein the TSSP comprises a first trapezoidal inlet port (FTIP) and a second trapezoidal inlet port (STIP);

the TSSP is attached to the MHOP and configured to supply concrete from the MHOP to the hydraulic pump through the FTIP and the STIP;

the hydraulic pump comprises a first hydraulic pump ram (FHPR) and a second hydraulic pump ram (SHPR);

the FHPR is configured to accept concrete via the FTIP;

the SHPR is configured to accept concrete via the STIP;

the TSCR comprises a trapezoidal receiver output port (TROP) configured to alternately traverse between positions that cover the FTIP and the STIP;

the TROP is configured to direct concrete from the FTIP and the STIP to the ejection port;

the hydraulic pump is configured to eject concrete from the FHPR into the TROP when the TROP is positioned to cover the FTIP;

the hydraulic pump is configured to inject concrete from the MHOP into the SHPR when the TROP is positioned to cover the FTIP;

the hydraulic pump is configured to eject concrete from the SHPR into the TROP when the TROP is positioned to cover the STIP; and the hydraulic pump is configured to inject concrete from the MHOP into the FHPR when the TROP is positioned to cover the STIP;

wherein the method comprises the steps of:

(1) Centering the TROP over the TSSP to open the TROP to the FHPR and the SHPR (4101) (as depicted in FIG. 44 (4400) and FIG. 45 (4500));

(2) Ejecting material using the FHPR and the SHPR into the TROP (4102) (as depicted in FIG. 44 (4400) and FIG. 45 (4500));

(3) Shifting the TROP over the FHPR and sealing off the SHPR (4103) (as depicted in FIG. 46 (4600) and FIG. 47 (4700));

(4) Ejecting material into the TROP using the FHPR (4104) (as depicted in FIG. 46 (4600) and FIG. 47 (4700));

(5) Shifting the TROP over the FHPR and opening the SHPR to the MHOP (4105) (as depicted in FIG. 48 (4800) and FIG. 49 (4900));

(6) Ejecting material into the TROP using the FHPR and injecting material from the MHOP using the SHPR (4106) (as depicted in FIG. 48 (4800) and FIG. 49 (4900));

(7) Shifting the TROP over the FHPR and opening the SHPR to the MHOP (4207) (as depicted in FIG. 50 (5000) and FIG. 51 (5100));

(8) Ejecting material into the TROP using the FHPR and injecting material from the MHOP using the SHPR (optionally at twice the ejection rate of the FHPR) (4208) (as depicted in FIG. 50 (5000) and FIG. 51 (5100));

(9) Shifting the TROP over the FHPR and sealing off the SHPR (4209) (as depicted in FIG. 52 (5200) and FIG. 53 (5300));

(10) Ejecting material into the TROP using the FHPR and stopping the SHPR when fully loaded (4210) (as depicted in FIG. 52 (5200) and FIG. 53 (5300));

(11) Centering the TROP over the TSSP to open the TROP to the FHPR and the SHPR (4211) (as depicted in FIG. 54 (5400) and FIG. 55 (5500));

(12) Ejecting material into the TROP using the FHPR and the SHPR (4212) (as depicted in FIG. 54 (5400) and FIG. 55 (5500));

(13) Shifting the TROP over the SHPR and sealing off the FHPR (4313) (as depicted in FIG. 56 (5600) and FIG. 57 (5700));

(14) Ejecting material into the TROP using the SHPR and stopping the FHPR when fully ejected (4314) (as depicted in FIG. 56 (5600) and FIG. 57 (5700));

(15) Shifting the TROP over the SHPR and opening the FHPR to the MHOP (4315) (as depicted in FIG. 58 (5800) and FIG. 59 (5900));

(16) Ejecting material into the TROP using the SHPR and injecting material from the MHOP using the FHPR (optionally at twice the ejection rate of the SHPR) (4316) (as depicted in FIG. 58 (5800) and FIG. 59 (5900));

(17) Shifting the TROP over the SHPR and sealing off the FHPR (4317) (as depicted in FIG. 60 (6000) and FIG. 61 (6100));

(18) Ejecting material into the TROP using the SHPR and stopping the FHPR when fully loaded (4318) (as depicted in FIG. 60 (6000) and FIG. 61 (6100)); and

(19) Proceeding to step (1) to repeat material pumping operations.

One skilled in the art will recognize that this method as depicted is applied to a pumping system having two hydraulic pump rams (HPRs). Other preferred invention embodiments may employ a plurality of HPRs in a coordinated fashion using the same techniques to achieve higher pump flow rates as discussed elsewhere herein.

Annulus Transition Sizing Calculations

Figure 40:
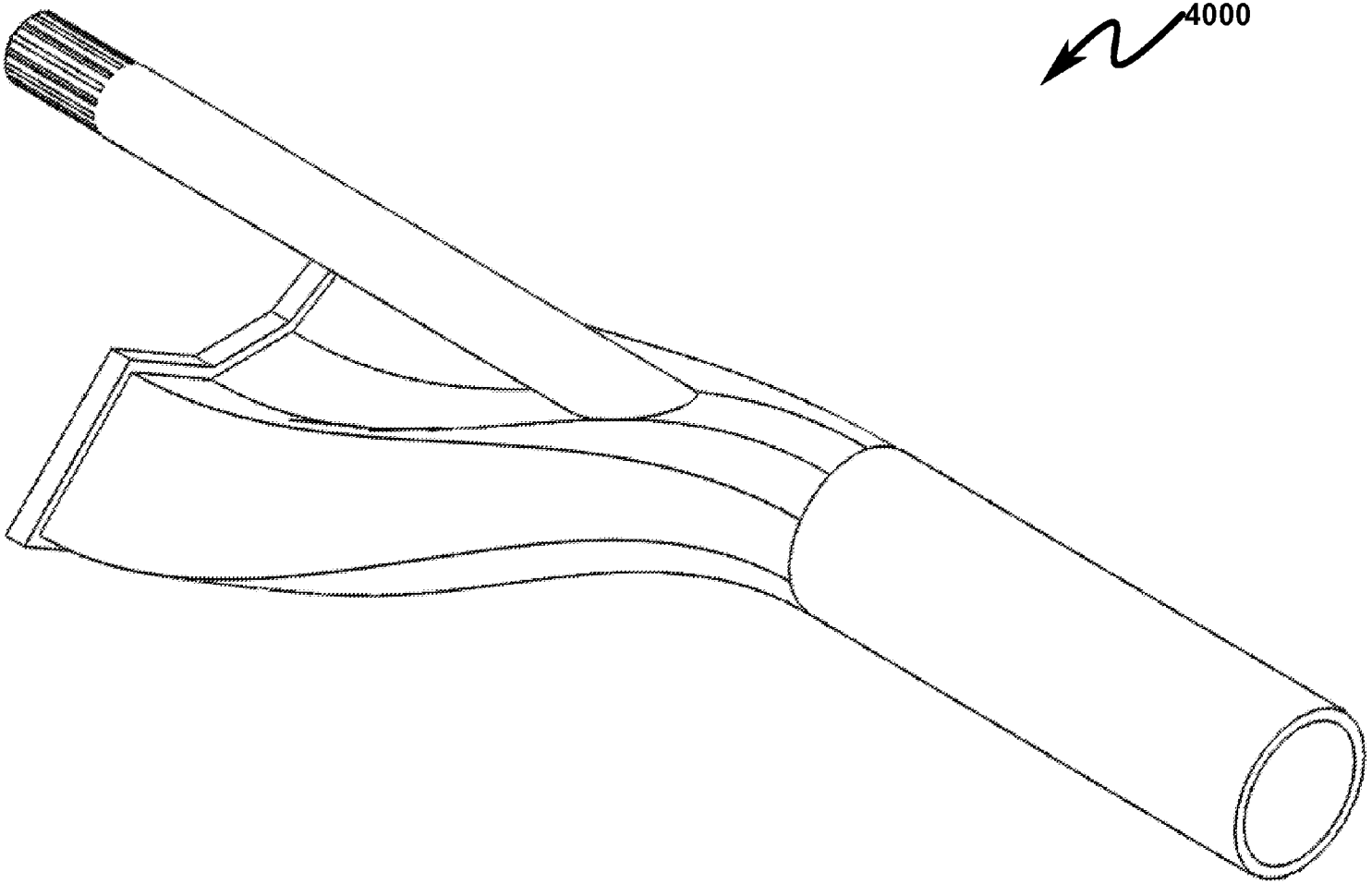
FIG. 40 illustrates a rear perspective detail view of a preferred exemplary embodiment of the present invention utilizing a trapezoidal-shaped spectacle plate and corresponding ejection port/cutting plate and detailing the ejection port and cutting plate construction.

As generally depicted in FIG. 25 (2500)-FIG. 40 (4000), the transition interfaces between the pump cylinders and the spectacle plate may be optimally sized in some preferred embodiments so that the circular pump cylinder face area and the trapezoidal spectacle plate interfaces are approximately equal. One skilled in the art will readily be able to calculate the required spectacle plate sizing for these preferred embodiments.

Mechanical Methods of Operation (6200)-(6400)

Figure 62:
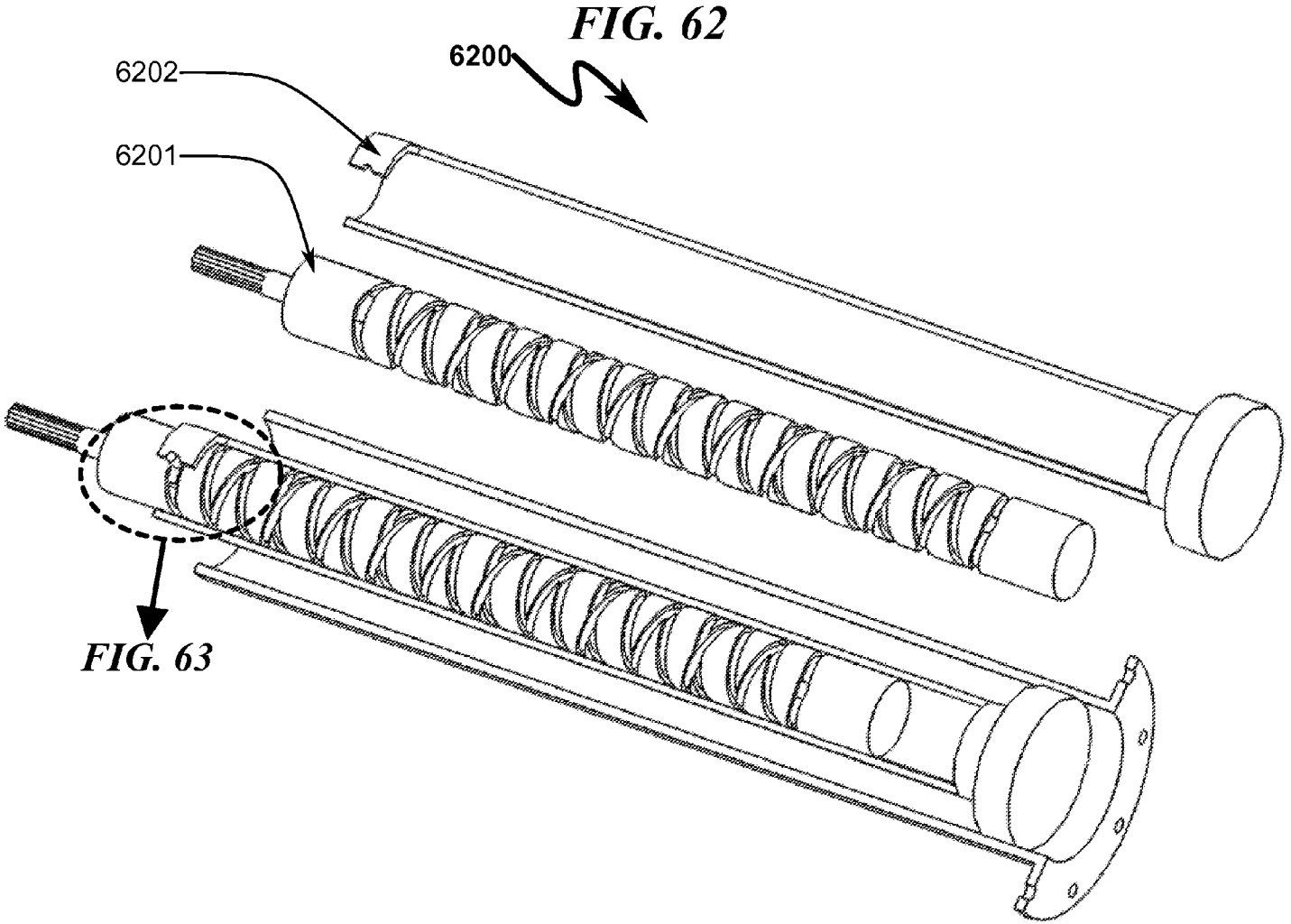
FIG. 62 illustrates a perspective sectional view of a preferred exemplary embodiment of the present invention incorporating a shaft-driven pumping system.
Figure 63:
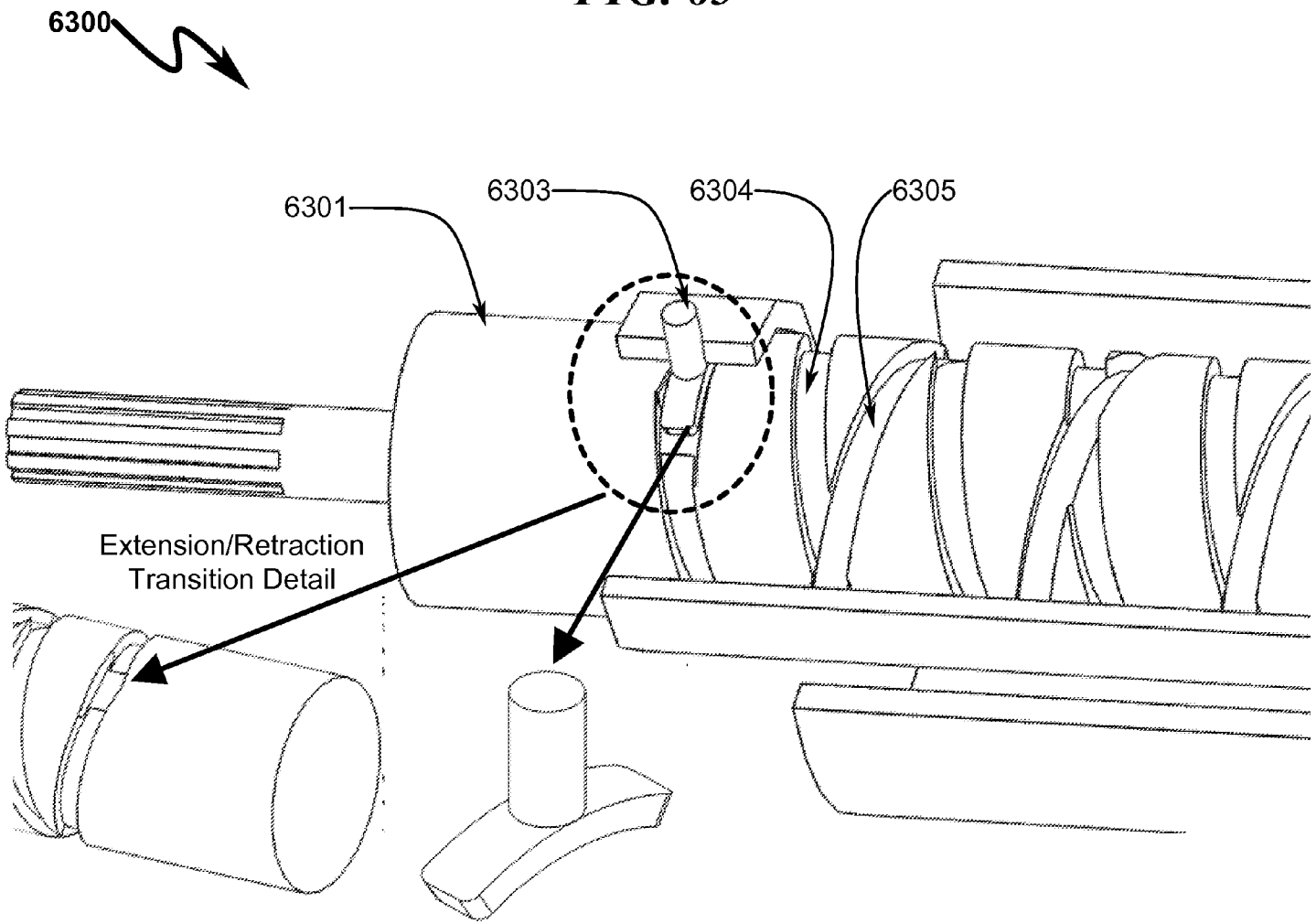
FIG. 63 illustrates a detail perspective sectional view of a preferred exemplary embodiment of the present invention incorporating a shaft-driven pumping system.

While many preferred invention embodiments operate hydraulically, the present invention also anticipates that some embodiments may operate mechanically. Within this context, there are various methods to achieve these functions including:

Threaded Driveshaft Operation. As generally depicted in FIG. 62 (6200) and FIG. 63 (6300), the present invention may in some preferred embodiments be implemented using a threaded driveshaft (6201) to operate the pump cylinder pistons (6202). In this embodiment gear or chain driven threaded driveshafts (6201) incorporate an automatic reversing channel thread (6304, 6305) that retracts the rams (6202) at a faster rate than it extends the rams (6202). Within this context a driveshaft engagement key (6303) rides within the right-handed (6304) and left-handed (6305) channels of the driveshaft (6301) to affect the extension and retraction cycles respectively. As an operational example, assume a 1.00 thread per inch extension and a 1.25 thread per inch retraction pitch. A 40-inch long thread stroke would thus create one full extension in 40 revolutions and a full retraction in 32 revolutions. Using two units driven simultaneously results in a 4-inch simultaneous extension (pumping) at the beginning and end of every stroke. This varying pumping flow can also be accomplished using a variable thread pitch along the shaft on the extension stroke. For example, the first and last portion of the threaded shaft can be at a lesser TPI than the middle portion of the shaft. This would create pistons that stroke at different rates as they discharge simultaneously during the beginning and end of their strokes than in the middle when discharging singularly. The retraction TPI would still generally be at a faster rate to retract in about half the revolutions as compared to the extension cycle.

Figure 64:
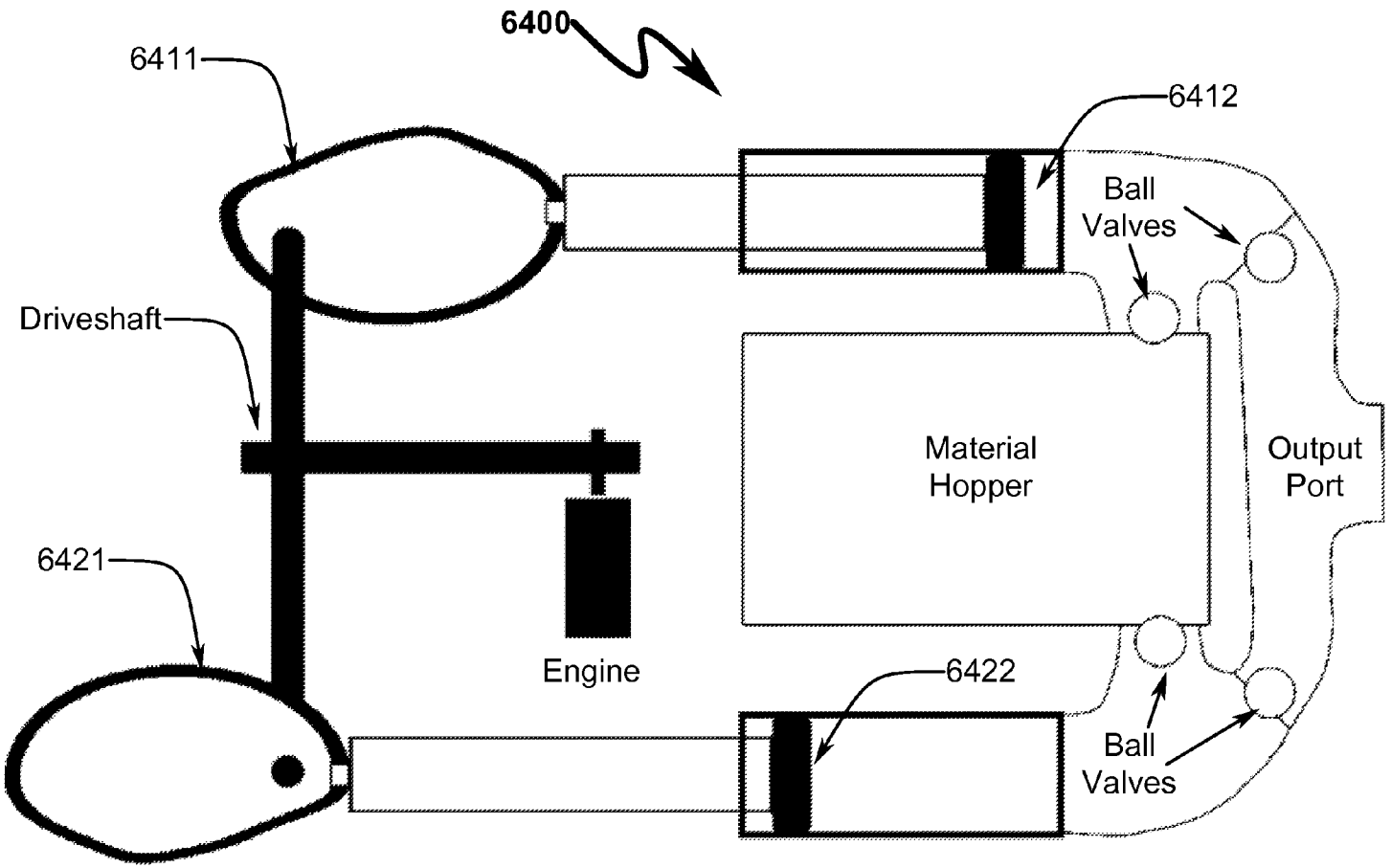
FIG. 64 illustrates a schematic diagram of a preferred exemplary invention embodiment utilizing a cam-driven pump lever ram operation with ball valves.

Cam driven mechanical lever rams. As generally depicted in FIG. 64 (6400), the present invention functionality can also be accomplished utilizing cam (6411, 6421) driven lever rams (6412, 6422). The cam drives (6411, 6421) allow the retract stroke to be at a faster rate than the discharge. This allows the timing of the beginning of each cylinder stroke to begin prior to the opposite cylinder finishing its discharge stroke while being driven by a common drive shaft power apparatus that maintains a constant speed.

One skilled in the art will recognize that these mechanical implementations are only exemplary of a variety of methods that may be used to affect the disclosed pumping action. With respect to the threaded driveshaft (6201) embodiment, the implementation of the driveshaft engagement key (6303) may have many forms, but in general is designed to ride within the threads of the threaded driveshaft (6201) in such a way that transition between the right-handed (6304) and left-handed (6305) threaded regions is possible at the distal ends of the threaded driveshaft (6201).

Differentiation with the Prior Art (6500, 6600)

All other twin reciprocating concrete pumps in the prior art exhibit a surging discharge of material. This is due to the inherit design of a round cutting ring valve at round discharge spectacle plates from the pumping cylinders. Pressure is lost and actual backflow of material is unpreventable during the valve shift (through the center position). Some prior art configurations try to cushion how the pumping pistons start each stroke to reduce the destructive forces while others add shock absorbing air cylinders to the discharge pipeline.

The present invention utilizes a "YS Tube" discharge port that is designed to never allow the pressurized discharge material pressure to be relaxed nor back-flow into the material hopper. This is achieved by the use of a trapezoidal-shaped cutting ring and spectacle plate.

There is never a position that the "YS Tube" is in during transitioning from one discharge port to the other that allows material pressure to bleed off or backflow into the loading hopper. The trapezoidal cutting ring completely seals off the trapezoid spectacle ports as it transitions across the spectacle plate during cycle changes.

The trapezoidal ejection port shape is designed with the same or larger material face area as an equivalent round spectacle plate to allow for the harsh mixes to still flow without a reduction in flow rate. For example, an 8-inch I.D. round cutting ring has a flow area of approximately 50.24 square inches. A trapezoid design generally provides an equal or larger flow area by construction of appropriate side lengths of the trapezoid having opposite side dimensions of approximately 4/6 inches and 10/10 inches respectively.

In addition, the "YS Tube" design described herein has three operating positions. The center position allows both pumping pistons to begin its discharge stroke simultaneously prior to the other piston finishing their respective discharge stroke. This results in the pistons retracting (loading concrete) at a faster rate than they discharge (pump concrete). Prior art twin piston pumps reciprocate simultaneously at the same retract (loading) rate as discharging (pumping) rate.

Figure 65:
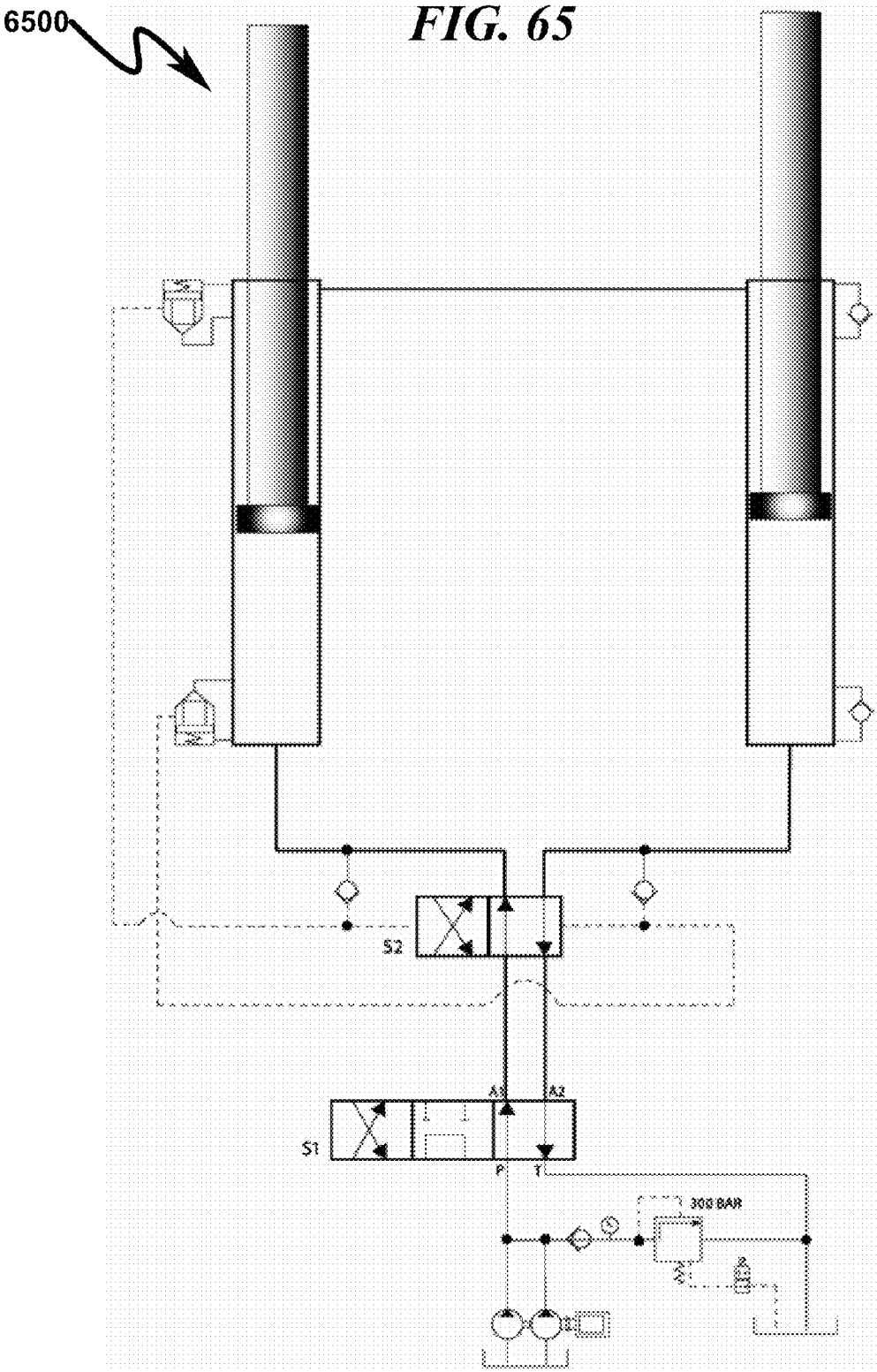
FIG. 65 illustrates a hydraulic schematic diagram of a typical prior art twin cylinder concrete pump system.
Figure 66:
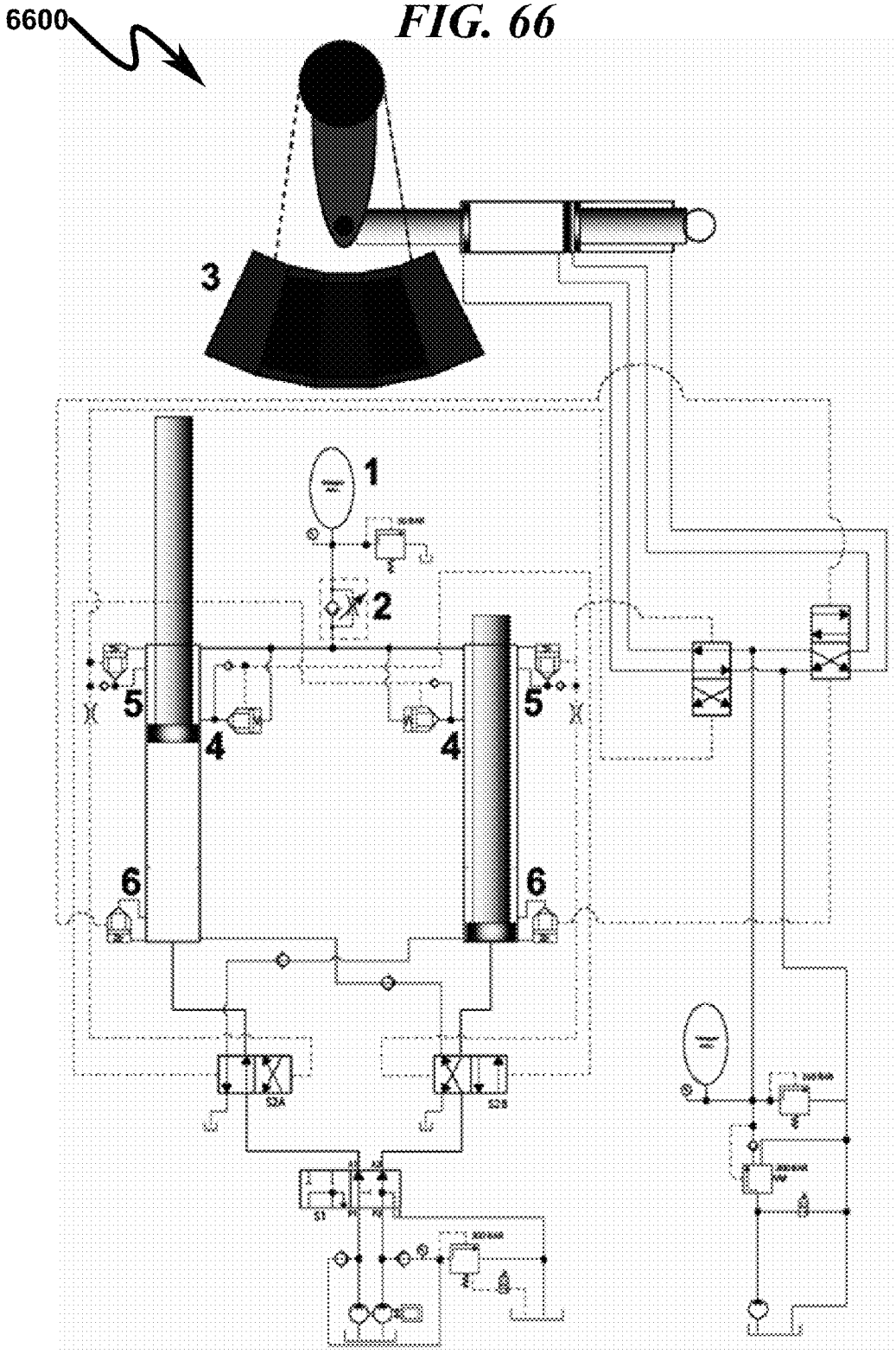
FIG. 66 illustrates a hydraulic schematic diagram of a preferred exemplary invention embodiment utilizing a trapezoidal spectacle plate ejection port that may in some embodiments be substituted by ball valves.

There are various methods hydraulically to achieve the pumping functions described herein. FIG. 65 (6500) depicts a traditional concrete pump schematic and is contrasted with FIG. 66 (6600) which illustrates an exemplary invention system schematic that may be used to implement some of the features of the present invention which may include:

Referencing FIG. 66 (6600), one embodiment may utilize an accumulator (1) in the slave oil of the hydraulic differential cylinders that stores the energy from both cylinders during their discharge strokes. This is accomplished by the 75% signal port (4) on each cylinder which causes both cylinders to discharge simultaneously. That energy is then released and controlled by the throttle check valve (2) once a cylinder reaches its full discharge stroke and the YS tube (3) has been shifted. The 100% signal port (5) activates the YS tube (3) to shift the accumulator (1) to unload its stored energy controllably through the throttle check valve (2) along with the slave oil from the opposite cylinder to retract the loading cylinder at a faster rate. Once the retracted cylinder reaches the 0% port (6), the YS tube is shifted and the retracted cylinder rests until the discharging cylinder reaches the 75% signal port (4) and it all repeats.

For the grout and small aggregate concrete, ball valve type concrete pump machines are very popular. They may utilize both hydraulic and mechanical pumping cylinders. Again, having both pumping pistons begin their discharge stroke simultaneously prior to the other piston finishing its discharge stroke will provide a truly continuous flow.

As indicated in the examples provided herein, the use of hydraulic and/or mechanical controls to drive the pump cylinders may take many forms. Included within the scope of the present invention is the anticipation that these hydraulic/mechanical controls may be computer driven and be manipulated by machine instructions read from a computer readable medium. Thus, with the proper computer control configuration, a variety of pump cycles incorporating the trapezoidal shaped spectacle plate may be implemented to support a variety of material delivery methodologies, material consistencies, piping configurations, and specific job site requirements. This may permit a single concrete pump hardware configuration to be programmed to support a wide variety of materials and work environments without the need for significant hardware modifications to the machinery.

Preferred Embodiment System Summary

The present invention preferred exemplary system embodiment anticipates a wide variety of variations in the basic theme of construction, but can be generalized as a concrete pump system comprising:

(a) material hopper (MHOP);
(b) trapezoidal-shaped spectacle plate (TSSP);
(c) hydraulic pump;
(d) trapezoidal-shaped cutting ring (TSCR); and
(e) ejection port;

wherein the TSSP comprises a first trapezoidal inlet port (FTIP) and a second trapezoidal inlet port (STIP);

the TSSP is attached to the MHOP and configured to supply concrete from the MHOP to the hydraulic pump through the FTIP and the STIP;

the hydraulic pump comprises a first hydraulic pump ram (FHPR) and a second hydraulic pump ram (SHPR);

the FHPR is configured to accept concrete via the FTIP;

the SHPR is configured to accept concrete via the STIP;

the TSCR comprises a trapezoidal receiver output port (TROP) configured to alternately traverse between positions that cover the FTIP and the STIP;

the TROP is configured to direct concrete from the FTIP and the STIP to the ejection port;

the hydraulic pump is configured to eject concrete from the FHPR into the TROP when the TROP is positioned to cover the FTIP;

the hydraulic pump is configured to inject concrete from the MHOP into the SHPR when the TROP is positioned to cover the FTIP;

the hydraulic pump is configured to eject concrete from the SHPR into the TROP when the TROP is positioned to cover the STIP; and the hydraulic pump is configured to inject concrete from the MHOP into the FHPR when the TROP is positioned to cover the STIP.

This general system summary may be augmented by the various elements described herein to produce a wide variety of invention embodiments consistent with this overall design description.

Preferred Embodiment Method Summary

The present invention preferred exemplary method embodiment anticipates a wide variety of variations in the basic theme of implementation, but can be generalized as a concrete pump method, the method operating in conjunction with a concrete pump system comprising:

(a) material hopper (MHOP);

(b) trapezoidal-shaped spectacle plate (TSSP);

(c) hydraulic pump;

(d) trapezoidal-shaped cutting ring (TSCR); and (e) ejection port;

wherein the TSSP comprises a first trapezoidal inlet port (FTIP) and a second trapezoidal inlet port (STIP);

the TSSP is attached to the MHOP and configured to supply concrete from the MHOP to the hydraulic pump through the FTIP and the STIP;

the hydraulic pump comprises a first hydraulic pump ram (FHPR) and a second hydraulic pump ram (SHPR);

the FHPR is configured to accept concrete via the FTIP;

the SHPR is configured to accept concrete via the STIP;

the TSCR comprises a trapezoidal receiver output port (TROP) configured to alternately traverse between positions that cover the FTIP and the STIP;

the TROP is configured to direct concrete from the FTIP and the STIP to the ejection port;

the hydraulic pump is configured to eject concrete from the FHPR into the TROP when the TROP is positioned to cover the FTIP;

the hydraulic pump is configured to inject concrete from the MHOP into the SHPR when the TROP is positioned to cover the FTIP;

the hydraulic pump is configured to eject concrete from the SHPR into the TROP when the TROP is positioned to cover the STIP; and the hydraulic pump is configured to inject concrete from the MHOP into the FHPR when the TROP is positioned to cover the STIP;

wherein the method comprises the steps of:

(1) Centering the TROP over the TSSP to open the TROP to the FHPR and the SHPR;

(2) Ejecting material using the FHPR and the SHPR into the TROP;

(3) Shifting the TROP over the FHPR and sealing off the SHPR;

(4) Ejecting material into the TROP using the FHPR;

(5) Shifting the TROP over the FHPR and opening the SHPR to the MHOP;

(6) Ejecting material into the TROP using the FHPR and injecting material from the MHOP using the SHPR;

(7) Shifting the TROP over the FHPR and opening the SHPR to the MHOP;

(8) Ejecting material into the TROP using the FHPR and injecting material from the MHOP using the SHPR (optionally at twice the ejection rate of the FHPR);

(9) Shifting the TROP over the FHPR and sealing off the SHPR;

(10) Ejecting material into the TROP using the FHPR and stopping the SHPR when fully loaded;

(11) Centering the TROP over the TSSP to open the TROP to the FHPR and the SHPR;

(12) Ejecting material into the TROP using the FHPR and the SHPR;

(13) Shifting the TROP over the SHPR and sealing off the FHPR;

(14) Ejecting material into the TROP using the SHPR and stopping the FHPR when fully ejected;

(15) Shifting the TROP over the SHPR and opening the FHPR to the MHOP;

(16) Ejecting material into the TROP using the SHPR and injecting material from the MHOP using the FHPR (optionally at twice the ejection rate of the SHPR);

(17) Shifting the TROP over the SHPR and sealing off the FHPR;

(18) Ejecting material into the TROP using the SHPR and stopping the FHPR when fully loaded; and

(19) Proceeding to step (1) to repeat material pumping operations.

One skilled in the art will recognize that these method steps may be augmented or rearranged without limiting the teachings of the present invention. This general method summary may be augmented by the various elements described herein to produce a wide variety of invention embodiments consistent with this overall design description.

System/Method Variations

The present invention anticipates a wide variety of variations in the basic theme of construction. The examples presented previously do not represent the entire scope of possible usages. They are meant to cite a few of the almost limitless possibilities.

This basic system and method may be augmented with a variety of ancillary embodiments, including but not limited to:

An embodiment wherein the TSCR comprises a transfer cavity having a geometric shape selected from a group consisting of:

(1) four-sided polygons having exactly two sides that are parallel;

(2) four-sided polygons having two sets of sides that are parallel;

(3) four-sided polygons in which the legs on opposite sides of the polygon have the same length and the base angles have the same measure (isosceles trapezoid);

(4) four-sided polygons in which two adjacent angles are right angles (right trapezoid or right-angled trapezoid);
(5) four-sided polygons which have an inscribed circle (tangential trapezoid);
(6) four-sided parallelograms; and
(7) annular sectors comprising one or more sectors of an annulus or annular ring that approximate an isosceles trapezoid.

An embodiment wherein the TSSP comprises transfer cavities having a geometric shape selected from a group consisting of:
(1) four-sided polygons having exactly two sides that are parallel;
(2) four-sided polygons having two sets of sides that are parallel;
(3) four-sided polygons in which the legs on opposite sides of the polygon have the same length and the base angles have the same measure (isosceles trapezoid);
(4) four-sided polygons in which two adjacent angles are right angles (right trapezoid or right-angled trapezoid);
(5) four-sided polygons which have an inscribed circle (tangential trapezoid);
(6) four-sided parallelograms; and
(7) annular sectors comprising one or more sectors of an annulus or annular ring that approximate an isosceles trapezoid.

An embodiment wherein material is injected from the MHOP using the SHPR at twice the ejection rate of the FHPR.

An embodiment wherein material is injected from the MHOP using the FHPR at twice the ejection rate of the SHPR.

An embodiment wherein the FTIP further comprises a transition conduit that transitions from a cylindrical FHPR to a trapezoidal-shaped void in the TSSP.

An embodiment wherein the STIP further comprises a transition conduit that transitions from a cylindrical SHPR to a trapezoidal-shaped void in the TSSP.

An embodiment wherein the TSCR further comprises trapezoidal-shaped sealing wings configured to seal the FTIP and the STIP when positioned over the FTIP and the STIP.

An embodiment wherein the TSCR comprises a sector of an annulus having an area that is three times the cross sectional area of the FTIP and the STIP.

An embodiment wherein the TSCR sector comprises a sweep angle of approximately 90 degrees.

One skilled in the art will recognize that other embodiments are possible based on combinations of elements taught within the above invention description.

CONCLUSION

A concrete pump system/method configured to provide substantially constant flow of concrete or cement material has been disclosed. The system integrates a trapezoidal cutting ring and spectacle plate in conjunction with lofted transitional interfaces to the hydraulic pump cylinder rams and output ejection port to ensure that pressurized discharge concrete material is not allowed to be relaxed nor backflow into the material sourcing hopper. The trapezoidal cutting ring is configured to completely seal off the trapezoidal spectacle ports as it smoothly transitions between the hydraulic pump input ports during cycle changes thus generating a more uniform output flow of concrete while eliminating hopper backflow and hydraulic fluid shock. A control system is configured to coordinate operation of the hydraulic pump cylinder rams and cutting ring to ensure that output ejection port pressure and material flow is maintained at a relatively constant level throughout all portions of the pumping cycle.

What is claimed is:

1. A concrete pump system comprising:
(a) material hopper (MHOP);
(b) trapezoidal-shaped spectacle plate (TSSP);
(c) hydraulic pump;
(d) trapezoidal-shaped cutting ring (TSCR); and
(e) ejection port;
wherein
said TSSP comprises a first trapezoidal inlet port (FTIP) and a second trapezoidal inlet port (STIP);
said TSSP is attached to said MHOP and configured to supply concrete from said MHOP to said hydraulic pump through said FTIP and said STIP;
said hydraulic pump comprises a first hydraulic pump ram (FHPR) and a second hydraulic pump ram (SHPR);
said FHPR is configured to accept concrete via said FTIP;
said SHPR is configured to accept concrete via said STIP;
said TSCR comprises a trapezoidal receiver output port (TROP) configured to alternately traverse between positions that cover said FTIP and said STIP;
said TROP is configured to completely cover said FTIP and said STIP during said alternating traversal between said positions that cover said FTIP and said STIP;
said TROP is configured to direct concrete from said FTIP and said STIP to said ejection port;
said hydraulic pump is configured to eject concrete from said FHPR into said TROP when said TROP is positioned to cover said FTIP;
said hydraulic pump is configured to inject concrete from said MHOP into said SHPR when said TROP is positioned to cover said FTIP;
said hydraulic pump is configured to eject concrete from said SHPR into said TROP when said TROP is positioned to cover said STIP; and
said hydraulic pump is configured to inject concrete from said MHOP into said FHPR when said TROP is positioned to cover said STIP.

2. The concrete pump system of claim 1 wherein said TSCR comprises a transfer cavity having a geometric shape selected from a group consisting of:
(1) four-sided polygons having exactly two sides that are parallel;
(2) four-sided polygons having two sets of sides that are parallel;
(3) four-sided polygons in which the legs on opposite sides of the polygon have the same length and the base angles have the same measure (isosceles trapezoid);
(4) four-sided polygons in which two adjacent angles inside the polygon are right angles (right trapezoid or right-angled trapezoid);
(5) four-sided polygons which have each side tangent to an inscribed circle (tangential trapezoid);
(6) four-sided parallelograms; and
(7) annular sectors comprising one or more sectors of an annulus or annular ring that approximate an isosceles trapezoid.

3. The concrete pump system of claim 1 wherein said TSSP comprises transfer cavities having a geometric shape selected from a group consisting of:
(1) four-sided polygons having exactly two sides that are parallel;

(2) four-sided polygons having two sets of sides that are parallel;

(3) four-sided polygons in which the legs on opposite sides of the polygon have the same length and the base angles have the same measure (isosceles trapezoid);

(4) four-sided polygons in which two adjacent angles inside the polygon are right angles (right trapezoid or right-angled trapezoid);

(5) four-sided polygons which have each side tangent to an inscribed circle (tangential trapezoid);

(6) four-sided parallelograms; and (7) annular sectors comprising one or more sectors of an annulus or annular ring that approximate an isosceles trapezoid.

4. The concrete pump system of claim 1 wherein material is injected from said MHOP using the SHPR at twice the ejection rate of said FHPR.

5. The concrete pump system of claim 1 wherein material is injected from said MHOP using the FHPR at twice the ejection rate of said SHPR.

6. The concrete pump system of claim 1 wherein said FTIP further comprises a transition conduit that transitions from a cylindrical FHPR to a trapezoidal-shaped void in said TSSP.

7. The concrete pump system of claim 1 wherein said STIP further comprises a transition conduit that transitions from a cylindrical SHPR to a trapezoidal-shaped void in said TSSP.

8. The concrete pump system of claim 1 wherein said TSCR further comprises trapezoidal-shaped sealing wings configured to seal said FTIP and said STIP when positioned over said FTIP and said STIP.

9. The concrete pump system of claim 1 wherein said TSCR comprises a sector of an annulus having an area that is three times the cross sectional area of said FTIP and said STIP.

10. The concrete pump system of claim 9 wherein said TSCR sector comprises a sweep angle of approximately 90 degrees.

11. A concrete pump method, said method operating in conjunction with a concrete pump system comprising:

(a) material hopper (MHOP);

(b) trapezoidal-shaped spectacle plate (TSSP);

(c) hydraulic pump;

(d) trapezoidal-shaped cutting ring (TSCR); and (e) ejection port;

wherein said TSSP comprises a first trapezoidal inlet port (FTIP) and a second trapezoidal inlet port (STIP);

said TSSP is attached to said MHOP and configured to supply concrete from said MHOP to said hydraulic pump through said FTIP and said STIP;

said hydraulic pump comprises a first hydraulic pump ram (FHPR) and a second hydraulic pump ram (SHPR);

said FHPR is configured to accept concrete via said FTIP;

said SHPR is configured to accept concrete via said STIP;

said TSCR comprises a trapezoidal receiver output port (TROP) configured to alternately traverse between positions that cover said FTIP and said STIP;

said TROP is configured to direct concrete from said FTIP and said STIP to said ejection port;

said hydraulic pump is configured to eject concrete from said FHPR into said TROP when said TROP is positioned to cover said FTIP;

said hydraulic pump is configured to inject concrete from said MHOP into said SHPR when said TROP is positioned to cover said FTIP;

said hydraulic pump is configured to eject concrete from said SHPR into said TROP when said TROP is positioned to cover said STIP; and said hydraulic pump is configured to inject concrete from said MHOP into said FHPR when said TROP is positioned to cover said STIP;

wherein said method comprises the steps of:

(1) Centering said TROP over said TSSP to open said TROP to said FHPR and said SHPR;

(2) Ejecting material using said FHPR and said SHPR into said TROP;

(3) Shifting said TROP over said FHPR and sealing off said SHPR;

(4) Ejecting material into said TROP using said FHPR;

(5) Shifting said TROP over said FHPR and opening said SHPR to said MHOP;

(6) Ejecting material into said TROP using said FHPR and injecting material from said MHOP using said SHPR;

(7) Shifting said TROP over said FHPR and opening said SHPR to said MHOP;

(8) Ejecting material into said TROP using said FHPR and injecting material from said MHOP using said SHPR;

(9) Shifting said TROP over said FHPR and sealing off said SHPR;

(10) Ejecting material into said TROP using said FHPR and stopping said SHPR when fully loaded;

(11) Centering said TROP over said TSSP to open said TROP to said FHPR and said SHPR;

(12) Ejecting material into said TROP using said FHPR and said SHPR;

(13) Shifting said TROP over said SHPR and sealing off said FHPR;

(14) Ejecting material into said TROP using said SHPR and stopping said FHPR when fully ejected;

(15) Shifting said TROP over said SHPR and opening said FHPR to said MHOP;

(16) Ejecting material into said TROP using said SHPR and injecting material from said MHOP using said FHPR;

(17) Shifting said TROP over said SHPR and sealing off said FHPR;

(18) Ejecting material into said TROP using said SHPR and stopping said FHPR when fully loaded; and

(19) Proceeding to step (1) to repeat material pumping operations.

12. The concrete pump method of claim 11 wherein said TSCR comprises a transfer cavity having a geometric shape selected from a group consisting of:

(1) four-sided polygons having exactly two sides that are parallel;

(2) four-sided polygons having two sets of sides that are parallel;

(3) four-sided polygons in which the legs on opposite sides of the polygon have the same length and the base angles have the same measure (isosceles trapezoid);

(4) four-sided polygons in which two adjacent angles inside the polygon are right angles (right trapezoid or right-angled trapezoid);

(5) four-sided polygons which have each side tangent to an inscribed circle (tangential trapezoid);

(6) four-sided parallelograms; and (7) annular sectors comprising one or more sectors of an annulus or annular ring that approximate an isosceles trapezoid.

13. The concrete pump method of claim 11 wherein said TSSP comprises transfer cavities having a geometric shape selected from a group consisting of:

(1) four-sided polygons having exactly two sides that are parallel;
(2) four-sided polygons having two sets of sides that are parallel;
(3) four-sided polygons in which the legs on opposite sides of the polygon have the same length and the base angles have the same measure (isosceles trapezoid);
(4) four-sided polygons in which two adjacent angles inside the polygon are right angles (right trapezoid or right-angled trapezoid);
(5) four-sided polygons which have each side tangent to an inscribed circle (tangential trapezoid);
(6) four-sided parallelograms; and
(7) annular sectors comprising one or more sectors of an annulus or annular ring that approximate an isosceles trapezoid.

14. The concrete pump method of claim 11 wherein material is injected from said MHOP using the SHPR at twice the ejection rate of said FHPR.

15. The concrete pump method of claim 11 wherein material is injected from said MHOP using the FHPR at twice the ejection rate of said SHPR.

16. The concrete pump method of claim 11 wherein said FTIP further comprises a transition conduit that transitions from a cylindrical FHPR to a trapezoidal-shaped void in said TSSP.

17. The concrete pump method of claim 11 wherein said STIP further comprises a transition conduit that transitions from a cylindrical SHPR to a trapezoidal-shaped void in said TSSP.

18. The concrete pump method of claim 11 wherein said TSCR further comprises trapezoidal-shaped sealing wings configured to seal said FTIP and said STIP when positioned over said FTIP and said STIP.

19. The concrete pump method of claim 11 wherein said TSCR comprises a sector of an annulus having an area that is three times the cross sectional area of said FTIP and said STIP.

20. The concrete pump method of claim 19 wherein said TSCR sector comprises a sweep angle of approximately 90 degrees.

* * * * *